US011370596B1

(12) United States Patent
Fugere

(10) Patent No.: US 11,370,596 B1
(45) **Date of Patent: *Jun. 28, 2022**

(54) MICRO-VOLUME DISPENSE PUMP SYSTEMS AND METHODS

(71) Applicant: DL Technology, LLC, Haverhill, MA (US)

(72) Inventor: Jeffrey P. Fugere, Hampton Falls, NH (US)

(73) Assignee: DL Technology, LLC., Haverhill, MA (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/225,358

(22) Filed: Apr. 8, 2021

Related U.S. Application Data

(63) Continuation of application No. 16/503,676, filed on Jul. 5, 2019, now Pat. No. 11,059,654, which is a continuation of application No. 15/646,265, filed on Jul. 11, 2017, now Pat. No. 10,370,172, which is a continuation of application No. 13/774,447, filed on Feb. 22, 2013, now Pat. No. 9,725,225.

(Continued)

(51) Int. Cl.
*B65D 83/00* (2006.01)

(52) U.S. Cl.
CPC ..... *B65D 83/00* (2013.01)

(58) Field of Classification Search
CPC ... B05B 15/10; B05B 11/3074; B05B 15/065; B05B 1/3026; B05B 11/007; B05B 11/0072; B05B 12/002; B05B 1/02; B05B 7/12; B05B 1/1636
USPC ..... 222/380, 504, 320, 531, 532, 310, 525
See application file for complete search history.

(56) References Cited

U.S. PATENT DOCUMENTS 248,555 A 10/1881 Clarke
537,201 A 4/1895 Haldeman
(Continued)

FOREIGN PATENT DOCUMENTS

EP 0110591 6/1984
WO 0001495 1/2000

OTHER PUBLICATIONS

"Micro-Volume Dispense Pump Systems and Methods" Specification, Drawings, and Prosecution History of U.S. Appl. No. 13/774,447, filed Feb. 22, 2013, now U.S. Pat. No. 9,725,225, issued Aug. 8, 2017, by Jeffrey P. Fugere.

(Continued)

*Primary Examiner* — Paul R Durand
*Assistant Examiner* — Michael J. Melaragno
(74) *Attorney, Agent, or Firm* — Onello & Mello, LLP

(57) ABSTRACT

Provided is a fluid dispense pump comprising a pump housing and a cartridge body positioned along an axis. The cartridge body comprises a chamber and a feed aperture extending through a surface of the cartridge body to the chamber. A fluid shaft extends through the cartridge body along the axis. The fluid shaft has an inlet port positioned in the chamber of the cartridge body. One of the cartridge body and the fluid shaft is attached to the pump housing and is fixed relative to the pump housing. The other of the cartridge body and the fluid shaft moves relative to the one of the cartridge body and the fluid shaft to change a position of the inlet port relative to the feed aperture during a dispensing operation.

18 Claims, 37 Drawing Sheets

Related U.S. Application Data

(60) Provisional application No. 61/602,823, filed on Feb. 24, 2012.

(56) References Cited

U.S. PATENT DOCUMENTS

| | | | |
|---|---|---|---|
| 796,256 | A | 8/1905 | Sanders |
| 1,038,231 | A | 9/1912 | Taylor et al. |
| 1,345,965 | A | 7/1920 | Shute |
| 1,397,220 | A | 11/1921 | Lord |
| 1,453,161 | A | 4/1923 | Murphy et al. |
| 1,458,718 | A | 6/1923 | Lord |
| 1,593,016 | A | 7/1926 | Campbell |
| 1,699,236 | A | 1/1929 | Goldrick |
| 1,730,099 | A | 10/1929 | Tribbett |
| 1,745,382 | A | 2/1930 | Roger |
| 2,054,881 | A | 9/1936 | Saunders |
| 2,165,398 | A | 7/1939 | Mazzanobile |
| 2,287,716 | A | 4/1941 | Whitfield |
| 2,269,823 | A | 1/1942 | Kreiselman |
| 2,410,517 | A | 11/1946 | Muller et al. |
| 2,506,657 | A | 5/1950 | Webster |
| 2,635,016 | A | 4/1953 | Doniak |
| 2,656,070 | A | 10/1953 | Linder |
| 2,729,364 | A | 1/1956 | Malko |
| 2,751,119 | A | 6/1956 | Manning, Sr. |
| 2,834,520 | A | 5/1958 | Nyden |
| 2,855,929 | A | 10/1958 | Hein |
| 2,901,153 | A | 8/1959 | Collins |
| 2,906,492 | A | 9/1959 | Conrad |
| 2,933,259 | A | 4/1960 | Raskin |
| 3,072,302 | A | 1/1963 | Giovannoni et al. |
| 3,330,294 | A | 7/1967 | Etal |
| 3,342,205 | A | 9/1967 | Quinto |
| 3,344,647 | A | 10/1967 | Berger |
| 3,355,766 | A | 12/1967 | Causemann |
| 3,379,196 | A | 4/1968 | Mitchell |
| 3,394,659 | A | 7/1968 | Van Alen |
| 3,473,557 | A | 10/1969 | Loe |
| 3,507,584 | A | 4/1970 | Robbins, Jr. |
| 3,545,479 | A | 12/1970 | Winston |
| 3,618,993 | A | 11/1971 | Platte |
| 3,693,884 | A | 9/1972 | Snodgrass et al. |
| 3,732,731 | A | 5/1973 | Fussell |
| 3,732,734 | A | 5/1973 | Avakian |
| 3,734,635 | A | 5/1973 | Black et al. |
| 3,756,730 | A | 9/1973 | Spatz |
| 3,771,476 | A | 11/1973 | Heinle |
| 3,790,128 | A | 2/1974 | Hempelmann et al. |
| 3,811,601 | A | 5/1974 | Reighard et al. |
| 3,865,281 | A | 2/1975 | Byrd et al. |
| 3,938,492 | A | 2/1976 | Mercer, Jr. |
| 3,945,569 | A | 3/1976 | Sperry |
| 3,963,151 | A | 6/1976 | North, Jr. |
| 3,963,884 | A | 6/1976 | Pollock |
| 3,985,032 | A | 10/1976 | Avakian |
| 4,004,715 | A | 1/1977 | Williams et al. |
| 4,040,875 | A | 8/1977 | Noble |
| 4,042,201 | A | 8/1977 | O'Callaghan |
| 4,072,330 | A | 2/1978 | Brysch |
| 4,077,180 | A | 3/1978 | Agent et al. |
| 4,116,766 | A | 9/1978 | Poindexter et al. |
| 4,168,942 | A | 9/1979 | Firth |
| 4,239,462 | A | 12/1980 | Dach et al. |
| 4,258,862 | A | 3/1981 | Thorsheim |
| 4,312,630 | A | 1/1982 | Travaglini |
| 4,338,925 | A | 7/1982 | Miller |
| 4,339,840 | A | 7/1982 | Monson |
| 4,341,329 | A | 7/1982 | Kuemmerer et al. |
| 4,346,849 | A | 8/1982 | Rood |
| 4,377,894 | A | 3/1983 | Yoshida |
| 4,386,483 | A | 6/1983 | Schlaefli |
| 4,397,407 | A | 8/1983 | Skoupi et al. |
| 4,400,708 | A | 8/1983 | Sachs |
| 4,408,699 | A | 10/1983 | Stock |
| 4,454,745 | A | 6/1984 | Cudini |
| 4,465,212 | A | 8/1984 | Boone |
| 4,471,890 | A | 9/1984 | Dougherty |
| 4,513,190 | A | 4/1985 | Ellett et al. |
| 4,523,741 | A | 6/1985 | Chandler |
| 4,572,103 | A | 2/1986 | Engel |
| 4,579,286 | A | 4/1986 | Stoudt |
| 4,584,964 | A | 4/1986 | Engel |
| 4,607,766 | A | 8/1986 | Jones |
| 4,610,377 | A | 9/1986 | Rasmussen |
| 4,629,099 | A | 12/1986 | Jones |
| 4,673,109 | A | 6/1987 | Cassia |
| 4,705,218 | A | 11/1987 | Daniels |
| 4,705,611 | A | 11/1987 | Grimes et al. |
| 4,729,544 | A | 3/1988 | Baumann |
| 4,743,243 | A | 5/1988 | Vaillancourt |
| 4,763,755 | A | 8/1988 | Murray |
| 4,785,996 | A | 11/1988 | Ziecker et al. |
| 4,803,124 | A | 2/1989 | Kunz |
| 4,836,422 | A | 6/1989 | Rosenberg |
| 4,859,073 | A | 8/1989 | Howseman, Jr. et al. |
| 4,917,274 | A | 4/1990 | Asa et al. |
| 4,919,204 | A | 4/1990 | Baker et al. |
| 4,935,015 | A | 6/1990 | Hall |
| 4,941,428 | A | 7/1990 | Engel |
| 4,969,602 | A | 11/1990 | Scholl |
| 4,974,755 | A | 12/1990 | Sonntag |
| 5,002,228 | A | 3/1991 | Su |
| 5,010,930 | A | 4/1991 | Colu |
| 5,052,591 | A | 10/1991 | Divall et al. |
| 5,065,910 | A | 11/1991 | Fie |
| 5,090,814 | A | 2/1992 | Petcen |
| 5,106,291 | A | 4/1992 | Gellert |
| 5,130,710 | A | 7/1992 | Salazar |
| 5,148,946 | A | 9/1992 | Mizuta et al. |
| 5,161,427 | A | 11/1992 | Fukuda et al. |
| 5,172,833 | A | 12/1992 | Faulkner, III |
| 5,176,803 | A | 1/1993 | Barbuto et al. |
| 5,177,901 | A | 1/1993 | Smith |
| 5,186,886 | A | 2/1993 | Zerinvary et al. |
| RE34,197 | E | 3/1993 | Engel |
| 5,199,169 | A | 4/1993 | Bonzak |
| 5,217,154 | A | 6/1993 | Elwood et al. |
| 5,226,625 | A | 7/1993 | Hanna |
| 5,236,162 | A | 8/1993 | Desjardins |
| 5,261,610 | A | 11/1993 | Waryu et al. |
| 5,265,773 | A | 11/1993 | Harada |
| 5,287,762 | A | 2/1994 | Bonzak |
| 5,344,052 | A | 9/1994 | Divall et al. |
| 5,348,453 | A | 9/1994 | Baran et al. |
| 5,375,743 | A | 12/1994 | Soudan |
| 5,407,101 | A | 4/1995 | Hubbard |
| 5,452,824 | A | 9/1995 | Dan et al. |
| 5,535,919 | A | 7/1996 | Ganzer et al. |
| 5,553,742 | A | 9/1996 | Maruyama et al. |
| 5,564,606 | A | 10/1996 | Engel |
| 5,567,300 | A | 10/1996 | Datta et al. |
| 5,569,934 | A | 10/1996 | Fujii et al. |
| 5,624,045 | A | 4/1997 | Highsmith et al. |
| 5,637,815 | A | 6/1997 | Takahata et al. |
| 5,685,853 | A | 11/1997 | Bonnet |
| 5,699,934 | A | 12/1997 | Kolcun et al. |
| 5,765,730 | A | 6/1998 | Richter |
| 5,785,068 | A | 7/1998 | Sasaki et al. |
| 5,795,390 | A | 8/1998 | Cavallaro |
| 5,803,661 | A | 9/1998 | Lemelson |
| 5,814,022 | A | 9/1998 | Antanavich et al. |
| 5,819,983 | A | 10/1998 | White et al. |
| 5,823,747 | A | 10/1998 | Ciavarini et al. |
| 5,833,851 | A | 11/1998 | Adams et al. |
| 5,837,892 | A | 11/1998 | Cavallaro et al. |
| 5,886,494 | A | 3/1999 | Prentice et al. |
| 5,903,125 | A | 5/1999 | Prentice et al. |
| 5,904,377 | A | 5/1999 | Throup |
| 5,918,648 | A | 7/1999 | Carr et al. |
| 5,925,187 | A | 7/1999 | Freeman et al. |
| 5,927,560 | A | 7/1999 | Lewis et al. |
| 5,931,355 | A | 8/1999 | Jefferson |
| 5,947,022 | A | 9/1999 | Freeman et al. |
| 5,947,509 | A | 9/1999 | Ricks et al. |

(56) References Cited

U.S. PATENT DOCUMENTS 5,957,343 A 9/1999 Cavallaro
5,964,378 A 10/1999 Sperry et al.
5,971,227 A 10/1999 White et al.
5,984,147 A 11/1999 Van Ngo
5,985,029 A 11/1999 Purcell
5,985,206 A 11/1999 Zabala et al.
5,985,216 A 11/1999 Rens et al.
5,988,530 A 11/1999 Rockefeller
5,992,688 A 11/1999 Lewis et al.
5,992,704 A 11/1999 Jager-Waldau
5,993,183 A 11/1999 Laskaris et al.
5,995,788 A 11/1999 Baek
6,007,631 A 12/1999 Prentice et al.
6,017,392 A 1/2000 Cavallaro
6,025,689 A 2/2000 Prentice et al.
6,068,202 A 5/2000 Hynes et al.
6,082,289 A 7/2000 Cavallaro
6,085,943 A 7/2000 Cavallaro et al.
6,088,892 A 7/2000 Bertsch et al.
6,093,251 A 7/2000 Carr et al.
6,112,588 A 9/2000 Cavallaro et al.
6,119,566 A 9/2000 Yan et al.
6,119,895 A 9/2000 Fugere et al.
6,123,167 A 9/2000 Miller et al.
6,126,039 A 10/2000 Cline et al.
6,132,396 A 10/2000 Antanavich et al.
6,157,157 A 12/2000 Prentice et al.
6,196,477 B1 3/2001 Halltorp et al.
6,196,521 B1 3/2001 Hynes et al.
6,199,566 B1 3/2001 Gazewood
6,206,964 B1 3/2001 Purcell et al.
6,207,220 B1 3/2001 Doyle et al.
6,214,117 B1 4/2001 Prentice et al.
6,216,917 B1 4/2001 Crouch
6,224,671 B1 5/2001 Cavallaro
6,224,675 B1 5/2001 Prentice et al.
6,234,358 B1 5/2001 Romine et al.
6,234,858 B1 5/2001 Nix
6,250,515 B1 6/2001 Newbold et al.
6,253,957 B1 7/2001 Messerly et al.
6,253,972 B1 7/2001 Devito et al.
6,257,444 B1 7/2001 Everett
6,258,165 B1 7/2001 Cavallaro
6,291,016 B1 9/2001 Donges et al.
6,299,031 B1 10/2001 Cavallaro et al.
6,299,078 B1 10/2001 Fugere
6,311,740 B1 11/2001 Sperry et al.
6,322,854 B1 11/2001 Purcell et al.
6,324,973 B2 12/2001 Rossmeisl et al.
6,354,471 B2 3/2002 Fujii
6,371,339 B1 4/2002 White et al.
6,378,737 B1 4/2002 Cavallaro et al.
6,383,292 B1 5/2002 Brand et al.
6,386,396 B1 5/2002 Strecker
6,391,378 B1 5/2002 Carr et al.
6,395,334 B1 5/2002 Prentice et al.
6,412,328 B1 7/2002 Cavallaro et al.
6,428,852 B1 8/2002 Pillion et al.
6,453,810 B1 9/2002 Rossmeisl et al.
6,511,301 B1 1/2003 Fugere
6,514,569 B1 2/2003 Crouch
6,540,832 B2 4/2003 Cavallaro
6,541,063 B1 4/2003 Prentice et al.
6,547,167 B1 4/2003 Fugere
6,562,406 B1 5/2003 Chikahisa et al.
6,581,906 B2 6/2003 Pott et al.
6,609,902 B1 8/2003 Blais et al.
6,619,198 B2 9/2003 Rossmeisl et al.
6,626,097 B2 9/2003 Rossmeisl et al.
6,644,517 B2 11/2003 Thiel et al.
6,719,174 B1 4/2004 Swift
6,729,507 B2 5/2004 Nagahata et al.
6,736,900 B2 5/2004 Isogai et al.
6,739,483 B2 5/2004 White et al.
6,775,879 B2 8/2004 Bibeault et al.
6,803,661 B2 10/2004 Thakar et al.
6,828,167 B2 12/2004 Kim
6,832,733 B2 12/2004 Engel
6,851,923 B1 2/2005 Fugere
6,866,881 B2 3/2005 Prentice et al.
6,886,720 B2 5/2005 Penn
6,892,959 B1 5/2005 Fugere
6,896,202 B1 5/2005 Fugere
6,957,783 B1 10/2005 Fugere
6,981,664 B1 1/2006 Fugere
6,983,867 B1 1/2006 Fugere
6,994,234 B2 2/2006 De Leeuw
7,000,853 B2 2/2006 Fugere
7,018,477 B2 3/2006 Engel
7,028,867 B2 4/2006 Acum et al.
7,128,731 B2 10/2006 Aramata et al.
7,176,746 B1 2/2007 Wang et al.
7,178,745 B1 2/2007 Fugere
7,190,891 B2 3/2007 Verrilli
7,207,498 B1 4/2007 Fugere
7,231,716 B2 6/2007 Verilli
7,293,691 B2 11/2007 Rossmeisl et al.
7,325,994 B2 2/2008 Liberatore
7,331,482 B1 2/2008 Fugere
RE40,539 E 10/2008 Fugere
7,434,753 B2 10/2008 Verrilli
7,448,857 B1 11/2008 Fugere
7,614,529 B2 11/2009 Bolyard, Jr. et al.
7,677,417 B2 3/2010 Leiner et al.
7,694,857 B1 4/2010 Fugere
7,744,022 B1 6/2010 Fugere
7,762,088 B2 7/2010 Fiske et al.
7,762,480 B1 7/2010 Fugere
7,874,456 B2 1/2011 Bolyard, Jr. et al.
7,905,945 B1 3/2011 Fugere
7,997,446 B2 8/2011 Engel
8,056,833 B1 11/2011 Fugere
8,197,582 B1 6/2012 Fugere
8,220,669 B1 7/2012 Fugere
8,220,699 B2 7/2012 Dong et al.
8,240,335 B1 8/2012 Broberg et al.
8,281,963 B2 10/2012 Liu
8,353,429 B2 1/2013 Zhou et al.
8,448,818 B2 5/2013 Ikushima
8,480,015 B1 7/2013 Fugere
8,561,842 B2 10/2013 Pizzacalla et al.
8,690,084 B1 4/2014 Fugere
8,701,946 B1 4/2014 Fugere
8,707,559 B1 4/2014 Fugere
8,864,055 B2 10/2014 Fugere
9,108,215 B1 8/2015 Fugere
9,180,482 B1 11/2015 Fu
9,228,582 B1 1/2016 Fugere
9,486,830 B1 11/2016 Fugere
9,725,225 B1 8/2017 Fugere
9,833,807 B2 12/2017 Fugere
9,833,808 B1 12/2017 Fugere
10,105,729 B1 10/2018 Fugere
10,370,172 B1 8/2019 Fugere
10,583,454 B1 3/2020 Fugere
10,722,914 B1 7/2020 Fugere
11,035,412 B2 6/2021 Risko Cattell et al.
11,059,654 B1 * 7/2021 Fugere ..... B65D 83/00
2001/0011506 A1 8/2001 Rossmeisl et al.
2001/0020629 A1 9/2001 Fujii
2001/0020787 A1 9/2001 Pott et al.
2002/0007227 A1 1/2002 Prentice et al.
2002/0007741 A1 1/2002 Rossmeisl et al.
2002/0008118 A1 1/2002 Cavallaro
2002/0020350 A1 2/2002 Prentice et al.
2002/0084290 A1 7/2002 Materna
2002/0088269 A1 7/2002 Cavallaro et al.
2003/0000462 A1 1/2003 Prentice et al.
2003/0038190 A1 2/2003 Newbold et al.
2003/0066546 A1 4/2003 Bibeault et al.
2003/0071149 A1 4/2003 Verilli
2003/0084845 A1 5/2003 Prentice et al.
2003/0091727 A1 5/2003 Prentice et al.
2003/0097941 A1 5/2003 Rossmeisl et al.

(56) References Cited

U.S. PATENT DOCUMENTS

| | | | |
|---|---|---|---|
| 2003/0125671 | A1 | 7/2003 | Aramata et al. |
| 2003/0132243 | A1 | 7/2003 | Engel |
| 2003/0132443 | A1 | 7/2003 | Kim |
| 2003/0155384 | A1 | 8/2003 | Nagahata et al. |
| 2004/0089228 | A1 | 5/2004 | Prentice et al. |
| 2004/0140371 | A1 | 7/2004 | Engel |
| 2004/0142099 | A1 | 7/2004 | Rossmeisl et al. |
| 2004/0195278 | A1 | 10/2004 | Leeuw |
| 2004/0245673 | A1 | 12/2004 | Allsop |
| 2005/0072815 | A1 | 4/2005 | Carew et al. |
| 2005/0095365 | A1 | 5/2005 | Acum et al. |
| 2005/0103886 | A1 | 5/2005 | Verrilli |
| 2005/0135869 | A1 | 6/2005 | Liberatore |
| 2005/0158042 | A1 | 7/2005 | Verrilli |
| 2006/0037972 | A1 | 2/2006 | Leiner et al. |
| 2006/0157517 | A1 | 7/2006 | Fiske et al. |
| 2006/0278666 | A1 | 12/2006 | Wang et al. |
| 2007/0267450 | A1 | 11/2007 | Bolyard, Jr. et al. |
| 2009/0095825 | A1 | 4/2009 | Ahmadi et al. |
| 2009/0266840 | A1 | 10/2009 | Brand et al. |
| 2010/0276522 | A1 | 11/2010 | Fugere |
| 2010/0294810 | A1 | 11/2010 | Ikushima |
| 2011/0095056 | A1 | 4/2011 | Liu |
| 2011/0315906 | A1 | 12/2011 | Ohuchi et al. |
| 2012/0048888 | A1 | 3/2012 | Pizzacalla et al. |
| 2013/0105597 | A1 | 5/2013 | Dunlap et al. |
| 2014/0319402 | A1 | 10/2014 | Gatten |
| 2016/0082468 | A1 | 3/2016 | Fugere |
| 2020/0109746 | A1 | 4/2020 | Risko Cattell et al. |

OTHER PUBLICATIONS

"Micro-Volume Dispense Pump Systems and Methods" Specification, Drawings, and Prosecution History of U.S. Appl. No. 15/646,265, filed Jul. 11, 2017, now U.S. Pat. No. 10,370,172, issued Jul. 17, 2019, by Jeffrey P. Fugere.

"Micro-Volume Dispense Pump Systems and Methods" Specification, Drawings, and Prosecution History of U.S. Appl. No. 16/503,676, filed Jul. 5, 2019, by Jeffrey P. Fugere.

* cited by examiner

MICRO-VOLUME DISPENSE PUMP SYSTEMS AND METHODS

RELATED APPLICATIONS

This application is a continuation of U.S. patent application Ser. No. 16/503,676, filed on Jul. 5, 2019, which is a continuation of U.S. patent application Ser. No. 15/646,265, filed on Jul. 11, 2017, now Issued U.S. Pat. No. 10,370,172, issued on Aug. 6, 2019, which is a continuation of U.S. patent application Ser. No. 13/774,447, filed on Feb. 22, 2013, now Issued U.S. Pat. No. 9,725,225, issued on Aug. 8, 2017, which claims the benefit of U.S. Provisional Patent Application No. 61/602,823 filed on Feb. 24, 2012, the content of which is incorporated herein by reference in its entirety.

This application is related to U.S. Pat. No. 6,511,301 issued Jan. 28, 2003, U.S. Pat. No. 6,957,783 issued Oct. 25, 2005, U.S. Pat. No. 6,892,959 issued May 17, 2005, and U.S. Pat. No. 6,983,867 issued Jan. 10, 2006, the content of each of which is incorporated herein by reference in its entirety.

TECHNICAL FIELD

The present inventive concepts generally relate to the field of fluid dispense pump systems, and more particularly, to systems and methods for dispensing micro-volumes of material.

BACKGROUND

Contemporary micro-volume dispense pumps are suited for outputting small amounts of fluid to a substrate, and are particularly useful in applications that include the assembly of small electronic components in personal computers, smartphones, tablets, and other consumer electronics devices.

During a dispensing operation, a pump transports glue, resin, paste, epoxy, or other adhesives, or other fluid material to a dispense tip attached to the end of the pump. The dispense tip, also referred to as a needle, nozzle, or pin, in turn outputs a small volume of the fluid material on the substrate as needed.

The density of components assembled for an electronic device continues to increase, while the size of the components continues to decrease. It is therefore desirable for dispense pump systems to deposit precise volumes of fluid materials at precise dimensions.

SUMMARY

Embodiments of the present inventive concepts are directed to fluid dispense pumps and systems, to methods for manufacturing fluid dispense pumps, and to methods for dispensing fluid.

In one aspect, provided is a fluid dispense pump comprising a pump housing, a cartridge body, and a fluid shaft. The cartridge body is positioned along an axis. The cartridge body comprises a chamber and a feed aperture extending through a surface of the cartridge body to the chamber. The fluid shaft extends through the cartridge body along the axis. The fluid shaft has an inlet port positioned in the chamber of the cartridge body. One of the cartridge body and the fluid shaft is attached to the pump housing and is fixed relative to the pump housing. The other of the cartridge body and the fluid shaft moves relative to the one of the cartridge body and the fluid shaft to change a position of the inlet port relative to the feed aperture during a dispensing operation.

In an embodiment, the cartridge body further comprises a first shaft seal positioned about the fluid shaft at a top region of the chamber; a second shaft seal positioned about the fluid shaft at a bottom region of the chamber, wherein the feed aperture extends through a side surface of the cartridge body to a chamber volume of the chamber between the first shaft seal, the second shaft seal, and the fluid shaft.

In an embodiment, in a first state of the dispensing operation, the first shaft seal or the second shaft seal is positioned over the inlet port of the fluid shaft to prevent fluid material from entering the inlet port, and wherein in a second state of the dispensing operation, the inlet port is at least partially exposed to the chamber volume to receive fluid material.

In an embodiment, the pump further comprises an o-ring conformably positioned between the first shaft seal and an upper surface of the top region of the chamber to prevent fluid material from escaping the chamber volume during the dispensing operation.

In an embodiment, the pump further comprises an o-ring conformably positioned between the second shaft seal and a bottom surface of the bottom region of the chamber to prevent fluid material from escaping the chamber volume during the dispensing operation.

In an embodiment, the fluid shaft transitions between a first linear position along the axis so that the first shaft seal at least partially covers the inlet port, and a second linear position along the axis to at least partially expose the inlet port to the chamber volume.

In an embodiment, the fluid shaft transitions between the second linear position and a third linear position along the axis, wherein the inlet port is at least partially covered by the second shaft seal.

In an embodiment, the fluid shaft linearly transitions between a first linear position along the axis so that the second shaft seal at least partially covers the inlet port, and a second linear position along the axis to at least partially expose the inlet port to the chamber volume.

In an embodiment, the fluid shaft is stationary in the pump housing and the cartridge body transitions between a first linear position along the axis to at least partially cover the inlet port with the second shaft seal, and a second linear position along the axis to at least partially expose the inlet port to the chamber volume.

In an embodiment, the cartridge body transitions between the second linear position and a third linear position along the axis, wherein the inlet port is at least partially covered by the first shaft seal.

In an embodiment, the cartridge body linearly transitions between a first linear position along the axis so that the first shaft seal at least partially covers the inlet port, and a second linear position along the axis to at least partially expose the inlet port to the chamber volume.

In an embodiment, the fluid shaft further comprises an outlet and a fluid path extending from the inlet port to the outlet. In the dispensing operation, fluid material flows from the feed aperture of the cartridge body through the fluid path to the outlet via at least a portion of the inlet port exposed to the feed aperture.

In an embodiment, the inlet port is constructed and arranged to include a taper funnel extending from the inlet port, the taper funnel controlling an introduction of fluid material to the fluid path during the dispensing operation.

In an embodiment, the taper funnel includes a first taper funnel that extends from a top region of the inlet port in a longitudinal direction of the fluid shaft, and a second taper funnel extends from a bottom region of the fluid shaft inlet port in the longitudinal direction.

In an embodiment, the pump further comprises a motor in communication with the pump housing, the motor changing the position of the inlet port of the fluid shaft relative to the feed aperture by driving the other of the cartridge body and the fluid shaft in at least one of a linear direction along the axis and a radial direction about the axis during the dispensing operation.

In an embodiment, the motor is a closed-loop servo motor.

In an embodiment, the pump further comprises a ball slide assembly including a ball screw and a ball race nut, the motor driving the ball screw in a rotational direction, the ball race nut translating in the linear direction with respect to the ball screw in response to the ball screw driven in the rotational direction.

In an embodiment, the ball slide assembly further comprises an interconnect in communication with a sidewall of the pump housing, wherein the other of the cartridge body and the fluid shaft is coupled to the interconnect, and wherein the interconnect moves along the sidewall of the pump housing and the other of the cartridge body and the fluid shaft moves in the linear direction in response to the ball race nut translating linearly along the rotating ball screw.

In an embodiment, the motor is constructed and arranged to transition the other of the fluid shaft and the cartridge body in the linear direction to the second state to expose at least a portion of the inlet port to the cartridge feed aperture.

In an embodiment, the motor is constructed and arranged to move the other of the fluid shaft and the cartridge body in the radial direction about the axis to expose at least a portion of the inlet port to the feed aperture.

In an embodiment, an amount of fluid dispensed by the fluid dispense pump is determined by a degree of exposure of at least the portion of the inlet port to the feed aperture, and wherein the motor controls the degree of exposure of the at least the portion of the inlet port to the feed aperture In an embodiment, a linear position of the fluid shaft along the axis is adjustable over a range of discrete positions corresponding to indexed positions of the motor.

In an embodiment, a rotating position of the fluid shaft about the axis is adjustable over a range of discrete positions corresponding to indexed positions of the motor.

In an embodiment, the fluid dispense pump further comprises a cartridge assembly that includes the cartridge body and the fluid shaft, wherein the cartridge assembly is removably coupled to a cartridge socket at a bottom portion of the pump housing.

In an embodiment, the fluid dispense pump further comprises a cartridge locking device constructed and arranged to secure the cartridge at the cartridge socket.

In an embodiment, the fluid dispense pump further comprises a dispense tip coupled to an outlet of the fluid shaft for outputting a volume of fluid material received from the outlet.

In an embodiment, the fluid dispense pump further comprises a feed tube coupled to the feed aperture. In an embodiment, the feed tube includes one selected from group consisting of: a rigid fluid port, a flexible fluid port, a stainless steel fluid port, an aluminum fluid port, rubber tubing and plastic tubing.

In another aspect, provided is a fluid dispense pump, comprising a pump housing and a cartridge assembly removably coupled to the pump housing. The cartridge assembly includes a cartridge body and a fluid shaft extending through the cartridge body. The cartridge body has a feed aperture and a chamber. The fluid shaft has an inlet port positioned in the chamber in the cartridge body. The pump further comprises a motor coupled to the pump housing. The motor controls a position of the feed aperture relative to the inlet port of the fluid shaft in the chamber of the cartridge body.

In an embodiment, the cartridge body comprises: a first shaft seal at a top region of the chamber; a second shaft seal at a bottom region of the chamber; and the feed aperture extending through a surface of the cartridge body to a chamber volume of the chamber between the first shaft seal, the second shaft seal, and the fluid shaft.

In an embodiment, wherein the fluid shaft further comprises: an outlet; and a fluid path extending from the inlet port to the outlet, wherein in a dispensing operation, fluid material flows from the feed aperture of the cartridge body through the fluid path to the outlet via at least a portion of the inlet port exposed to the feed aperture.

In an embodiment, the fluid dispense pump further comprises an o-ring conformably positioned between the first shaft seal and an upper surface of the top region of the chamber to prevent fluid material from escaping the chamber volume during a dispensing operation.

In an embodiment, the fluid dispense pump further comprises an o-ring conformably positioned between the second shaft seal and a bottom surface of the bottom region of the chamber to prevent fluid material from escaping the chamber volume during a dispensing operation.

In an embodiment, the fluid shaft transitions between a first linear position along an axis so that the first shaft seal at least partially covers the inlet port, and a second linear position along the axis to at least partially expose the inlet port to the chamber volume.

In an embodiment, the fluid shaft transitions between the second linear position and a third linear position along the axis, wherein the inlet port is at least partially covered by the second shaft seal.

In an embodiment, the fluid shaft linearly transitions between a first linear position along an axis so that the second shaft seal at least partially covers the inlet port, and a second linear position along the axis to at least partially expose the inlet port to the chamber volume.

In an embodiment, the fluid shaft is stationary in the pump housing and the cartridge body transitions between a first linear position along the axis to at least partially cover the inlet port with the second shaft seal, and a second linear position along the axis to at least partially expose the inlet port to the chamber volume.

In an embodiment, the cartridge body transitions between the second linear position and a third linear position along the axis, wherein the inlet port is at least partially covered by the first shaft seal.

In an embodiment, the cartridge body linearly transitions between a first linear position along the axis so that the first shaft seal at least partially covers the inlet port, and a second linear position along the axis to at least partially expose the inlet port to the chamber volume.

In an embodiment, the motor changes the position of the inlet port of the fluid shaft in the chamber by moving the cartridge body and the fluid shaft in at least one of a linear direction along an axis and a radial direction about the axis during a dispensing operation.

In an embodiment, the motor is a closed-loop servo motor.

In an embodiment, the pump further comprises a ball slide assembly, the ball slide assembly including a ball screw and a ball race nut, the motor driving the ball screw in a rotational direction, the ball race nut translating in the linear direction with respect to the ball screw in response to the ball screw driven in the rotational direction.

In an embodiment, the ball slide assembly further comprises an interconnect in communication with a sidewall of the pump housing, wherein one of the cartridge body and the fluid shaft is coupled to the interconnect, and wherein the interconnect moves along the sidewall of the pump housing and the one of the cartridge body and the fluid shaft moves in the linear direction in response to the ball race nut translating linearly along the rotating ball screw.

In an embodiment, the motor is constructed and arranged to transition the fluid shaft in the linear direction to expose at least a portion of the inlet port to a feed aperture extending through the cartridge body.

In an embodiment, the motor is constructed and arranged to move the fluid shaft in the radial direction about the axis to expose at least a portion of the inlet port to a feed aperture extending through the cartridge body.

In an embodiment, an amount of fluid dispensed by the fluid dispense pump is determined by a degree of exposure of at least a portion of the inlet port to a feed aperture extending through the cartridge body, and wherein the motor controls the degree of exposure of the at least the portion of the inlet port to the feed aperture.

In an embodiment, a linear position of the fluid shaft is adjustable over a range of discrete positions corresponding to indexed positions of the motor.

In an embodiment, a rotating position of the fluid shaft is adjustable over a range of discrete positions corresponding to indexed positions of the motor.

In an embodiment, the cartridge assembly is removably coupled to a cartridge socket at a bottom portion of the pump housing.

In an embodiment, the pump further comprises a cartridge locking device constructed and arranged to secure the cartridge at the cartridge socket.

In an embodiment, the pump further comprises a dispense tip coupled to an outlet of the fluid shaft for outputting a volume of fluid material received from the outlet.

In an embodiment, the pump further comprises a feed tube coupled to a feed aperture extending through the cartridge body. In an embodiment, the feed tube includes one selected from group consisting of: a rigid fluid port, a flexible fluid port, a stainless steel fluid port, an aluminum fluid port, rubber tubing and plastic tubing.

In an embodiment, the fluid dispensing system further comprises a pump dispensing controller that controls at least one of a position and a velocity of the motor, the pump dispensing controller configured to command the motor to adjust a position of the feed aperture relative to the inlet port In an embodiment, the fluid dispensing system further comprises a pump gantry system having a movable arm, wherein the fluid dispense pump is mounted to the movable arm; and a programmable pump controller configured to transmit positioning signals to the pump gantry system and dispensing signals to the pump dispensing controller.

In another aspect, provided is a fluid dispense pump, comprising: a pump housing; a fluid shaft coupled to the pump housing, the fluid shaft including an inlet port, an outlet, and a fluid path extending from the inlet port to the outlet; a cartridge body about the inlet port of the fluid shaft, the cartridge body comprising a chamber and a feed aperture extending through a surface of the cartridge body to the chamber, wherein one of the cartridge body and the fluid shaft moves relative to the other of the cartridge body and the fluid shaft during a dispensing operation.

In an embodiment, the cartridge body further comprises: a first shaft seal positioned about the fluid shaft at a top region of the chamber; and a second shaft seal positioned about the fluid shaft at a bottom region of the chamber, wherein the feed aperture extends through a side surface of the cartridge body to a chamber volume between the first shaft seal, the second shaft seal, and the fluid shaft.

In an embodiment, in a first state of the dispensing operation, the first shaft seal or the second shaft seal is positioned over the inlet port of the fluid shaft to prevent fluid material from entering the inlet port, and wherein in a second state of the dispensing operation, the inlet port is at least partially exposed to the chamber volume to receive fluid material.

In an embodiment, the fluid shaft is stationary in the pump housing and the cartridge body transitions between a first linear position along the axis to at least partially cover the inlet port with the second shaft seal, and a second linear position along the axis to at least partially expose the inlet port to the chamber volume.

In an embodiment, the cartridge body transitions between the second linear position and a third linear position along the axis, wherein the inlet port is at least partially covered by the first shaft seal.

In an embodiment, the cartridge body linearly transitions between a first linear position along the axis so that the first shaft seal at least partially covers the inlet port, and a second linear position along the axis to at least partially expose the inlet port to the chamber volume.

In an embodiment, the inlet port is constructed and arranged to include a taper funnel extending from the inlet port, the taper funnel controlling an introduction of fluid material to the fluid path during the dispensing operation.

In an embodiment, the taper funnel includes a first taper funnel that extends from a top region of the inlet port in a first longitudinal direction of the fluid shaft, and a second taper funnel extends from a bottom region of the fluid shaft inlet port in a second longitudinal direction of the fluid shaft opposite the first longitudinal direction.

In an embodiment, the fluid dispense pump further comprises a motor in communication with the pump housing, the motor changing the position of the cartridge body about the inlet port by driving the cartridge body in at least one of a linear direction along the axis and a radial direction about the axis during the dispensing operation.

In an embodiment, the motor is a closed-loop servo motor.

In an embodiment, the fluid dispense pump further comprises an interconnect in communication with a sidewall of the pump housing, wherein the one of the cartridge body and the fluid shaft is coupled to the interconnect, and wherein the interconnect moves along the sidewall of the pump housing and the one of the cartridge body and the fluid shaft moves in the linear direction in response to the ball race nut translating linearly along the rotating ball screw.

In an embodiment, the motor is constructed and arranged to transition the fluid shaft in the linear direction to expose at least a portion of the inlet port to the feed aperture.

In an embodiment, the motor is constructed and arranged to move the fluid shaft in the radial direction about the axis to expose at least a portion of the inlet port to the feed aperture.

In an embodiment, an amount of fluid dispensed by the fluid dispense pump is determined by a degree of exposure of at least a portion of the inlet port to the feed aperture, and wherein the motor controls the degree of exposure of the at least the portion of the inlet port to the feed aperture.

In an embodiment, axis is adjustable over a range of discrete positions corresponding to indexed positions of the motor.

In an embodiment, a rotating position of the fluid shaft about the axis is adjustable over a range of discrete positions corresponding to indexed positions of the motor.

In an embodiment, the fluid dispense pump further comprises a cartridge assembly that includes the cartridge body and the fluid shaft, wherein the cartridge assembly is removably coupled to a cartridge socket at a bottom portion of the pump housing.

In an embodiment, the fluid dispense pump further comprises a cartridge locking device constructed and arranged to secure the cartridge at the cartridge socket.

In another aspect, provided is a method of controlling a fluid dispense pump, comprising positioning a cartridge body along an axis, the cartridge body comprising a chamber and a feed aperture extending through a surface of the cartridge body to the chamber; extending a fluid shaft through the cartridge body along the axis, the fluid shaft having an inlet port positioned in the chamber of the cartridge body, wherein one of the cartridge body and the fluid shaft is attached to a pump housing and is fixed relative to the pump housing; and activating a motor for moving the other of the cartridge body and the fluid shaft relative to the one of the cartridge body and the fluid shaft to change a position of the inlet port relative to the feed aperture during a dispensing operation.

In another aspect, provided is a method of controlling a fluid dispense pump, comprising: removably coupling a cartridge assembly removably coupled to the pump housing, the cartridge assembly including a cartridge body and a fluid shaft extending through the cartridge body, the cartridge body having a feed aperture and a chamber; positioning a fluid shaft having an inlet port in the chamber in the cartridge body; coupling a motor to the pump housing; and controlling, by the motor, a position of the feed aperture relative to the inlet port of the fluid shaft in the chamber of the cartridge body.

A method of controlling a fluid dispense pump, comprising: coupling a fluid shaft coupled to a pump housing, the fluid shaft including an inlet port, an outlet, and a fluid path extending from the inlet port to the outlet; positioning a cartridge body about the inlet port of the fluid shaft, the cartridge body comprising a chamber and a feed aperture extending through a surface of the cartridge body to the chamber; and activating a motor for moving one of the cartridge body and the fluid shaft relative to the other of the cartridge body and the fluid shaft during a dispensing operation.

In another aspect, provided is a fluid dispense pump comprising a pump housing, a cartridge assembly, and a motor. The cartridge assembly is removably coupled to the pump housing. The cartridge assembly includes a cartridge body and a fluid shaft extending through the cartridge body. The fluid shaft has an inlet port positioned in a chamber in the cartridge body. The motor is coupled to the pump housing. The motor controls a position of the inlet port of the fluid shaft in the chamber of the cartridge body.

In an embodiment, the cartridge body comprises a first shaft seal at a top region of the chamber; a second shaft seal at a bottom region of the chamber; and a feed aperture extending through a side surface of the cartridge body to a chamber volume between the first shaft seal, the second shaft seal, and the fluid shaft.

In an embodiment, the fluid shaft further comprises an outlet; and a fluid path extending from the inlet port to the outlet, wherein in the dispensing operation, fluid material flows from the feed aperture of the cartridge body through the fluid path to the outlet via at least a portion of the inlet port exposed to the feed aperture.

In another aspect, provided is a fluid dispensing system comprising a fluid dispense pump, a cartridge assembly, and a motor. The cartridge assembly is removably coupled to the pump. The cartridge assembly comprises a cartridge body and a fluid shaft extending through the cartridge body. The motor is in communication with the pump, the motor driving one of the cartridge body and the fluid shaft in at least one of a linear direction along the axis and a radial direction relative to the other of the cartridge body and the fluid shaft during the dispensing operation. The pump dispensing controller is configured to control at least one of a position and a velocity of the motor, the pump dispensing controller configured to command the motor to adjust a position of the inlet port relative to a fluid cavity of the cartridge body.

In an embodiment, the fluid dispensing system further comprises a pump gantry system having a movable arm, wherein the fluid dispense pump is mounted to the movable arm; and a programmable pump controller configured to transmit positioning signals to the pump gantry system and dispensing signals to the pump dispensing controller.

BRIEF DESCRIPTION OF THE DRAWINGS

The foregoing and other objects, features and advantages of embodiments of the present inventive concepts will be apparent from the more particular description of preferred embodiments, as illustrated in the accompanying drawings in which like reference characters refer to the same elements throughout the different views. The drawings are not necessarily to scale, emphasis instead being placed upon illustrating the principles of the preferred embodiments.

DETAILED DESCRIPTION OF EMBODIMENTS

Figure 1A:
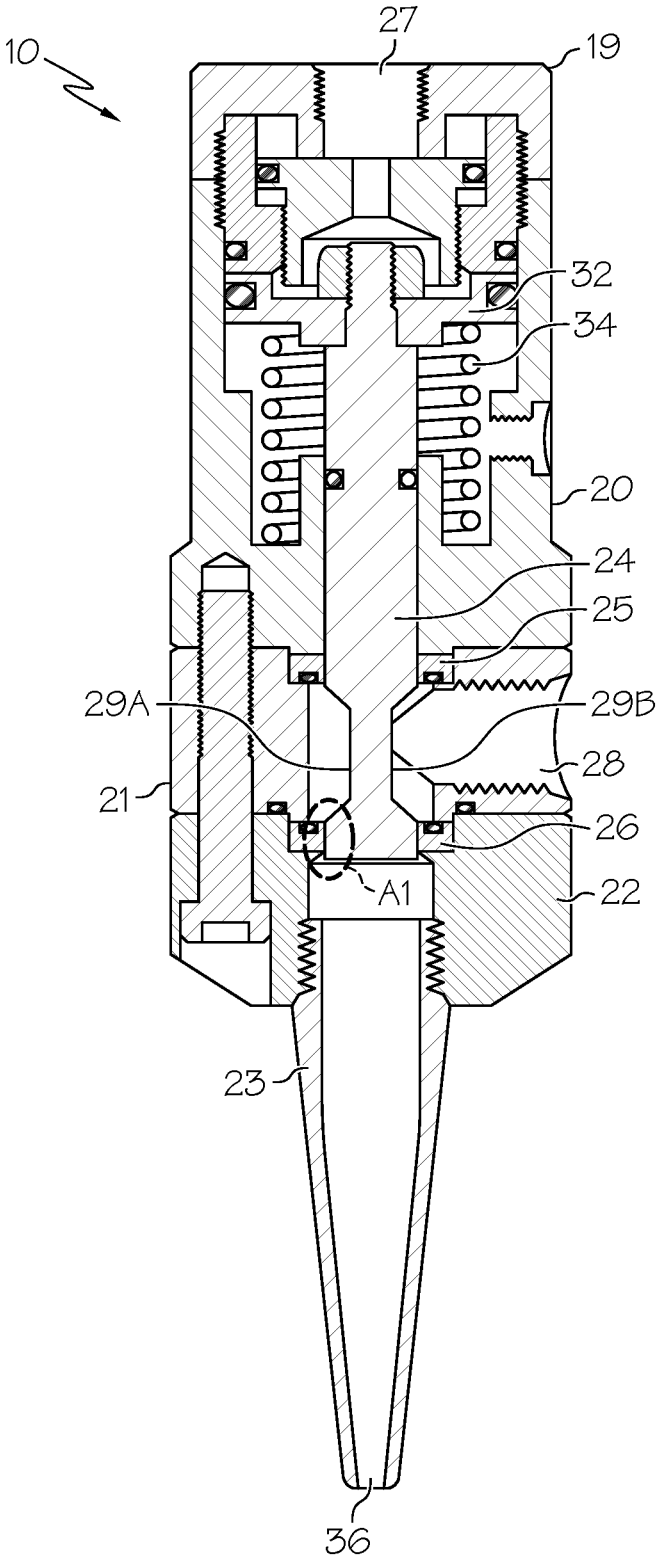
FIG. 1A (PRIOR ART)
FIG. 1A is a cross-sectional view of a conventional spool valve in a closed state.

The terminology used herein is for the purpose of describing particular embodiments and is not intended to be limiting of the inventive concepts. As used herein, the singular forms "a," "an" and "the" are intended to include the plural forms as well, unless the context clearly indicates otherwise. It will be further understood that the terms "comprises," "comprising," "includes" and/or "including," when used herein, specify the presence of stated features, integers, steps, operations, elements, and/or components, but do not preclude the presence or addition of one or more other features, integers, steps, operations, elements, components, and/or groups thereof.

It will be understood that, although the terms first, second, third etc. may be used herein to describe various limitations, elements, components, regions, layers and/or sections, these limitations, elements, components, regions, layers and/or sections should not be limited by these terms. These terms are only used to distinguish one limitation, element, component, region, layer or section from another limitation, element, component, region, layer or section. Thus, a first limitation, element, component, region, layer or section discussed below could be termed a second limitation, element, component, region, layer or section without departing from the teachings of the present application.

It will be further understood that when an element is referred to as being "on" or "connected" or "coupled" to another element, it can be directly on or above, or connected or coupled to, the other element or intervening elements can be present. In contrast, when an element is referred to as being "directly on" or "directly connected" or "directly coupled" to another element, there are no intervening elements present. Other words used to describe the relationship between elements should be interpreted in a like fashion (e.g., "between" versus "directly between," "adjacent" versus "directly adjacent," etc.). When an element is referred to herein as being "over" another element, it can be over or under the other element, and either directly coupled to the other element, or intervening elements may be present, or the elements may be spaced apart by a void or gap.

Contemporary dispense pumps typically include a syringe or related source of fluid material for dispensing, a feed tube, a dispense cartridge, and a pump drive mechanism. The feed tube is coupled between an outlet at a distal end of the syringe, and delivers the fluid material to an inlet at the dispense cartridge, which directs the fluid material into a chamber in the dispense cartridge. A feed screw is disposed longitudinally through the center of the cartridge chamber and transports the fluid material in Archimedes principle fashion from the cartridge inlet to a dispense needle attached to the chamber outlet. The pump drive mechanism includes a continuously-running motor that drives the feed screw via a rotary clutch, which is selectively actuated to engage the feed screw and thereby effect a dispensing of fluid material entering the cartridge chamber from the inlet.

These conventional dispense pump systems suffer from several limitations. In particular, the inlet neck feeds fluid material directly into the side of the feed screw from the cartridge inlet, which is typically small and circular. A substantial amount of pressure is required for driving the fluid material into the chamber to the feed screw, because the threads of the feed screw periodically pass in front of the inlet, preventing material from entering the fluid path during periods of rotation. This leads to inconsistent material flow and can contribute to the "balling" and clogging of material at the inlet.

Figure 1B:
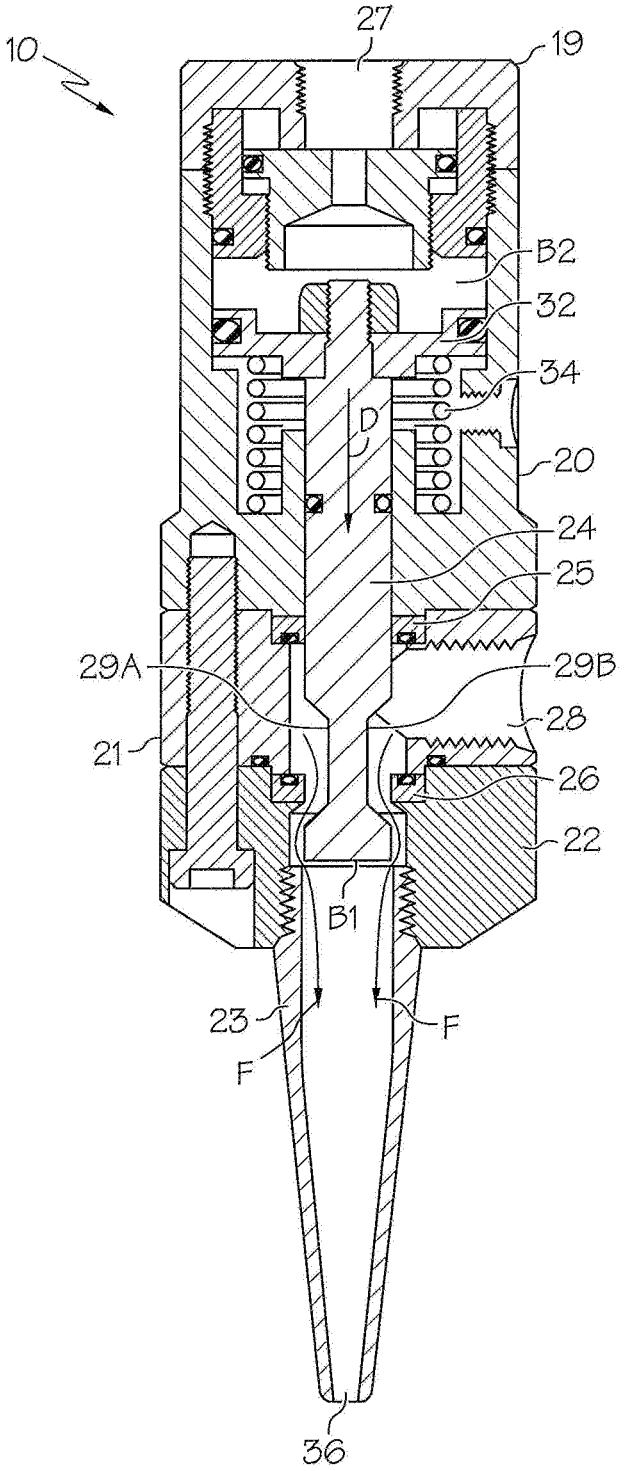
FIG. 1B (PRIOR ART)
FIG. 1B is a cross-sectional view of the conventional spool valve of FIG. 1A in an open state.

Another conventional dispense system includes a spool valve, which is often used for dispensing high viscosity fluids and pastes like sealants, silicones, and greases. FIG. 1A is a cross-sectional view of a conventional spool valve 10 in a closed state. FIG. 1B is a cross-sectional view of the spool valve 10 of FIG. 1A in an open state.

The spool valve 10 comprises an air cylinder cap 19 coupled to a top surface of an air cylinder body 20, a fluid body 21 coupled to a bottom surface of the air cylinder body 20, and a body cap 22 coupled to the fluid body 21. A disposable nozzle 23 is coupled to the body cap 22. An actuating air input 27 extends through the air cylinder cap 19 and receives an actuating air supply from a valve control system (not shown), which controls a valve open time of the spool valve 10 by switching on/off the actuating air supply.

The spool valve 10 also comprises a spring loaded spool 24, which engages an upper seal 25 of the fluid body 21, and engages a lower seal 26 of the fluid body 21 at a location A1 when the spool valve 10 is in an 'off' or closed state, as shown in FIG. 1A. When a predetermined supply of air is provided at the actuating air input 27, the spool 24 is driven in a downstroke direction D, as shown in FIG. 1B. Air pressure is applied to a piston 32 and a piston spring 34, which shifts the spool 24 to an 'on' or open state, shown at locations B1 and B2 of FIG. 1B, whereby a fluid path shown by flows of material F between the fluid inlet 28 and nozzle 23 is formed. The fluid material path F extends from the fluid inlet 28 along sidewalls 29A, 29B of the spool 24 to the nozzle 23 from where the fluid material can be dispensed at a nozzle outlet 36. At the end of a dispensing cycle, the spring 34 applies a force on the piston 32, returning the spool 24 to the closed position as shown in FIG. 1A.

When the spool 24 transitions from the closed state shown in FIG. 1A to an open state, as shown in FIG. 1B, a buildup of pressure occurs at the fluid inlet 28. Fluid pressure, along with other factors such as the valve open time, dispense tip size, and the direction of travel of the fluid about the sidewalls 29A, 29B of the spool 24 to the nozzle 23 contribute to the uncontrolled, inaccurate release of fluid material at the outlet 36.

Figure 2:
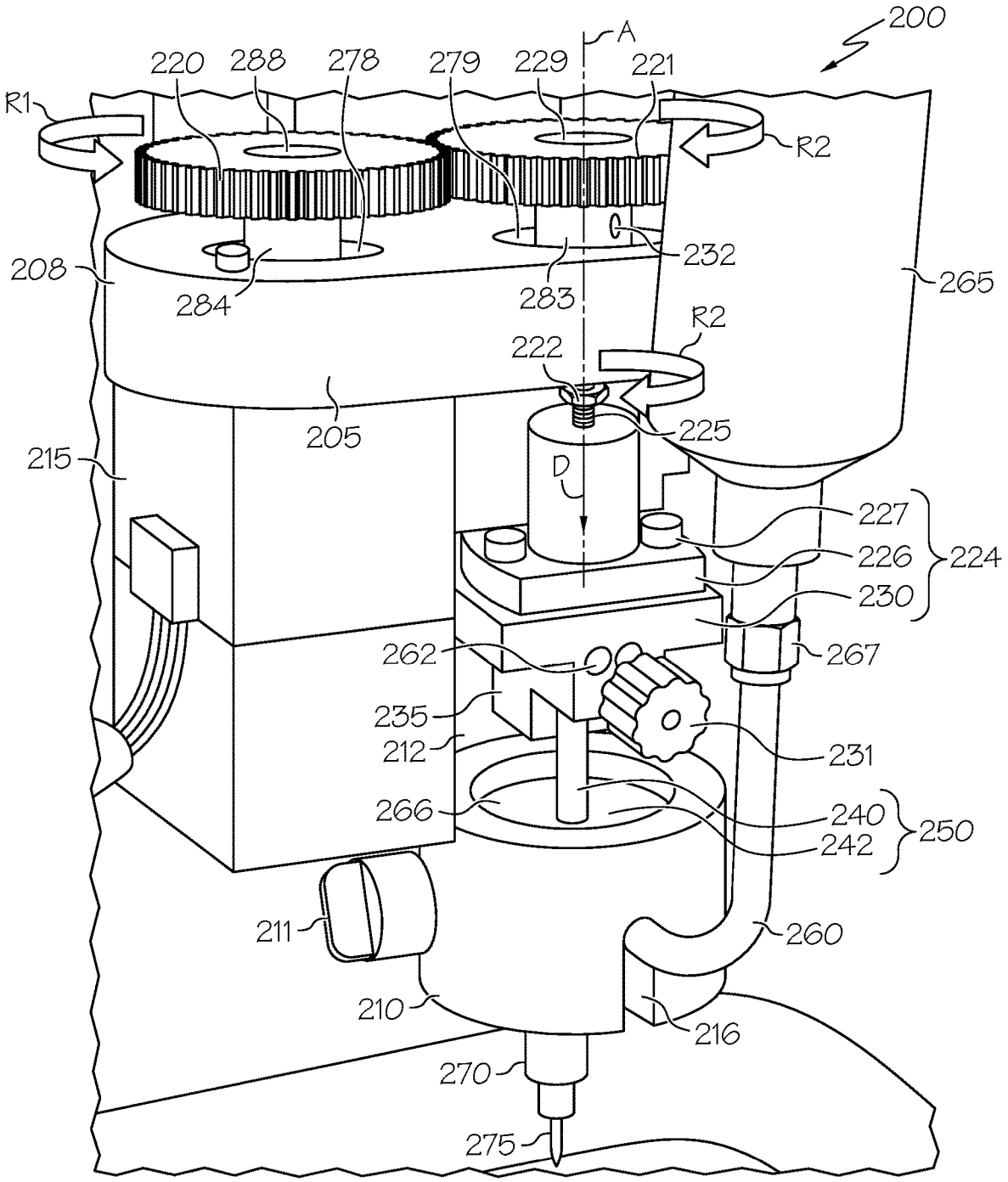
FIG. 2 is a perspective view of a fluid dispense pump system, in accordance with an embodiment of the present inventive concepts.

FIG. 2 is a perspective view of a fluid dispense pump system 200, in accordance with an embodiment of the present inventive concepts. The fluid dispense pump system 200 includes a pump housing 205, a motor 215, a ball slide assembly 224, and a cartridge assembly 250.

The motor 215 is preferably a closed-loop AC or DC servo motor or related position-controlled motor. The motor 215 can alternatively be a stepper motor, a linear motor, or other motor known to those of ordinary skill in the art. The motor 215 can be coupled to a side or top surface of the pump housing 205. The motor 215 can communicate with an independent motion control system, for example, described herein with reference to FIG. 26. The motor 215 includes a drive axle 288, and can be configured for indexed rotational, or angular, positions, to drive an ball slide assembly 224 and the cartridge assembly 250 for delivering a source of fluid material to a dispense tip 275 coupled to an end of the cartridge assembly 250. The motor 215 can include an encoder (not shown) that provides for precise control over indexed angular, or rotational, positions, an angular velocity, and/or an angular acceleration of the motor 215.

The pump housing 205, also referred to as a pump body, includes a top portion 208, a bottom portion 210, and a sidewall 212 extending between the top portion 208 and the bottom portion 210. The top portion 208, the bottom portion 210, and the sidewall 212 can be machined separately and welded, glued, or otherwise affixed to each other. Alternatively, the top portion 208, the bottom portion 210, and the sidewall 212 can be machined, die-cast, or otherwise formed from a single stock of material.

The top portion 208 of the pump housing 205 includes a first opening 278 for receiving the drive axle 288 of the motor 215. The top portion 208 of the pump housing 205 also includes a second opening 279 for receiving a shaft 229 in communication with the ball slide assembly 224. A first gear 220 is coupled to the motor drive axle 288 by a gear coupling 284. A second gear 221 includes a gear coupling 283 positioned over one end of the shaft 229, and coupled to the shaft 229 by a set screw 232. The first gear 220 and second gear 221 are meshed together so that when the first gear 220 rotates in a first direction R1, the meshed configuration drives the second gear 221 in a second rotational direction R2 about an axis of rotation A. A bearing assembly or sleeve (not shown) is positioned in the second opening 279. The shaft 229 is coupled to one side of the bearing assembly. A ball screw 225 having a continuous helical groove is coupled the other side of the bearing assembly by a nut 222, for example, a hex nut. The ball screw 225, the shaft 229, and the second gear 221 rotate together about the axis A in the second rotational direction R2.

The ball slide assembly 224 includes a ball nut 226, also referred to as a ball race nut, positioned about the ball screw 225. The ball nut 226 can be constructed and arranged in a manner known to those of ordinary skill in the art. In particular, the interior of the ball nut 226 includes an arrangement of balls positioned along a portion of the helical groove of the shaft 225 positioned in the ball nut 226, which permits the ball nut 226 to provide a backlash-free conversion between a single rotational direction R2 of the ball screw 225 about the axis A and a linear movement (D) of the ball slide assembly 224. Accordingly, the ball slide assembly can move along the axis A relative to the screw 225 in a linear, reciprocating manner when the screw 225 rotates. In particular, the ball nut 226 can move linearly up the screw 225 when the screw 225 rotates in a first direction of rotation, and can move linearly down the screw 225 when the screw 225 rotates in a second direction of rotation opposite the first direction of rotation. Other mechanical linear actuators can alternatively be provided that translate a rotational motion controlled by the motor 215 to a linear motion, for driving the ball nut 226 along the axis.

The ball slide assembly 224 includes an interconnect 230 that is coupled to the ball nut 226 by one or more screws 227, or by adhesives or other attachment mechanisms. The interconnect 230 is coupled to a ball slide guide (not shown) and the ball nut 226, permitting the interconnect 230 to move in the linear direction (D) along the sidewall 212 of the pump housing 205.

The bottom portion 210 of the pump housing 205 can include a cartridge socket 266 for receiving the cartridge assembly 250. The cartridge assembly 250 includes a fluid shaft 240 and a cartridge body 242. The cartridge body 242 can be inserted at the underside of the pump housing 205 and held in place inside the cartridge socket 266 by a hand-operated thumb screw 211 or other cartridge locking device, for example, a release lever, constructed and arranged to secure the cartridge assembly 250 in the cartridge socket 266.

Figure 4:
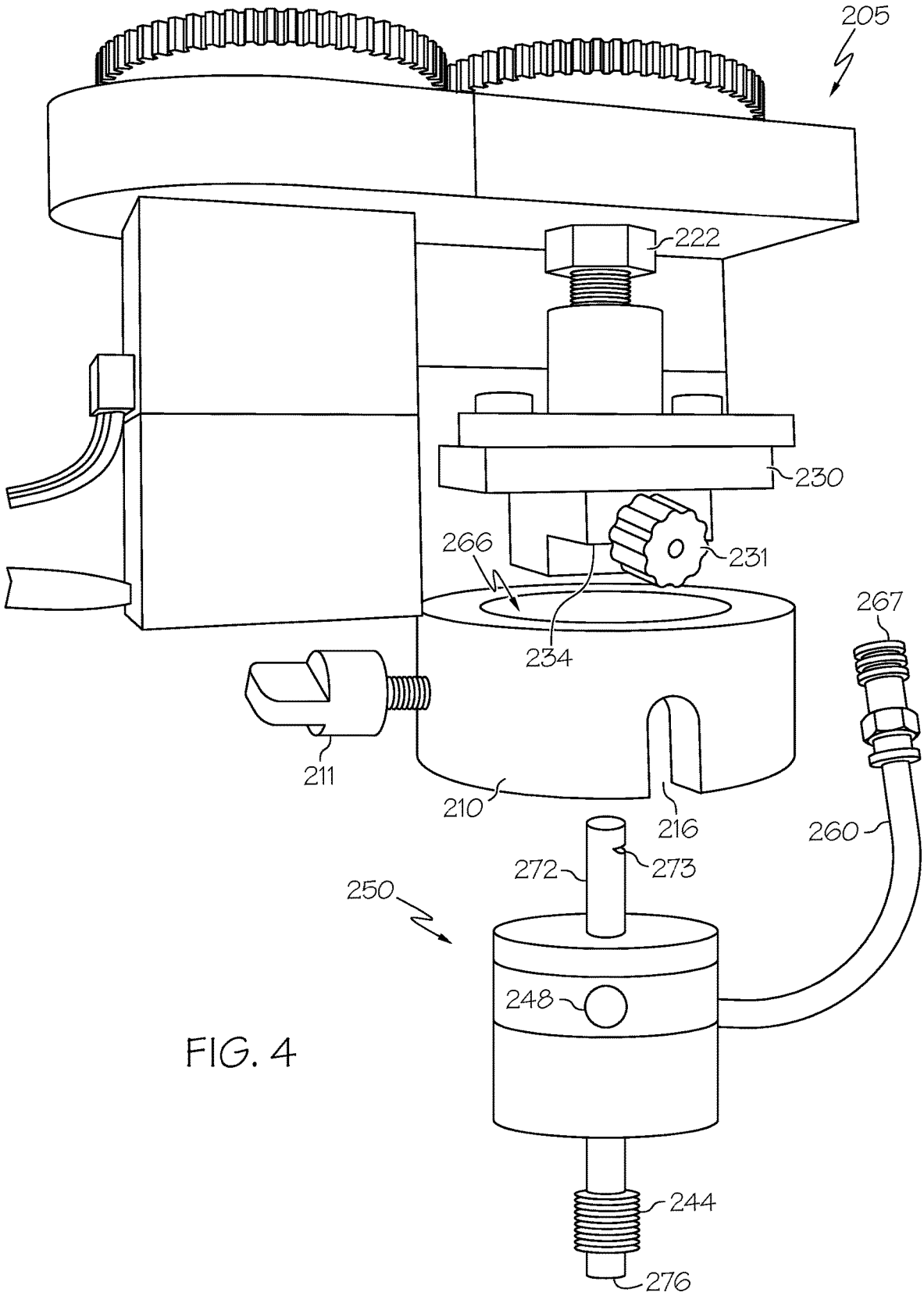
FIG. 4 is a perspective view of the fluid dispense pump of FIGS. 2 and 3, illustrating a cartridge assembly separate from a pump housing, in accordance with an embodiment.

The fluid shaft 240 may include a cylindrical body that extends longitudinally along the axis A. A top section of the fluid shaft 240 can be inserted into an opening at a bottom surface of the interconnect 230. The top section of the fluid shaft 240 can be releasably coupled to the interconnect 230 by a lock pin 231 or other securing mechanism, which holds the fluid shaft 240 in place in the interconnect 230. The cartridge assembly 250 can be releasably attached to the pump housing 205 by positioning the cartridge body 242 in the cartridge socket 266. In particular, the cartridge body 242 has a pin capture, for example, pin capture 248 shown in FIG. 4, which is configured to receive a distal end of the thumb screw 211 extending through the bottom portion 210 of the pump housing 205 into the cartridge socket 266. The cartridge assembly 250 can be removed from the pump housing 205, for example, as shown in FIG. 4, by loosening or removing the thumb screw 211 and the lock pin 231.

A sidewall of the bottom portion 210 of the pump housing 205 includes a slot 216 for receiving a feed tube 260. One end of the feed tube 260 is inserted into a feed aperture (not shown in FIG. 2) in a sidewall of the cartridge body 242. A syringe 265 or other source of material to be dispensed is coupled to a threaded adapter 267 at the other end of the feed tube 260. The feed tube 260 can be formed of a rigid material such as stainless steel, aluminum, and the like. Alternatively, the feed tube 260 can be formed of a flexible material such as plastic or rubber, and can elastably deform to fit over a syringe output adapter to form a tight seal with the syringe 265.

The cartridge assembly 250 is adapted to receive a dispense needle 275, which can be attached at an outlet region of the fluid shaft 240. The dispense needle 275 can be the same or similar to those disclosed in U.S. Pat. Nos. 6,547,167, 6,981,664, 6,957,783, and U.S. patent application Ser. No. 12/034,313, filed Feb. 2, 2008, entitled "Material Dispense Tips and Methods for Manufacturing the Same," and/or U.S. patent application Ser. No. 12/647,911, filed Dec. 28, 2009, entitled "Material Dispense Tips and Methods for Forming the Same," the contents of each of which is incorporated herein by reference in its entirety. The dispense needle 275 can be held in place by a needle nut 270 coupled to the fluid shaft 240.

Figure 3:
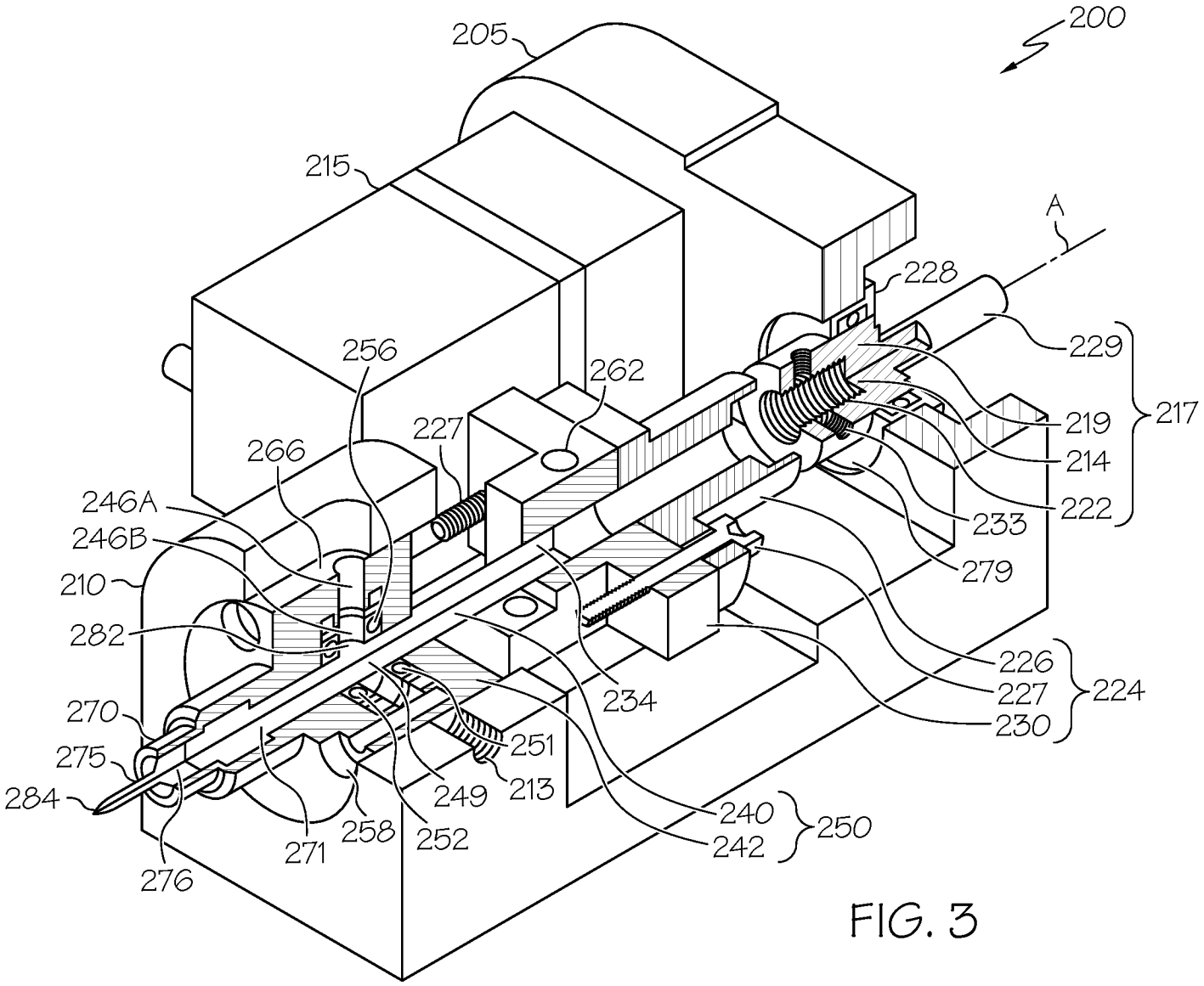
FIG. 3 is a partial cutout view of the fluid dispense pump of FIG. 2.

FIG. 3 is a partial cutout view of the fluid dispense pump system 200 of FIG. 2. As shown in FIG. 3, the shaft 229 and the nut 222 can be part of an integral unit 217. The shaft 229 extends from a threaded region 219 of the integral unit 217 through the second opening 279 at the top portion 208 of the pump housing 205. A central region 214 of the integral unit 217 has a smaller diameter or width than the nut 222 of the integral unit 217 and/or the nut (not shown) positioned about the threaded region 219. The central region 214 can be positioned in a bearing assembly 228, which holds the shaft 229 in place along the axis A, while permitting the shaft 229 to freely rotate about the axis A. A nut (not shown) or other fastener having a threaded hole can be screwed into the threaded region 219 to secure the shaft 229 in the integral unit 217 in the second opening 279.

An opening 213 extends through the bottom portion 210 of the pump housing 205 for receiving the thumb screw 211 or other fastening device, which is inserted into the opening 213. The opening 213 can be threaded for mating with a thread in the thumb screw 211 shown in FIG. 2 when the thumb screw 211 is screwed into the opening 213. An end of the thumb screw 211 is positioned against the cartridge assembly 250 to hold the cartridge assembly 250 in place in the cartridge cavity 266. The thumb screw 211 can be loosened or removed so that the cartridge assembly 250 can be removed from the bottom portion 210 of the pump housing 205, for example, for cleaning or replacement, for example, shown in FIG. 4.

A feed aperture 246A, 246B, generally, 246, also extends through the cartridge body 242 to a chamber 249 in the cartridge body 242, which can include a chamber volume. The feed tube 260 shown in FIG. 2 can be inserted or otherwise coupled to a first portion 246A of the cartridge feed aperture, permitting fluid material to be dispensed from a fluid source, for example, the syringe 265 shown in FIG. 2, to a second portion 246B of the cartridge feed aperture that extends to the chamber 249, and communicates with a fluid inlet 282 of the fluid shaft 240 during a dispensing operation. The cartridge feed aperture 246 can be aligned with the slot 216 at the bottom portion 210 of the pump housing 205 so that the feed tube 260 can extend through the slot 216 to the cartridge feed aperture 246 when the cartridge assembly 250 is positioned in the cartridge cavity 266.

A top shaft seal 251 is positioned about the fluid shaft 240 at an upper region of the chamber 249 of the cartridge body 242 above the cartridge feed aperture 246. A bottom shaft seal 252 is positioned about the fluid shaft 240 at a lower region of the chamber of the cartridge body 242 below the cartridge feed aperture 246. The top and bottom shaft seals 251, 252 can be ring-shaped or the like. The chamber volume 249 can be a region formed between the top and bottom shaft seals 251, 252, respectively, and between the wall of the hole 428 of the cartridge body 242 and the fluid shaft 240. The top and bottom shaft seals 251, 252 can provide a substantially fluid-tight seal with the fluid shaft 240 above the fluid inlet 282 and below the fluid inlet 282, respectively, to prevent fluid from escaping beyond the chamber volume 249 during a dispensing operation.

An o-ring 256 can be positioned about the fluid shaft 240 along the axis A between the top shaft seal 251 and a surface of the cartridge body 242, for preventing fluid from escaping beyond the fluid cavity volume in a first direction. Another o-ring (not shown) can be positioned about the fluid shaft 240 at the chamber 249 along the axis A between the bottom shaft seal 252 and a surface of the cartridge body 242 for preventing fluid from escaping beyond the fluid cavity volume in a second direction opposite the first direction.

Returning to FIG. 2, during a dispensing operation, the motor 215 applies a rotational force to the motor drive axle 288, which drives the first gear 220 in a first rotational direction R1. The first gear 220 in turn drives the second gear 221 in a second rotational direction R2. The second gear 221 is coupled to the gear coupling 283, which in turn is coupled to the shaft 229. Thus, the shaft 229 therefore rotates in the second rotational direction R2. The ball screw 225 is in communication with the shaft 229 via the bearing assembly 228 (see FIG. 3) so that the ball screw 225 likewise rotates in the second rotational direction R2. The ball screw 225 is inserted at a first end of the ball nut 226. The ball nut 226 can provide a conversion between the rotational direction R2 of the ball screw 225 about the axis A and a linear movement of the ball slide assembly 224. The fluid shaft 240 is attached to the ball slide assembly 224, and therefore moves axially in response to the reciprocating motion of the ball slide assembly 224. In particular, the ball slide assembly 224 can drive the fluid shaft 240 in an axial direction D relative to the cartridge body 242, which is secured in the cartridge cavity 266 at the bottom portion 210 of the pump housing 205 by the thumb screw 211. The dispensing operation can include an open state, or "on" state, of the pump system 200, where fluid is dispensed when the fluid shaft 240 is in a down position along the axis A. The dispensing operation can include a closed state, or "off" state, of the pump system 200, where fluid is prevented from being dispensed when the fluid shaft 240 is in an up position along the axis A.

The motor 215 is constructed and arranged to control the position, velocity, and acceleration or deceleration of the fluid shaft 240 by rotating the ball screw 225 with high precision over its entire motion, from initiation to completion of a dispensing operation. For example, the motor 215 can rotate the screw 225 one revolution about the axis A, whereby the inlet port 282 of the fluid shaft 240 transitions to the on or open state at a linear position between the top shaft seal 251 and the bottom shaft seal 252 positioned at the chamber 249. Here, the inlet port 282 is substantially aligned with the cartridge feed aperture 246 for receiving fluid material from the cartridge feed aperture 246. Continuing with this example, the motor 215 can rotate the screw 225 another revolution about the axis A, whereby the fluid shaft inlet port 282 transitions to the off or closed state. In the closed state, the top shaft seal 251 or the bottom shaft seal 252 covers the inlet port 282 to prevent fluid from entering the inlet port 282 from the cartridge feed aperture 246. The motor 215 can therefore move the location of the fluid shaft inlet port 282 relative to the cartridge feed aperture 246 with high precision. Accordingly, the motor 215 can control the quality and rate of flow of fluid material during the dispensing operation. For example, the motor 215 can adjust a position of the fluid shaft 240 so that the entire inlet port 282 is positioned at the chamber 249, and exposed to the cartridge feed aperture 246 so that a maximum flow of fluid material is introduced to the fluid path 271 in the fluid shaft 240 during a dispensing operation. In another example, the motor 215 can adjust a position of the fluid shaft 240 so that a predetermined portion of the inlet port 282, for example, 50% of the inlet port 282, is positioned at the chamber 249 and exposed to the cartridge feed aperture 246, and the other 50% is covered by the top shaft seal 251.

Figure 5A:
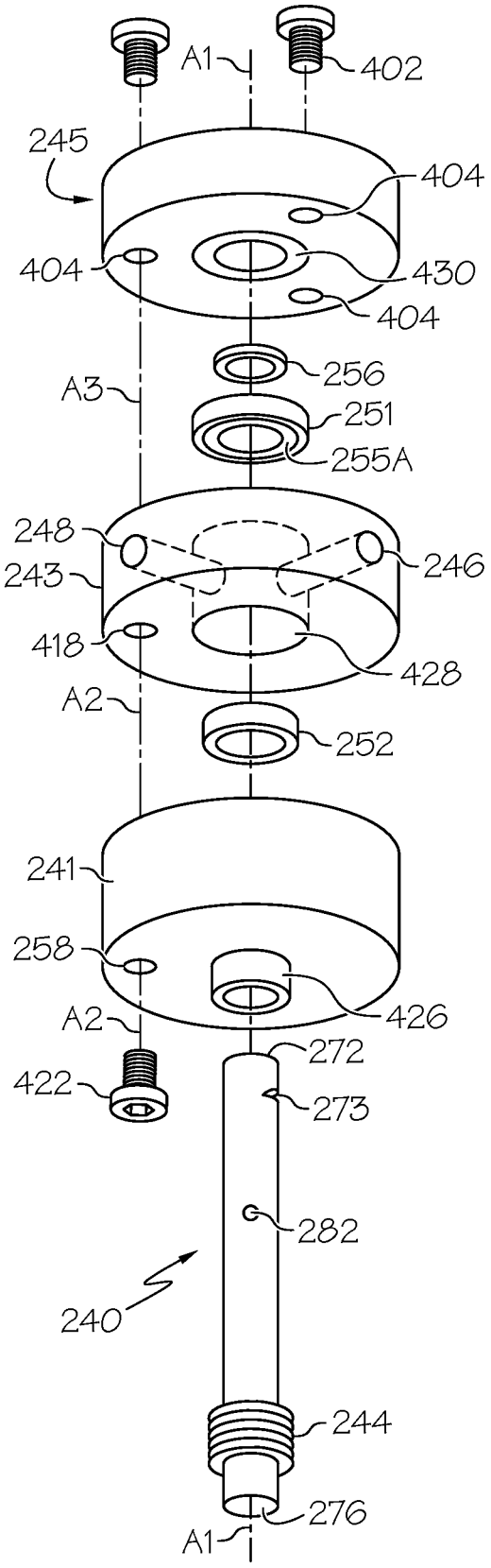
FIG. 5A is an exploded perspective view of a cartridge assembly, in accordance with an embodiment.
Figure 5B:
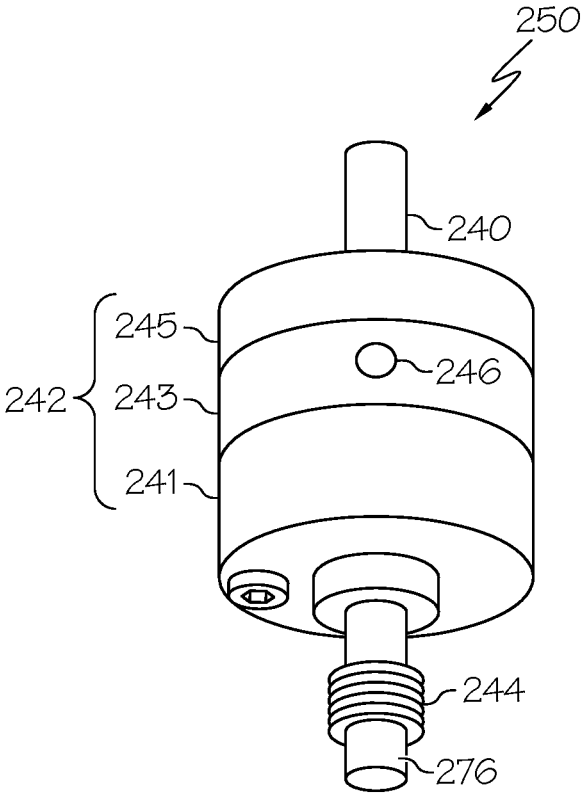
FIG. 5B is an assembled perspective view of the cartridge assembly of FIG. 5A.

FIGS. 5A and 5B are an exploded perspective view and an assembled perspective view, respectively the cartridge assembly 250 of FIGS. 2-4, in accordance with an embodiment.

The cartridge body 242 of the cartridge assembly 250 can include a plurality of ring-shaped sections, namely, a first section 241, the second section 243, and the third section 245. The first section 241 includes a hole 426 extending from a bottom surface to a top surface of the first section 241. The second section 243 includes a hole 428 extending from a bottom surface to a top surface of the second section 242. The third section 245 includes a hole 430 extending from a bottom surface to a top surface of the third section 245. The first, second, and third sections 241, 243, 245 can have a similar diameter, width, and related cross-sectional dimensions. In this manner, when coupled together, the first section 241, the second section 243, and the third sections 245 form a cylindrical-shaped cartridge body 242 having a uniform outer surface. The holes 426, 428, and 430 of the first, second, and third sections 241, 243, 245, respectively can be aligned with each other along an axis A1 for receiving a fluid shaft 240.

The first section 241 includes at least one screw hole 258 extending through the first section 241 along an axis A2. The screw hole 258 is aligned with a screw hole 418 extending through at least a portion of the bottom surface of the second section 243. At least one of the screw holes 258, 418 can be threaded. Accordingly, a screw 422, nut and bolt, or other fastening device can be inserted in the screw hole 258 and screwed into the screw hole 418 to secure the first section 241 to the second section 243. At least one of the screw holes 258, 418 can be threaded.

The third section 245 includes at least one screw hole 404 extending through the third section 243 along an axis A3. The axis A3 can be along the same axis as the axis A2, can be parallel to the axis A2, or can be along a different axis. The second section 243 includes a screw hole (not shown) that is aligned with a screw hole 404 of the third section 243, and also extends along the axis A3. A screw 402, nut and bolt, or other fastening device can be inserted into each screw hole 404 and screwed into the screw hole (not shown) at the top surface of the second section 243 to secure the second section 243 to the third section 245.

The second section 243 includes a feed aperture 246 that extends from a sidewall of the second section 243 to the hole 428 in the second section 243. A feed tube, for example, the feed tube 260 shown in FIG. 2, can be coupled to the cartridge feed aperture 246 as described herein.

The second section 243 can also include a pin capture 248 constructed and arranged to receive an end of a thumb screw 211 as shown in FIG. 2 or 4, or a cartridge release pin, or related mechanism for releasably securing the cartridge body 242 to a cartridge cavity 266 at the bottom portion 210 of the pump housing 205.

The fluid shaft 240 includes a coupling end 272 that can be inserted into an opening 234 of the interconnect 230. The fluid shaft 240 includes a pin capture 273 that, as shown in FIG. 4, can engage a lock pin 231 or other securing mechanism that extends through the interconnect 230 to hold the fluid shaft 240 in place against the interconnect 230. The fluid shaft 240 can include a threaded outlet region 244 opposite the coupling end 272 for receiving a needle nut 270, which can hold a dispense needle in place against the outlet 276 of the fluid shaft 240.

A fluid path (see FIG. 3) extends along at least a portion of the length of the fluid shaft 240 to the outlet 276. An inlet port 282 extends through a side surface of the fluid shaft 240 to the fluid path 271. In a dispensing operation, the inlet port 282 can be aligned with the cartridge feed aperture 246 of the cartridge body 242 to receive fluid material from a source such as the syringe 265 shown in FIG. 2 via the feed tube 260.

A bottom shaft seal 252 is conformably seated in a seal housing in an upper region of the hole 426 in the first section 241. A top shaft seal 251 is conformably seated in a seal housing at a lower region of the hole 430 in the third section 245. The top shaft seal 251 can include an o-ring 255A compressed into the top shaft seal 251. The bottom shaft seal 252 can optionally include an o-ring (not shown) compressed into the bottom shaft seal 252. An o-ring 256 can be positioned in the hole 430 of the third section 245, and positioned about the fluid shaft 240 between the top shaft seal 251 and an inner surface of the third section 245. The third section 245 when coupled to the second section 243 compresses the o-ring 256 into the top shaft seal 251, the surface of hole 430 in the third section 245, and about the fluid shaft 240 to prevent fluid from escaping beyond the upper region of the fluid cavity during a dispensing operation. An optional o-ring (not shown) can also be positioned in the hole 426 of the first section 241, and positioned about the fluid shaft 240 between the bottom shaft seal 252 and an inner surface of the first section 241 for preventing fluid from escaping beyond the lower region of the fluid cavity.

As described above, the fluid shaft 240 is inserted through the holes 426, 428, 430 of the first, second, and third sections 241, 243, 245 of the cartridge body 243, respectively. The top shaft seal 251 is positioned about the shaft 240 above the shaft inlet port 282, and the bottom shaft seal 252 is positioned about the shaft 240 below the shaft inlet port 282. The inner diameters of the ring-shaped seals 251, 252 can be slightly less than the diameter of the fluid shaft 240. Accordingly, the top shaft seal 251 uniformly contacts the outer circumferential surface of the fluid shaft 240 so as to provide a seal with the fluid shaft 240 above the shaft inlet port 282, and the bottom shaft seal 252 uniformly contacts the outer circumferential surface of the fluid shaft 240 so as to provide a seal with the fluid shaft 240 below the shaft inlet port 282. The shaft inlet port 282 can move axially relative to the cartridge body 242 between the top shaft seal 251 and the bottom shaft seal 252.

Figure 6:
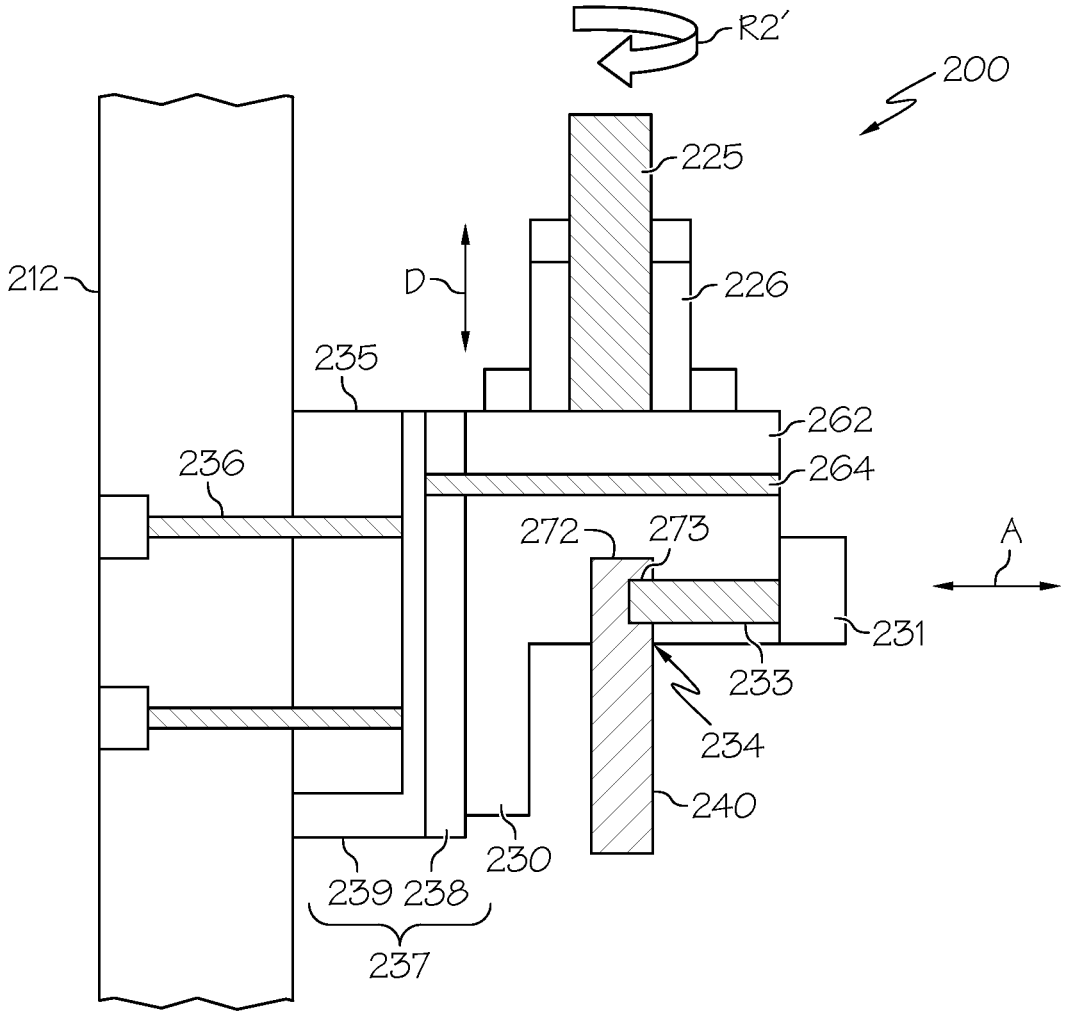
FIG. 6 is a cutaway side view of the fluid dispense pump of FIGS. 2-5, in accordance with an embodiment.

FIG. 6 is a cutaway side view of the fluid dispense pump system 200 of FIGS. 2-5, in accordance with an embodiment.

The pump system 200 includes a stationary base 235 coupled to the sidewall 212 of the pump housing 205 by one or more screws 236 or other fastening device, adhesive, and the like. A ball slide guide 237 is positioned between the base 235 and a back surface of the interconnect 230. The ball slide guide 237 can have a configuration that is well-known to those of ordinary skill in the art. The ball slide guide 237 can include a block 238 and a guide rail 239. The interconnect 230 can be coupled to the block 238 by one or more screws 264 inserted through holes 262 extending from a front surface to the back surface of the interconnect 230. The guide rail 239 can include a set of raceway grooves (not shown). A plurality of steel balls can roll along the raceway grooves during a dispensing operation to ensure a smooth linear motion of the interconnect 230 in a direction D during a dispensing operation.

As described above, the fluid shaft 240 can be inserted in the opening 234 at a bottom surface of the interconnect 230 and held in place against the interconnect 230 by the lock pin 231. The lock pin 231 is inserted in an opening 233 at a side of the interconnect 230, and can be pushed or pulled in a direction A to engage with the pin capture 273 at the coupling end 272 of the fluid shaft 240 or to release from the fluid shaft 240. Accordingly, during a dispensing operation, the fluid shaft 240 moves in the linear direction D with the interconnect 230 and the ball nut 226.

Figure 7A:
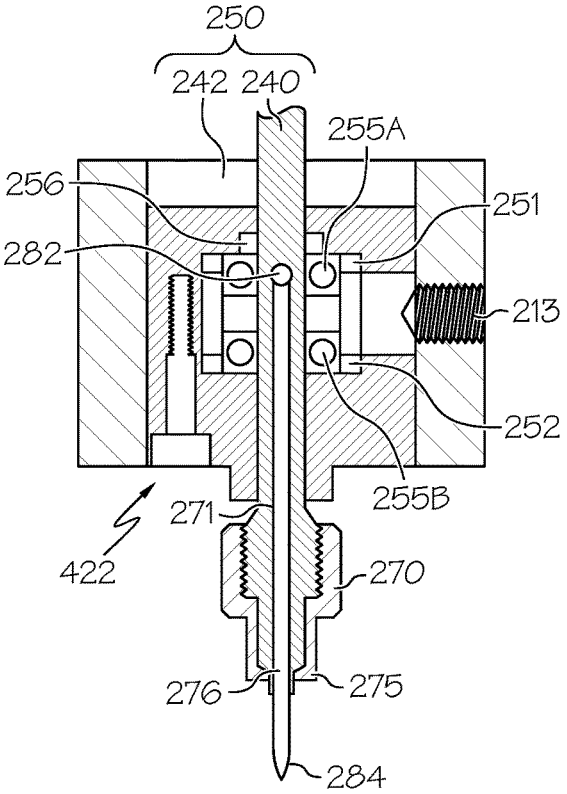
FIG. 7A is a cutaway front view of the fluid dispense pump of FIGS. 2-6, wherein a fluid shaft inlet port is at a first linear position in a cartridge body chamber, in accordance with an embodiment.
Figure 7B:
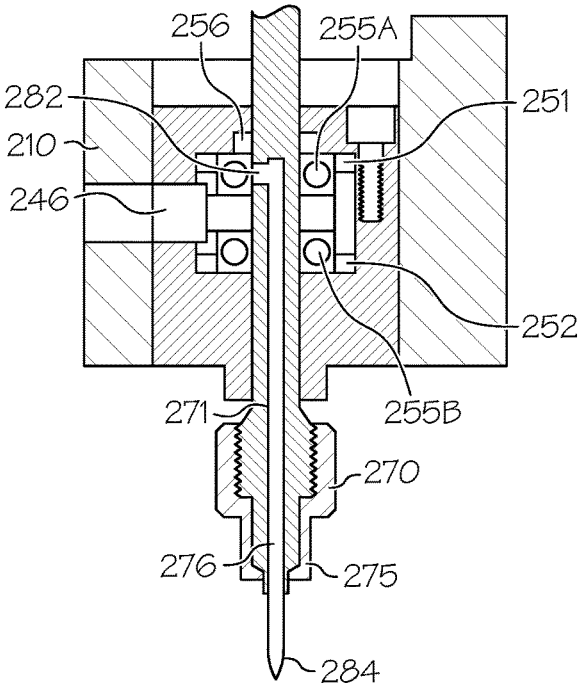
FIG. 7B is a cutaway side view of the fluid dispense pump shown in FIG. 7A.

FIG. 7A is a cutaway front view of the fluid dispense pump system 200 of FIGS. 2-6. The fluid shaft inlet port 282 is at a first linear position relative to the cartridge feed aperture 246. FIG. 7B is a cutaway side view of the fluid dispense pump of FIG. 7A. Here, the fluid shaft inlet port 282 is covered by the top shaft seal 251 to prevent fluid material from being transferred from the cartridge feed aperture 246 to the fluid path 271 extending through the shaft 240. At FIGS. 7A and 7B, the inlet port 282 is at the first linear position, also referred to as an off or closed position, for example, at the beginning of an downstroke of the fluid shaft 240, or at the end of a upstroke of the fluid shaft 240.

Figure 8A:
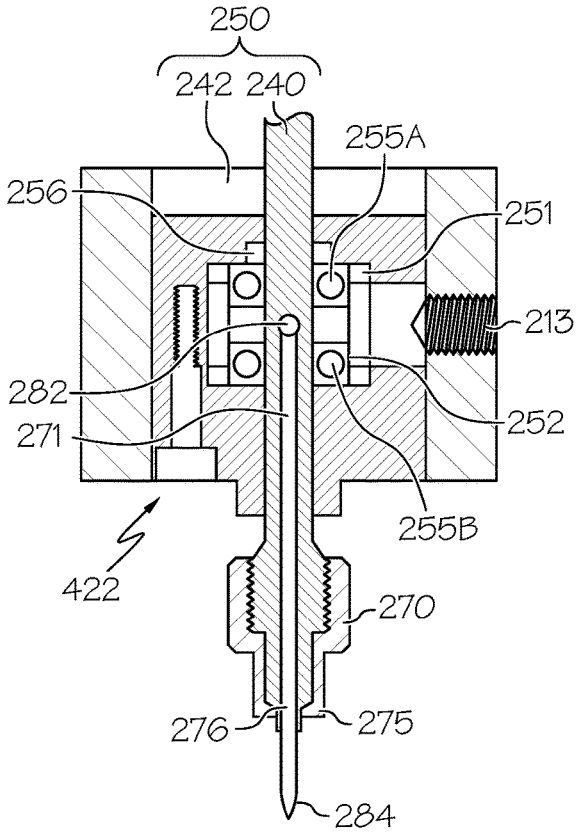
FIG. 8A is a cutaway front view of the fluid dispense pump of FIGS. 2-7B, wherein the fluid shaft inlet port is at a second linear position in the cartridge body chamber, in accordance with an embodiment.
Figure 8B:
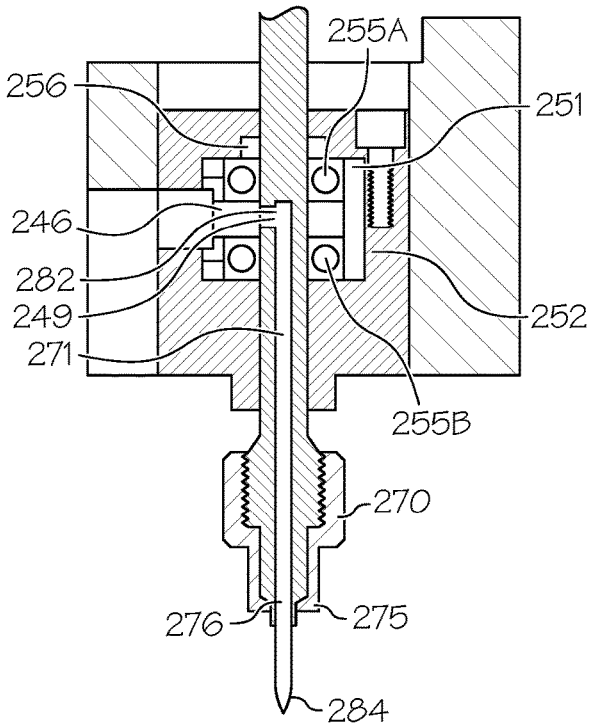
FIG. 8B is a cutaway side view of the fluid dispense pump shown in FIG. 8A.

FIG. 8A is a cutaway front view of the fluid dispense pump system 200 of FIGS. 7A and 7B in which the fluid shaft inlet port 282 is at a second linear position. Here, the fluid shaft inlet port 282 is substantially aligned with the cartridge feed aperture 246, in accordance with an embodiment. FIG. 8B is a cutaway side view of the fluid dispense pump system 200 shown in FIG. 8A. The fluid shaft 240 can move linearly from the first linear position to the second linear position, also referred to as on or open position. After the shaft 240 transitions to the second linear position, for example, during a downstroke, the fluid shaft inlet port 282 is in the chamber volume between the top shaft seal 251 and the bottom shaft seal 252, and positioned so that at least a portion of the inlet port 282 is exposed to the cartridge feed aperture 246. Here, fluid material can be transferred from the cartridge feed aperture 246 via the inlet port 282 to the fluid path 271 in the shaft 240 at a precise, controlled rate, for example, determined by a motion control system described in FIG. 26.

Accordingly, as illustrated at FIGS. 7A, 7B, 8A, and 8B, the fluid pump system 200 can transition between two states during a dispensing operation. The first state corresponds to the first linear position, or closed position, of the fluid shaft 240 as shown in FIGS. 7A and 7B. The second state corresponds to the second linear position, or open position, of the fluid shaft 240 as shown in FIGS. 8A and 8B. Fluid pressure can be produced at the cartridge feed aperture 246 when the inlet port 282 is completely or partially blocked by the top shaft seal 251. To release pressurized fluid material from the cartridge chamber volume to the fluid path 271, the top shaft seal 251 covering the inlet port 282 in the first linear position is separated from the inlet port 282 by moving the fluid shaft 240 to the second linear position. The position, velocity, acceleration, and deceleration of the fluid shaft 240 can be controlled by the motor 215 in a manner that permits the fluid material to be introduced to the inlet port 282 at a reduced pressure and at a controlled flow rate, reducing the risk of clogging the inlet port 282 with fluid material, or an unexpected burst of pressurized fluid material to the fluid path 271. For example, a greater area of exposure of the inlet port 282 to the chamber volume can result in the fluid material entering the inlet port 282 at a greater flow rate from the cartridge feed aperture 246.

Figure 9A:
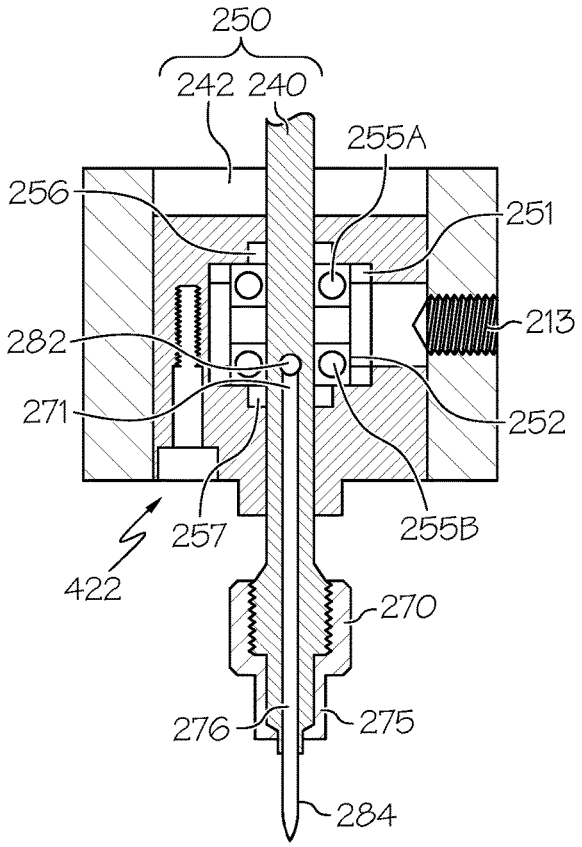
FIG. 9A is a cutaway front view of the fluid dispense pump of FIGS. 2-8B, wherein the fluid shaft inlet port is at a third linear position relative in the cartridge body chamber, in accordance with an embodiment.
Figure 9B:
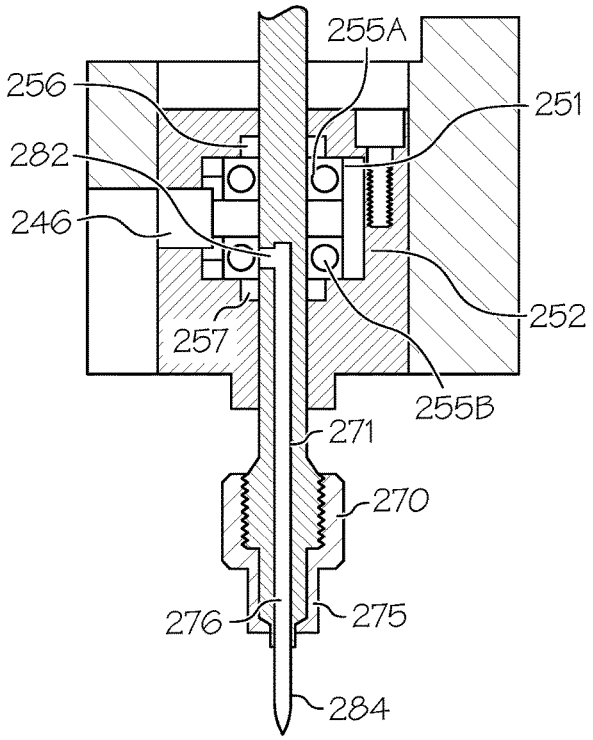
FIG. 9B is a cutaway side view of the fluid dispense pump shown in FIG. 9A.

In another embodiment, the fluid pump system 200 can transition between three states during a dispensing operation: a first state corresponding to the first linear position, or closed position, of the fluid shaft 240 as shown in FIGS. 7A and 7B, a second state corresponding to the second linear position, or open position, of the fluid shaft 240 as shown in FIGS. 8A and 8B, and a third state corresponding to a third linear position, also referred to as an off or closed position, as shown in FIGS. 9A and 9B. In FIGS. 9A and 9B, the fluid shaft inlet port 282 is covered by the bottom shaft seal 252 to prevent fluid material from being transferred from the cartridge feed aperture 246 to the fluid path 271 extending through the shaft 240, similar to the top shaft seal 251. An o-ring 257 (shown in FIGS. 9A and 9B) can be conformably positioned about the fluid shaft 240 between the bottom shaft seal 252 and a bottom surface of the chamber of the cartridge body 242 to prevent fluid from escaping from the bottom region of the chamber volume. The fluid shaft 240 can transition from the third state to the second state shown in FIGS. 8A and 8B, for example, during an upstroke of the fluid shaft 240.

In another embodiment, the fluid pump system 200 can transition between two states during a dispensing operation: a first state corresponding to a linear position of the fluid shaft 240 as shown in FIGS. 9A and 9B, and a second state corresponding to the linear position of the fluid shaft 240 as shown in FIGS. 8A and 8B. In this embodiment, the fluid shaft inlet port 282 is covered by the bottom shaft seal 252 to prevent fluid material from being transferred from the cartridge feed aperture 246 to the fluid path 271 extending through the shaft 240. The fluid shaft 240 can transition from the linear position, or closed position, shown in FIGS. 9A and 9B to the linear position, or open position, shown in FIGS. 8A and 8B. In the second state, the fluid shaft inlet port 282 is in the chamber volume between the top shaft seal 251 and the bottom shaft seal 252, and positioned so that at least a portion of the inlet port 282 is exposed to the cartridge feed aperture 246, where fluid material can be transferred from the cartridge feed aperture 246 via the inlet port 282 to the fluid path 271 in the shaft 240.

In another embodiment, the fluid pump system 200 can transition between three states during a dispensing operation: a first state corresponding to the closed position of the fluid shaft 240 as shown in FIGS. 9A and 9B, a second state corresponding to the open position of the fluid shaft 240 as shown in FIGS. 8A and 8B and a third state corresponding to the closed position as shown in FIGS. 7A and 7B.

Figure 10A:
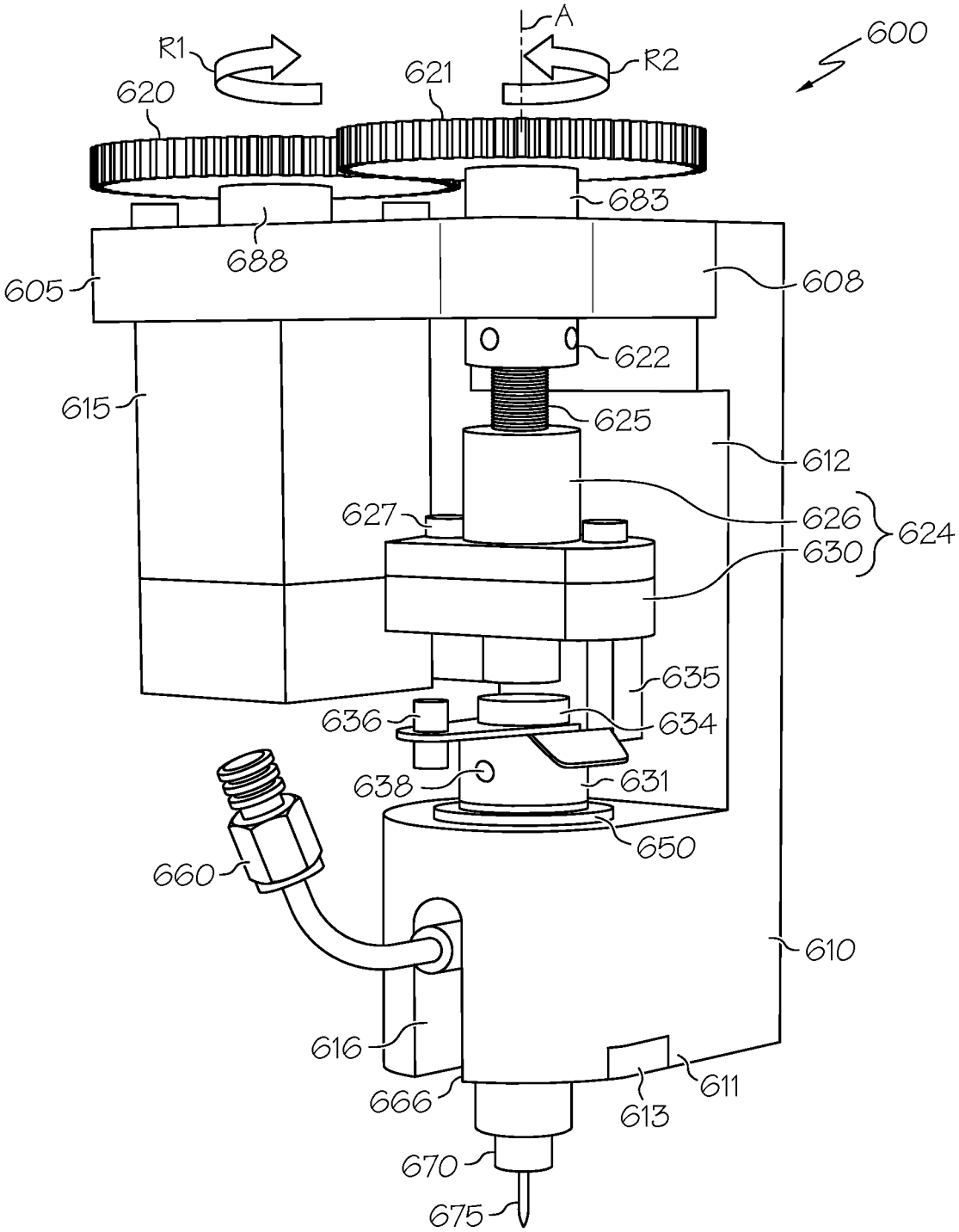
FIG. 10A is a perspective view of a fluid dispense pump system, in accordance with other embodiments of the present inventive concepts.
Figure 10B:
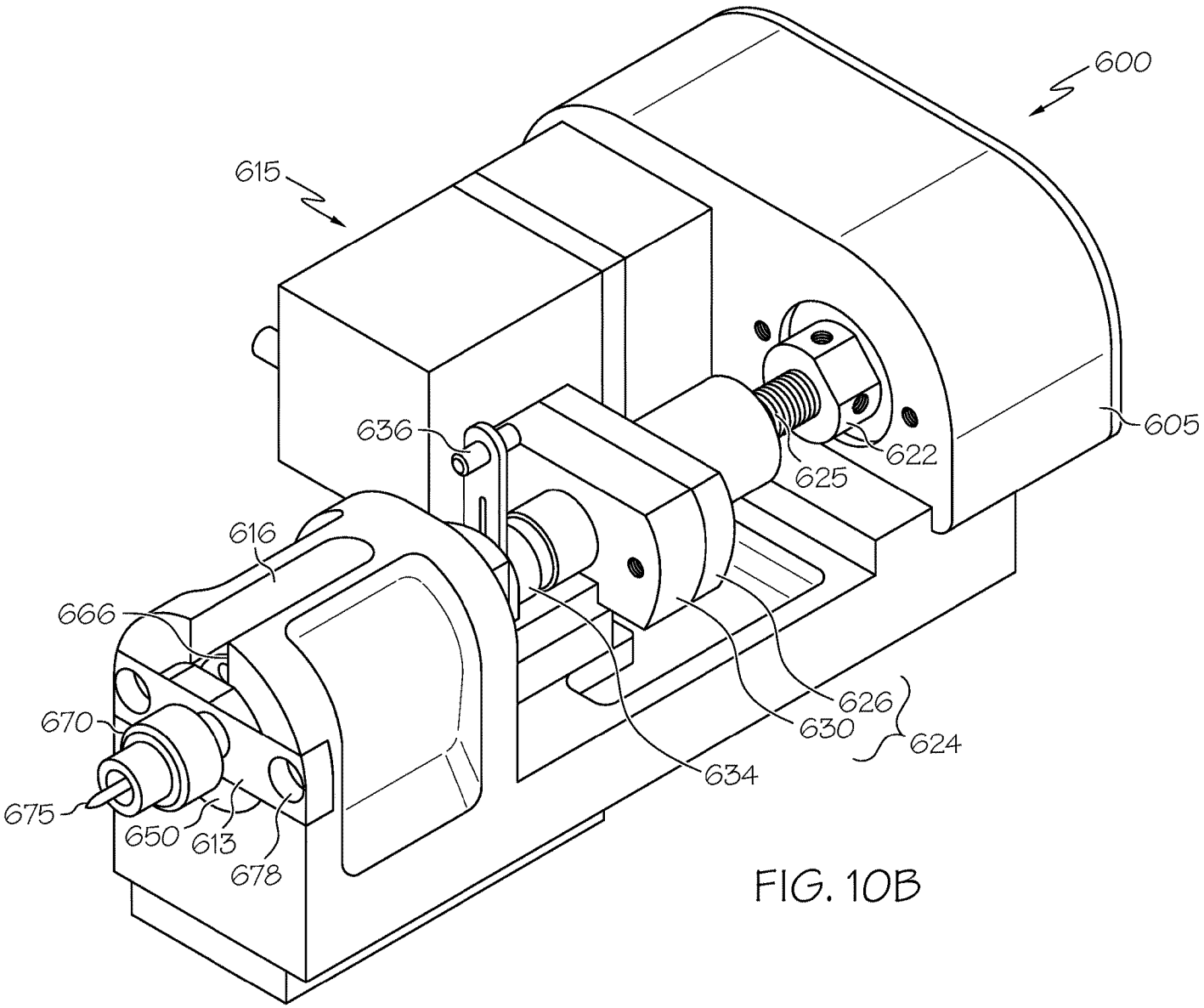
FIG. 10B is another perspective view of the fluid dispense pump system of FIG. 10A.
Figure 10C:
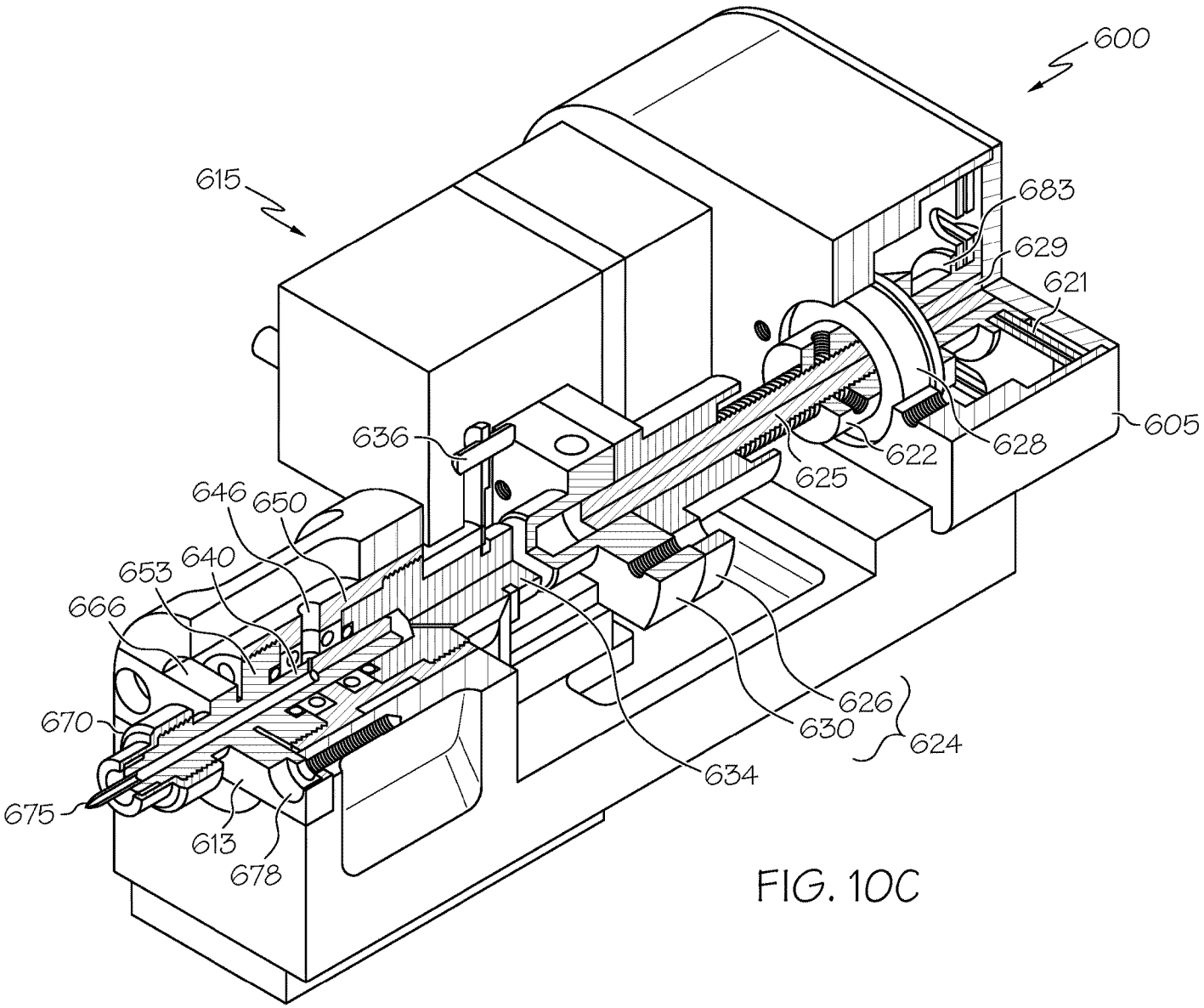
FIG. 10C is a partial cutout view of the fluid dispense pump system of FIGS. 10A and 10B.
Figure 10D:
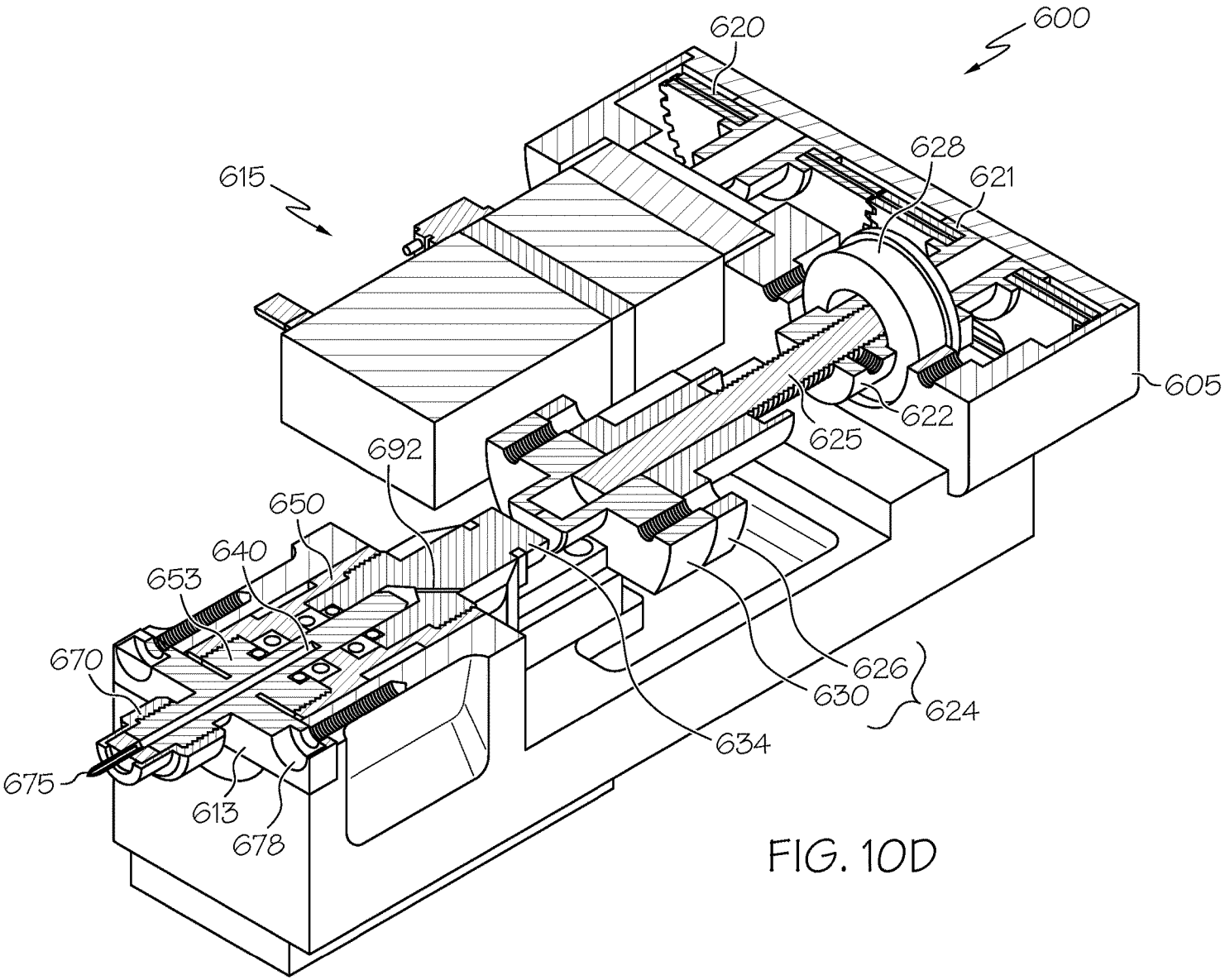
FIG. 10D is another partial cutout view of the fluid dispense pump system of FIGS. 10A-10C.

FIG. 10A is a perspective view of a fluid dispense pump system 600, in accordance with other embodiments of the present inventive concepts. FIG. 10B is another perspective view of the fluid dispense pump system 600 of FIG. 10A. FIG. 10C is a partial cutout view of the fluid dispense pump system 600 of FIGS. 10A and 10B. FIG. 10D is another partial cutout view of the fluid dispense pump system 600 of FIGS. 10A-10C.

The fluid dispense pump system 600 includes a pump housing 605, a motor 615, a ball slide assembly 624, a cartridge assembly 650, and a fluid shaft 640 (see FIGS. 10C and 10D). The fluid dispense pump system 600 is similar to the fluid dispense pump system 200 described with reference to FIGS. 2-9, with at least one notable exception, namely, that the fluid shaft remains stationary during a dispensing operation, and the cartridge assembly 650 includes a cartridge body that moves axially and/or radially relative to the fluid shaft 640.

The pump housing 605 includes a top portion 608, a bottom portion 610, and a sidewall 612 between the top portion 608 and the bottom portion 610. The top portion 608 and the sidewall 612 of the pump housing 605 can be similar to the pump housing 205 of FIGS. 2-9. A detailed description of the top portion 608 and the sidewall 612 is therefore not repeated for reasons of brevity.

The bottom portion 610 of the pump housing 605 includes a cartridge socket 666 for receiving the cartridge assembly 650, and is constructed and arranged so that the fluid shaft 640 remains stationary during a dispensing operation and so that the cartridge assembly 650 can move axially and/or radially relative to the fluid shaft in the cartridge socket 666. The cartridge assembly 650 is adapted to receive a dispense needle 675, which can be attached at an outlet region of the fluid shaft. The dispense needle can be a fixed-z dispensing type, a Luer-type, or other type known to those of ordinary skill in the art. The dispense needle 675 can be the same or similar to those disclosed in U.S. Pat. Nos. 6,547,167, 6,981,664, 6,957,783, U.S. patent application Ser. No. 12/034,313, filed Feb. 2, 2008, entitled "Material Dispense Tips and Methods for Manufacturing the Same," and/or U.S. patent application Ser. No. 12/647,911, filed Dec. 28, 2009, entitled "Material Dispense Tips and Methods for Forming the Same," the contents of each of which is incorporated herein by reference in its entirety. The dispense needle 675 can be held in place by a needle nut 670 positioned about the dispense needle 675 and coupled to the fluid shaft.

At least one groove or channel 611 can extend through the bottom portion 610 of the pump housing 605. The channel 611 can receive a protruding mount 613 of the fluid shaft, which can be secured in the channel 611 by a screw or other attachment device threaded or otherwise extending in a hole 678, for example, a threaded opening, in the mount 613. In this manner, the fluid shaft remains stationary in the cartridge socket 666 during a dispensing operation. The bottom portion 610 of the pump housing 605 can also include a slot 616 for receiving a feed tube 660, which is inserted into a feed aperture (not shown in FIG. 10A) in a sidewall of the cartridge body 642. A syringe (not shown) or other source of material to be dispensed can be coupled to the other end of the feed tube 660. The feed tube 660 can be the same as or similar to the feed screw 260 described in FIGS. 2-9. A detailed description of the feed tube 660 is therefore not repeated for reasons of brevity.

The ball slide assembly 624 includes a ball nut 626 and an interconnect 630. The ball nut 626 can be the same as or similar to the ball nut 226 of FIGS. 2-9 in that the ball nut 626 moves up and down a ball screw 625 during rotation of the ball screw 625. A detailed description of the ball nut 626 and the ball screw 625 is therefore not repeated for reasons of brevity.

The interconnect 630 is coupled to one end to the ball nut 626 by one or more screws 627, or by adhesives or other attachment mechanism known to those of ordinary skill in the art. A retainer 634 is positioned in an interconnect socket 631 at an opposite end of the interconnect 630 for attaching the cartridge body 642 to the interconnect 630.

Figure 27:
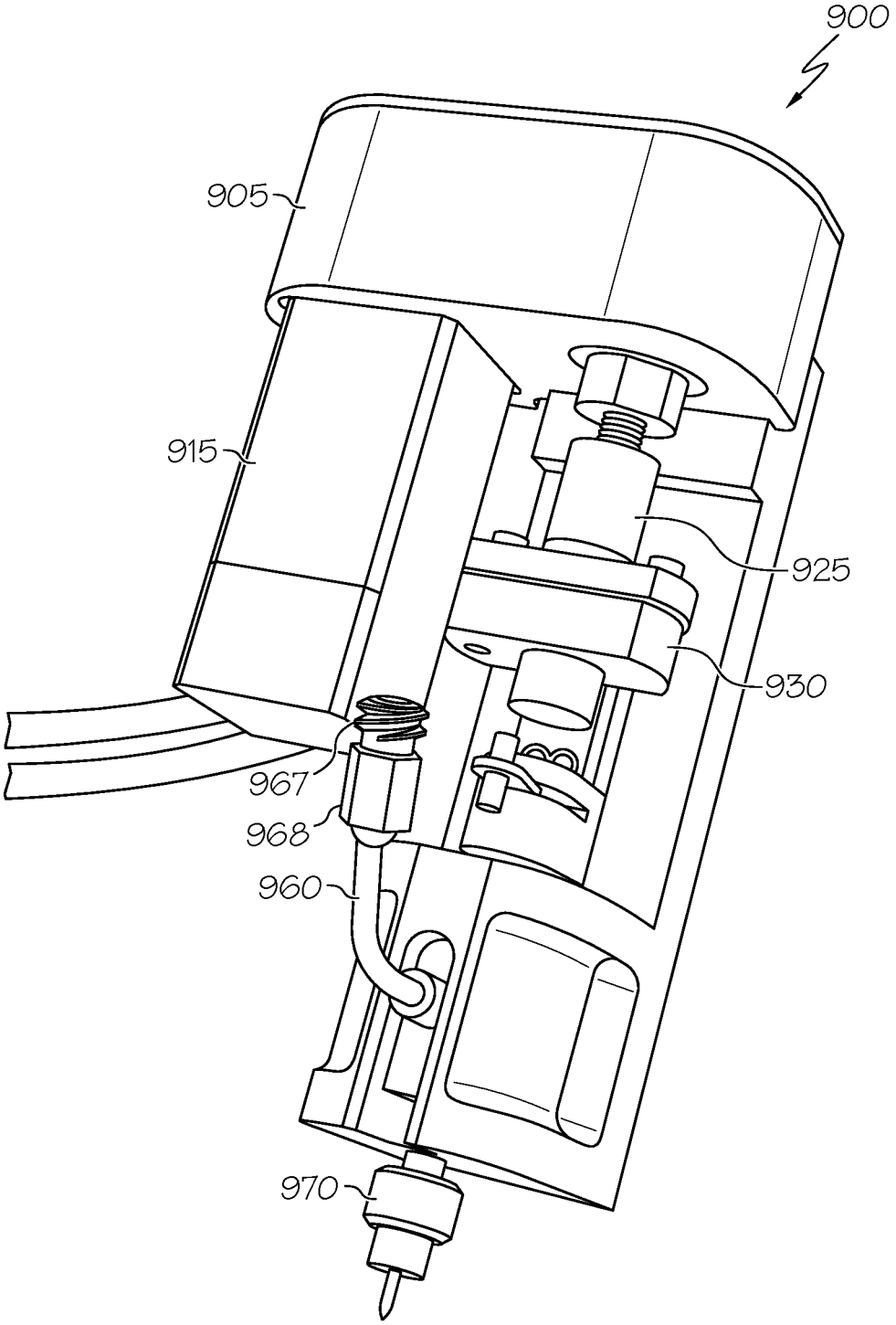
FIG. 27 is a perspective view of a fluid dispense pump, in accordance with another embodiment.

FIG. 27 is a perspective view of a fluid dispense pump 900, in accordance with another embodiment. The fluid dispense pump system 900 includes a pump housing 905, a motor 915, a ball nut 925, an interconnect 930, a cartridge assembly (not shown), and a needle nut 970 which are similar to comparable elements the fluid dispense pump system 600 described with reference to FIGS. 10-16. Details of the pump housing 905, motor 915, ball nut 925, the interconnect 930, the cartridge assembly (not shown), the needle nut 970, and other similar elements are therefore not repeated for brevity.

The fluid dispense pump system 900 also includes a feed tube 960, one end of which is inserted into a feed aperture (not shown) in a sidewall of the cartridge body. A syringe or other source of material to be dispensed is coupled to a threaded adapter 968 at the other end of the feed tube 960. A nut 967 can be turned or otherwise adjusted to screw the threaded adaptor 968 into the syringe or the like. The feed tube 960 can be formed of a rigid material such as stainless steel, aluminum, and the like. Alternatively, the feed tube 960 can be formed of a flexible material such as plastic or rubber, and can elastably deform to fit over a syringe output adapter to form a tight seal with the syringe.

Figure 11A:
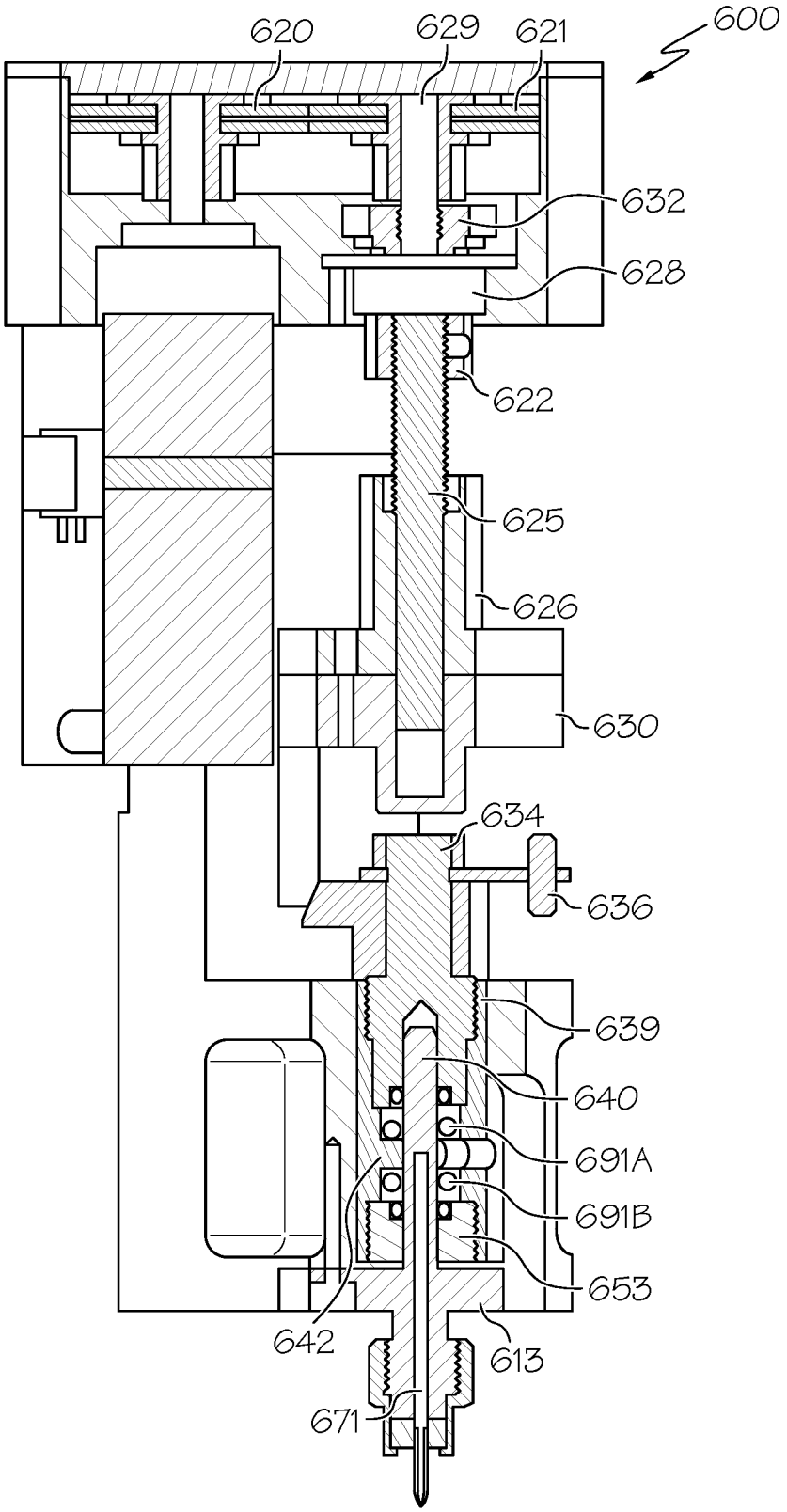
FIG. 11A is a cutaway view of the fluid dispense pump system of FIGS. 10A-10D, in accordance with an embodiment.
Figure 11B:
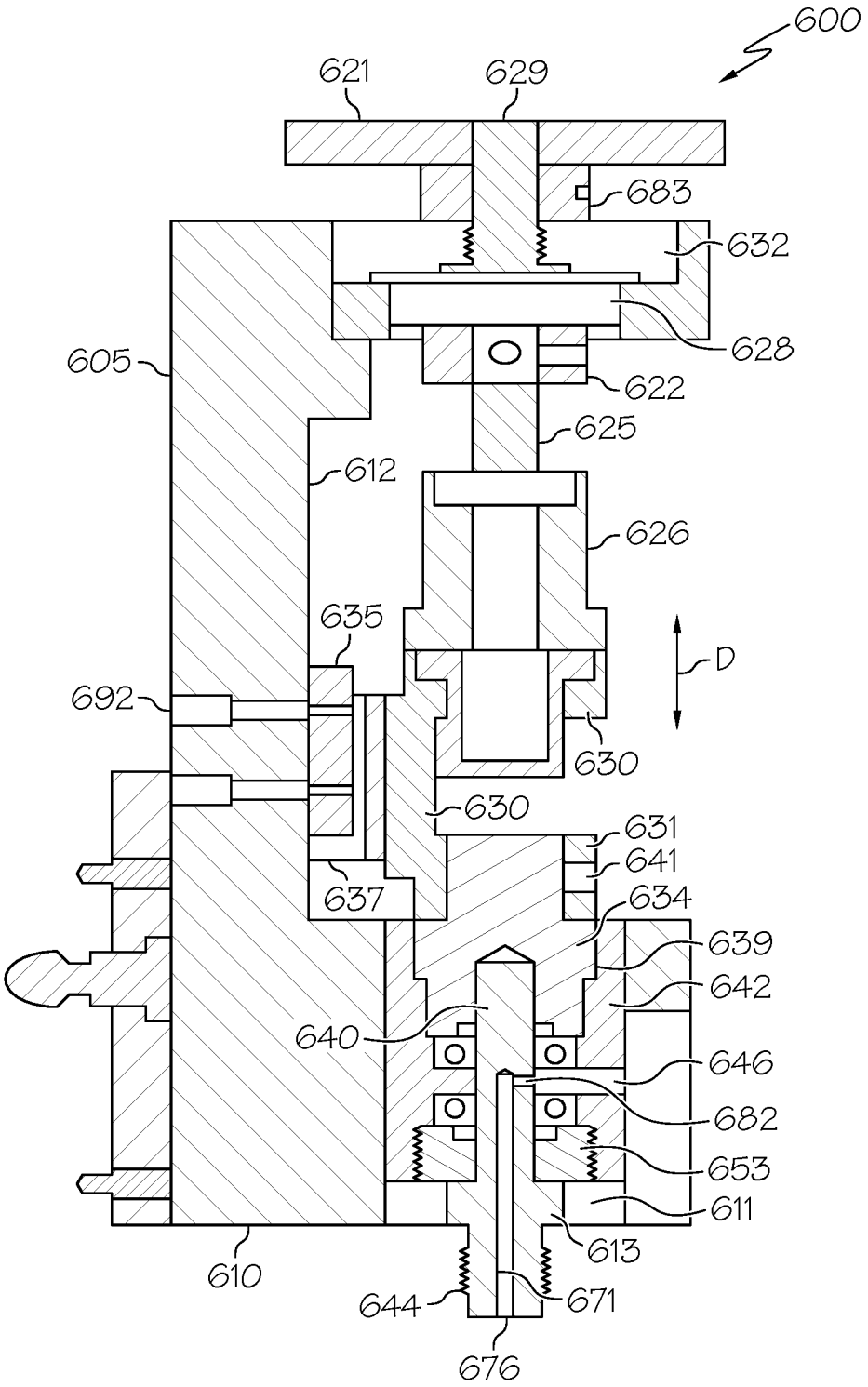
FIG. 11B is a cutaway view of the fluid dispense pump system of FIGS. 10A-10D, in accordance with another embodiment.

FIG. 11A is a cutaway side view of a fluid dispense pump system 600 of FIGS. 10A-10D, in accordance with an embodiment. FIG. 11B is a cutaway side view of the fluid dispense pump system 600 of FIGS. 10A-10D, in accordance with another embodiment.

A stationary base 635 is attached to the sidewall 612 of the pump housing 605 by one or more screws 692, or by an adhesive or other fastening device. A ball slide guide 637 is positioned between the base 635 and a back surface of the interconnect 630. The ball slide guide 637 can be the same as or similar to the ball slide guide 237 described with reference to FIGS. 2-9, except that the ball slide guide 637 drives the cartridge body 642. A detailed description of the ball slide guide 637 is therefore not repeated for reasons of brevity.

The interconnect 630 can be coupled to the ball slide guide 637 by one or more screws, bolts, adhesives, or other attachment mechanism known to those of ordinary skill in the art. Accordingly, when the ball slide 637 moves in an axial direction relative to the stationary base 635, the interconnect 630 likewise moves in an axial direction along the stationary base 635 attached to the sidewall 612 of the pump housing 605.

The ball nut 626 is attached to a top section of the interconnect 630. The interconnect retainer 634 is inserted into an opening at the interconnect socket 631 at the bottom region of the interconnect 630 and held in place against the interconnect 630 by a screw or related attachment mechanism, a clip 636, and/or a latch. The ball nut 626 coupled to the interconnect 630 is prevented from rotating with the ball screw 625 and instead translates up and down the ball screw 625 in a linear, reciprocating manner, for example, in a direction D, during a corresponding rotation of the ball screw 625.

As described above, the cartridge assembly 650 is positioned in the cartridge socket 666 at the bottom portion 610 of the pump housing 605. The cartridge body 642 can include a threaded opening 639 that is screwed into the retainer 634. A top portion of the fluid shaft 640 can be positioned in the retainer 634. As described above, the barrel of the fluid shaft 640 includes a mount 613 having wings, each extending laterally from the barrel of the fluid shaft 640 and inserted in the groove 611 at the underside of the pump housing 605 to hold the shaft 640 in place against the pump housing 605. The mount 613 and the shaft 640 can be formed, for example, machined, from a single stock, or can be formed separately and attached to each other. The retainer 634 can include a vent hole 692 that permits air or other gas that may otherwise be contained between the fluid shaft 640 and the interior of the retainer 634 to escape. The wings of the mount 613 when inserted in the grooves 611 this manner can control the orientation and/or position of the cartridge feed aperture 646 of the cartridge body 642 relative to an inlet port 682 of the fluid shaft 640 with high precision.

FIGS. 11A and 11B are different than each other in that, in FIG. 11B, the retainer 634 is held in place against the interconnect 630 by a screw 641 or related fastener, and in FIG. 11B, the retainer 634 is held in place by a clip 636 and the like.

Returning to FIGS. 10A-10D, during a dispensing operation, the motor 615 applies a rotational force to a motor drive axle, not shown since it is covered by a gear coupling 688. The motor 615 can include an encoder (not shown) that provides for precise control over indexed angular, or rotational, positions, an angular velocity, and/or an angular acceleration of the motor 615. The axle drives a first gear 620 in a first rotational direction R1. The first gear 620 is in a mesh relationship with a second gear 621, and therefore drives the second gear 621 in an opposite rotational direction R2. A second gear 621 is coupled to a shaft 629 (shown in FIG. 11) in a manner similar to that described in FIGS. 2 and 3, for example, by a coupling 683 of the second gear 621. A bearing assembly 628 communicates with the shaft 629 by permitting the shaft 629 to rotate about an axis A. A nut 622 holds a top portion of the ball screw 625 in place against the sleeve 628, so that the ball screw 625 rotates in response to a corresponding rotation of the second gear 621, shaft 629, and sleeve 628. Another nut 632 can be threaded about the shaft 629, and positioned on the bearing assembly 628.

When the ball screw 625 rotates, the ball nut 626 is translated up and down the ball screw 625, and moves the interconnect 630 in a linear direction along the stationary base 635. The interconnect 630 in turn moves the interconnect retainer 634. Since the cartridge body 642 is attached to the interconnect retainer 634, and since the fluid shaft 640 is stationary, the linear movement of the interconnect retainer 634 can drive the movement of the cartridge body 642 in the linear direction.

The motor 615 can move the location of the cartridge feed aperture 646 of the cartridge body 642 relative to an inlet port 682 of the fluid shaft 640 with high precision. For example, as shown in FIG. 11B, the motor 615 can adjust a position of the cartridge body 642 so that some or all of the cartridge feed aperture 646 of the cartridge body 642 is exposed to the fluid shaft inlet port 682. In this manner, a controlled flow of fluid material can be introduced to the fluid path 671 in the fluid shaft 640 during a dispensing operation. In another example, the motor 615 can adjust a position of the cartridge feed aperture 646 so that a predetermined portion of the cartridge feed aperture 646, for example, 50% of the cartridge feed aperture 646, is exposed to the fluid shaft inlet port 682. The dispense needle 675 does not move during the dispensing operation, since it is coupled to the stationary fluid shaft 640.

Figure 12:
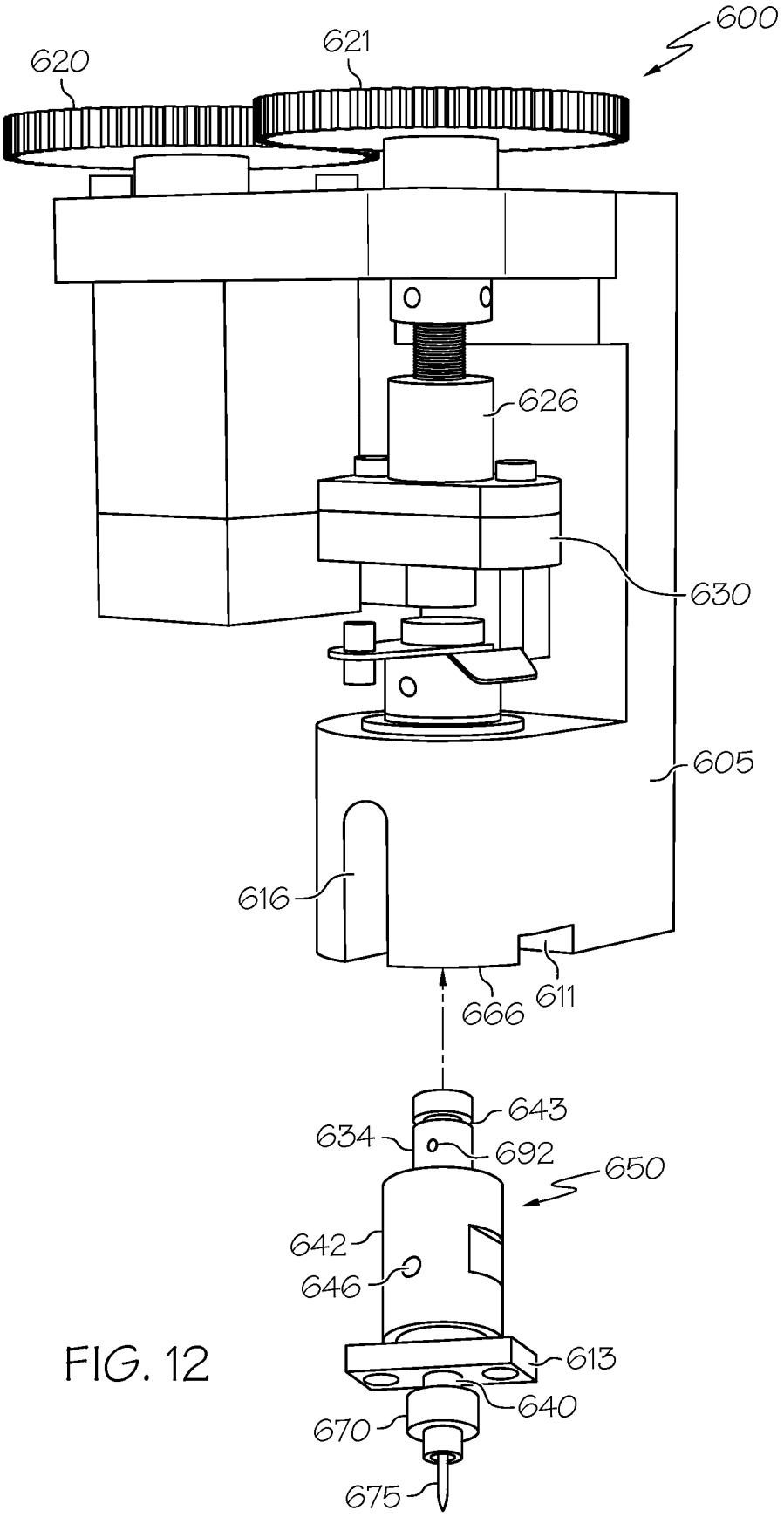
FIG. 12 is a perspective view of the fluid dispense pump of FIGS. 9 and 10, illustrating the cartridge assembly separate from the pump housing, in accordance with an embodiment.

The cartridge assembly 650 can be removed from the pump housing 605 in a similar manner as shown in FIG. 12. Here, the clip 636 can be removed from the groove 643 in the retainer 634, which is threaded into the cartridge body 642.

Figure 13A:
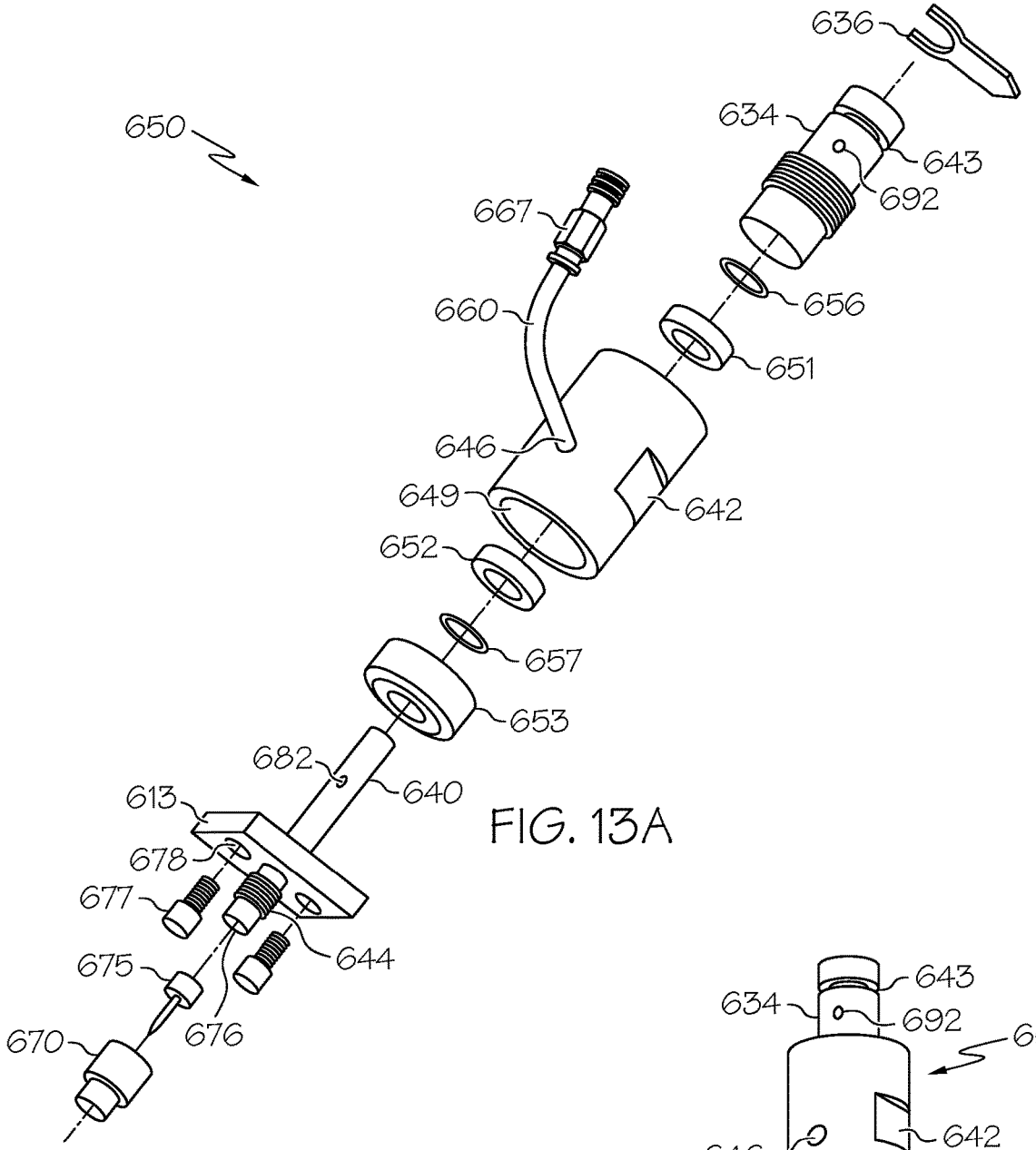
FIG. 13A is an exploded perspective view of the cartridge assembly shown in FIGS. 10-12, in accordance with an embodiment.
Figure 13B:
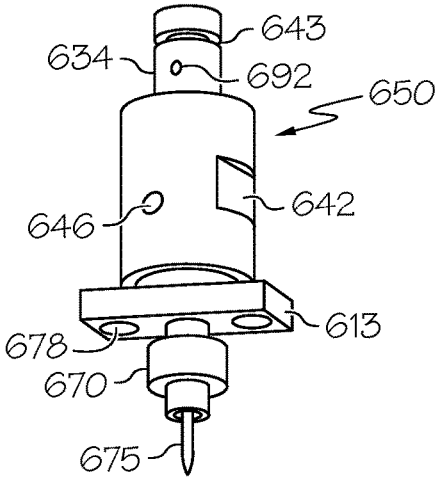
FIG. 13B is an assembled perspective view of the cartridge assembly of FIG. 13A.
Figure 13C:
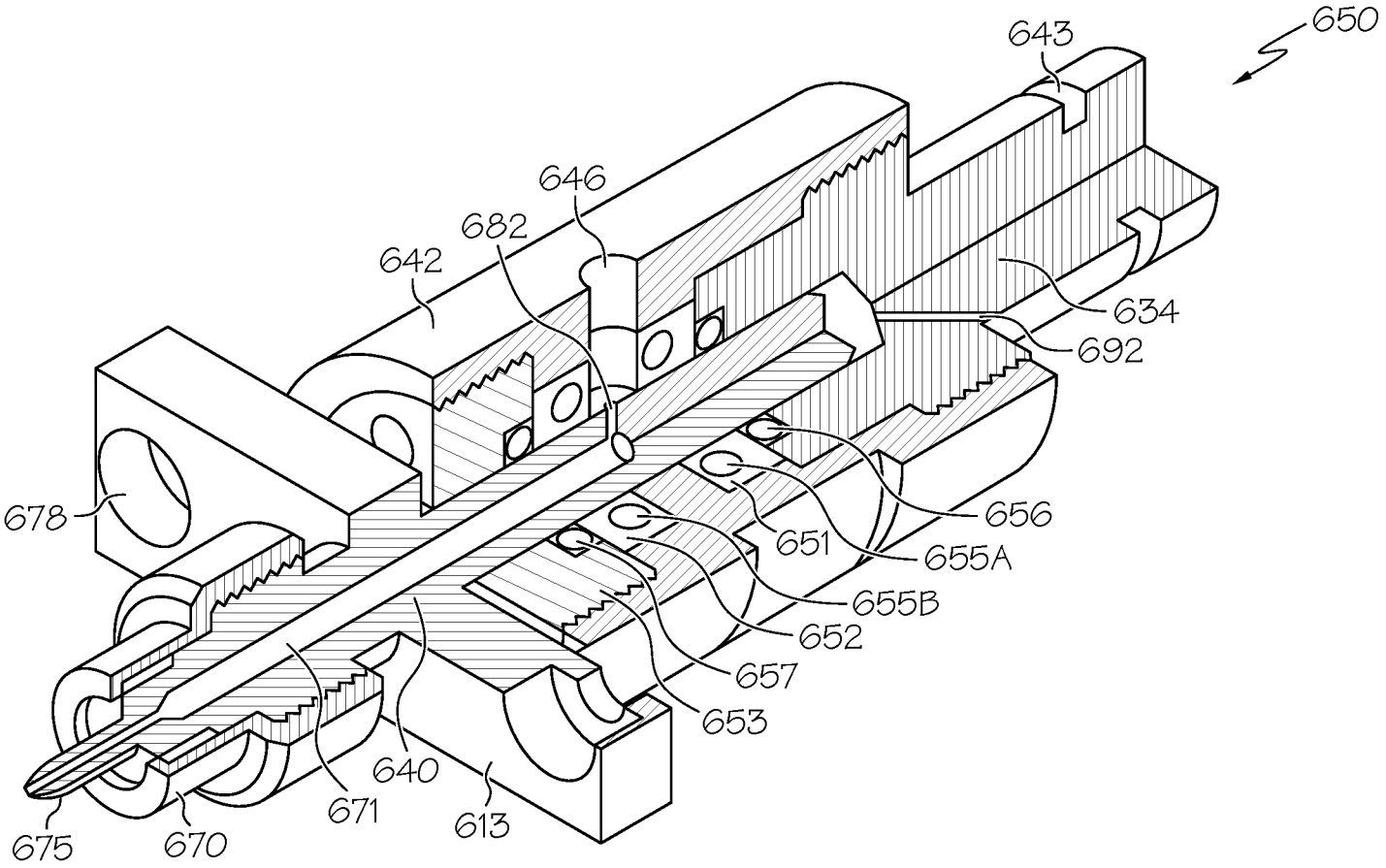
FIG. 13C is a cutaway perspective view of the cartridge assembly of FIGS. 10-13B.
Figure 13D:
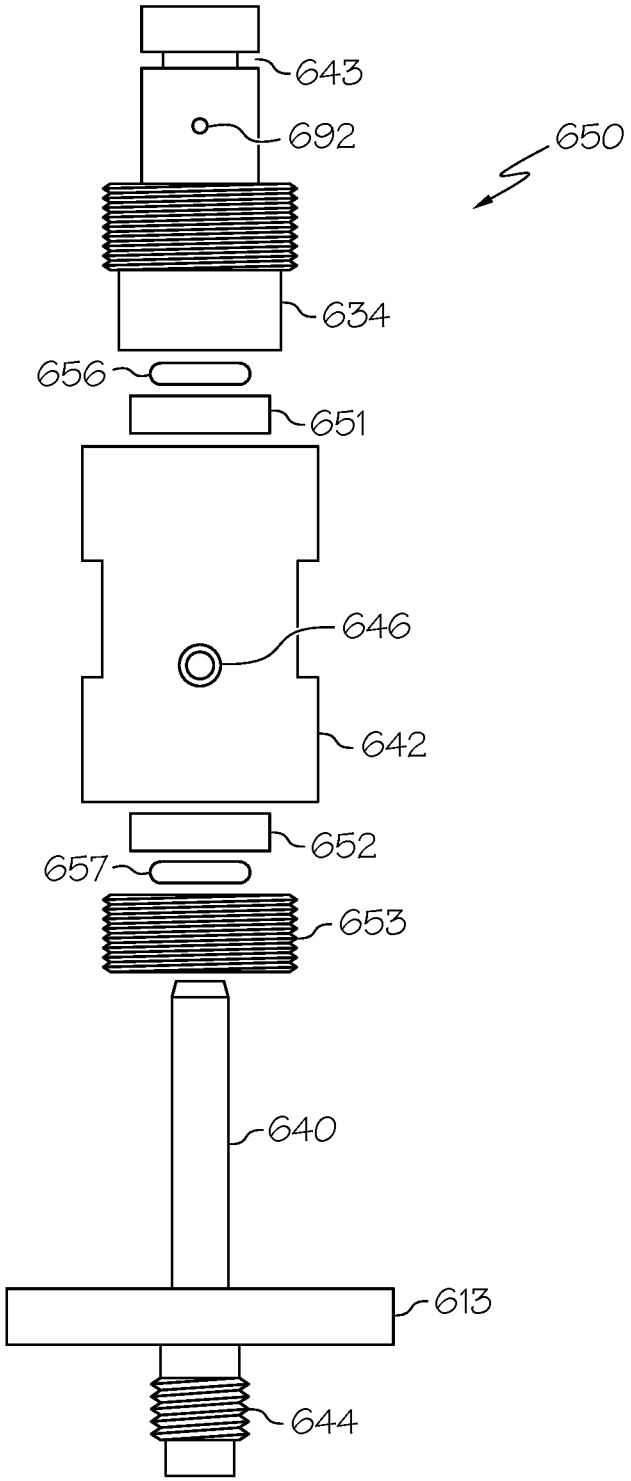
FIG. 13D is an exploded front view of the cartridge assembly of FIGS. 10-13C
Figure 13E:
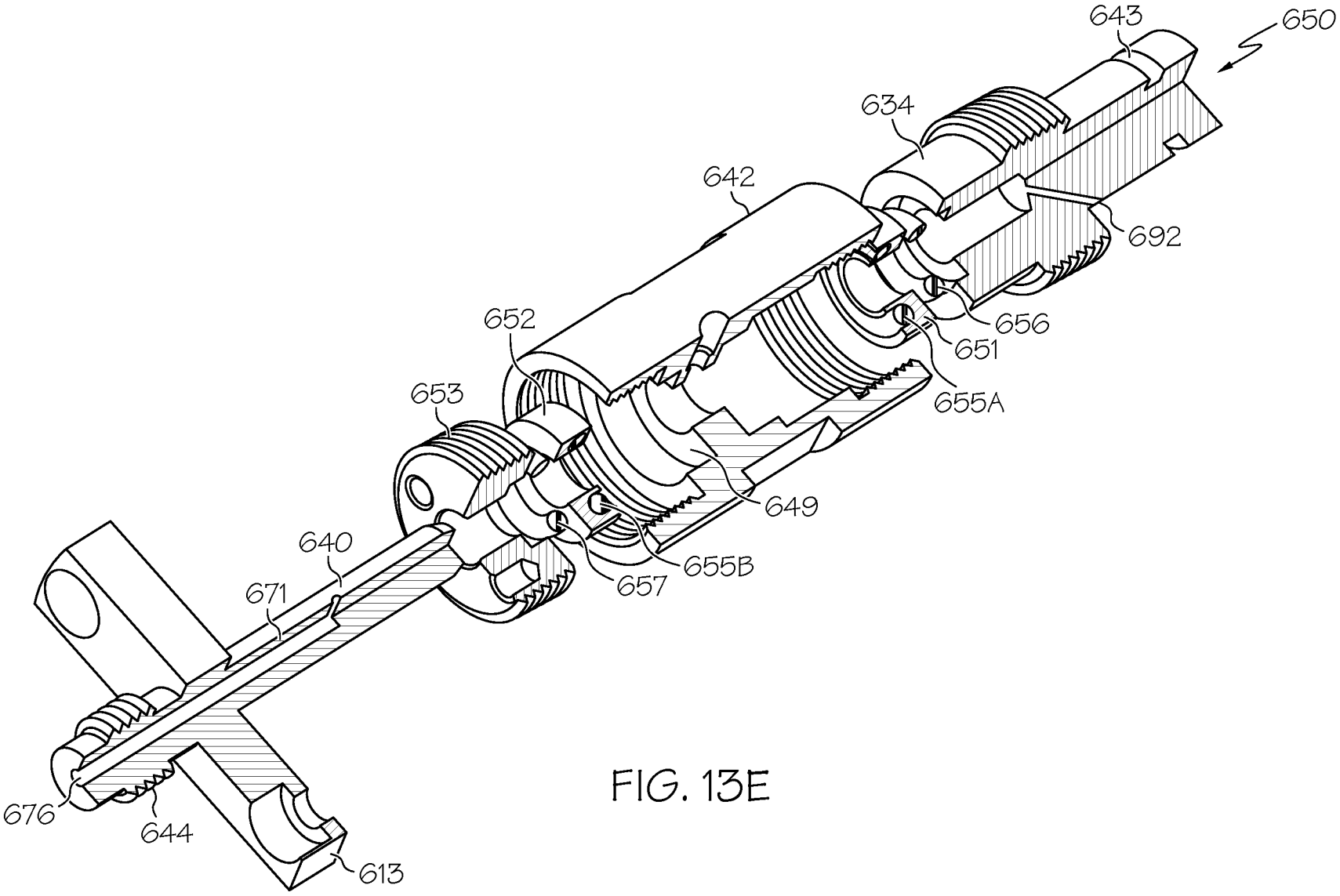
FIG. 13E is another cutaway perspective view of the cartridge assembly of FIGS. 10-13D.

FIGS. 13A and 13B are an exploded perspective view and an assembled perspective view, respectively, of a cartridge assembly 650, in accordance with an embodiment.

As described above, the cartridge assembly 650 includes a cartridge body 642 that moves axially and/or radially relative to a fluid shaft 640. The cartridge body 642 can be constructed of a single stock, or formed multiple sections coupled together, similar to the cartridge body 242 described in FIGS. 2-9. The cartridge body 642 is preferably cylindrical, and includes a hollow chamber 649 for receiving a fluid shaft 640. A cartridge feed aperture 646 extends through a sidewall of the cartridge body 642 to the chamber 649. A feed tube 660 can be inserted in the cartridge feed aperture 646 for providing a source of material to the fluid shaft 640 during a dispensing operation. The feed tube 660 can include a threaded adapter 667 for coupling to a syringe (not shown) or other source of material.

A top region of the hollow chamber 649 of the cartridge body 642 can be threaded for receiving the interconnect retainer 634, for example, shown in FIG. 11. The interconnect retainer 634 can include groove 643, or hole, for receiving a clip 636, a pin, hinge, latch, or a related fastener for securing the top portion of the interconnect retainer 634 to a cylindrical interconnect socket 631 as shown in FIG. 11A.

As described above, the fluid shaft 640 includes a mount 613 that extends laterally from a bottom section of the fluid shaft 640. The mount 613 can be attached to the pump housing 605 by screws 677 or other attachment devices inserted through holes 678, counterbores, and the like extending through the mount 613. The fluid shaft 640 also includes a threaded outlet region 644 for receiving a needle nut 670 to hold a dispense needle 675 in place. Other elements of the fluid shaft 640, for example, a fluid path, an inlet port, and outlet, are similar to those of the fluid shaft 240 described in FIGS. 2-9. Details of these other elements not repeated for reasons of brevity.

A top shaft seal 651 is positioned about the fluid shaft 640 at an upper region of the hollow chamber 649 of the cartridge body 642 above the cartridge feed aperture 646. The top shaft seal 651 is positioned in a seal housing (not shown) of the cartridge body 642 between the interconnect retainer 634 and a surface of the cartridge body 642. A bottom shaft seal 652 is positioned about the fluid shaft 640 at a lower region of the hollow chamber of the cartridge body 642 below the cartridge feed aperture 646. The bottom shaft seal 652 is positioned in a seal housing (not shown) formed from the chamber 649 in the cartridge body 642 between a threaded retainer 653 screwed into the lower region of the cartridge body 642 and a surface of the cartridge body 642. The top and bottom shaft seals 651, 652 can be ring-shaped or other configuration suitable for defining a fluid cavity volume in the chamber 649 and providing a substantially fluid-tight seal with the fluid shaft 640 above the fluid inlet 682 and below the fluid inlet 682, respectively. The inner diameters of the ring-shaped seals 651, 652 are slightly less than the diameter of the fluid shaft 640 to provide a substantially fluid-tight seal with respect to the fluid shaft 640. The shaft seals 651, 652 can be positioned in counterbores 691A, 691B, respectively (see FIG. 11A), formed in the cartridge body 642.

An o-ring 656 can be inserted in a groove, counterbore, and the like in the retainer 634, and can be positioned about the fluid shaft 640 in the chamber 649 between the top shaft seal 651 and a surface of the cartridge body 642, for preventing fluid from escaping the fluid cavity volume. Another o-ring 657 can be inserted in a groove, counterbore, and the like in the retainer 653 and positioned about the fluid shaft 640 in the chamber 649 along the axis A between the bottom shaft seal 652 and a surface of the cartridge body 642 for preventing fluid from escaping the fluid cavity volume.

The interconnect retainer 634 can be threaded into the top of the cartridge body 642 to press the top o-ring 656 into the top shaft seal 651 so that the top o-ring 656 and the top shaft seal 651 collectively form a fluid-tight upper surface of the fluid cavity volume. The retainer 653 can be threaded into the bottom of the cartridge body 642 to press the o-ring 657 into the bottom shaft seal 652 so that the bottom o-ring 657 and the bottom shaft seal 652 collectively form a fluid-tight bottom surface of the fluid cavity volume.

Figure 14A:
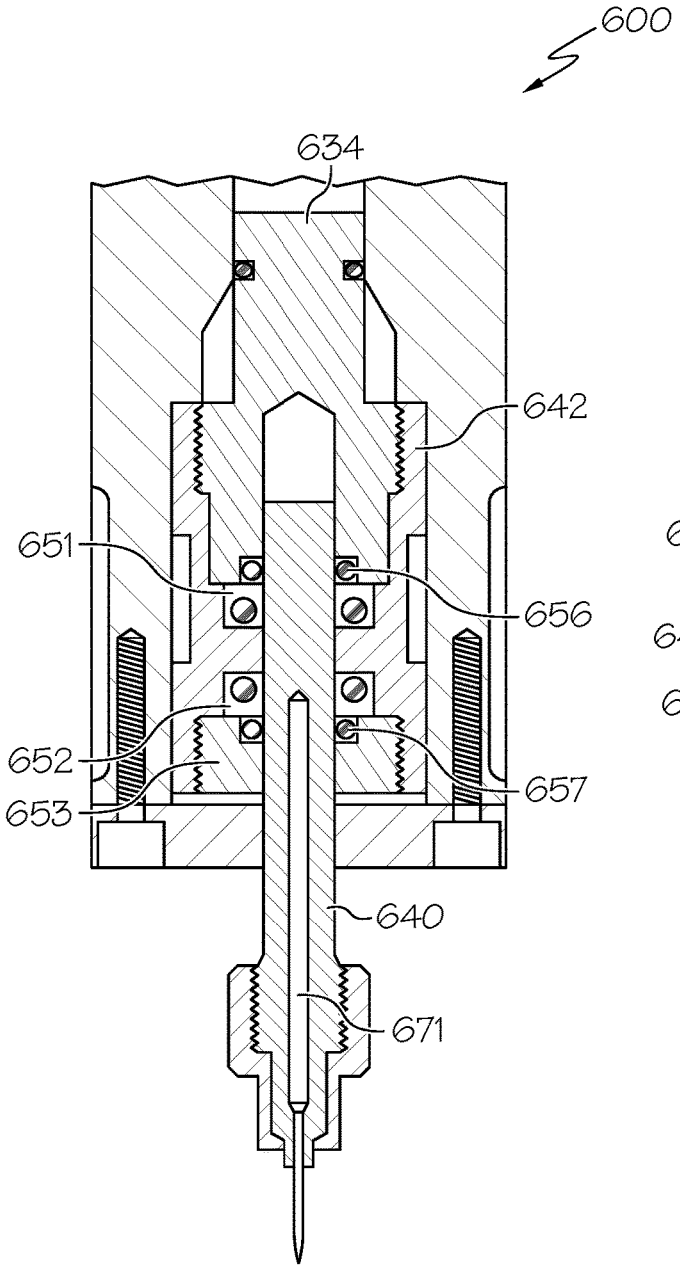
FIG. 14A is a cutaway front view of a fluid dispense pump, wherein a cartridge feed aperture is at a first linear position relative to a fluid shaft inlet port, in accordance with an embodiment.
Figure 14B:
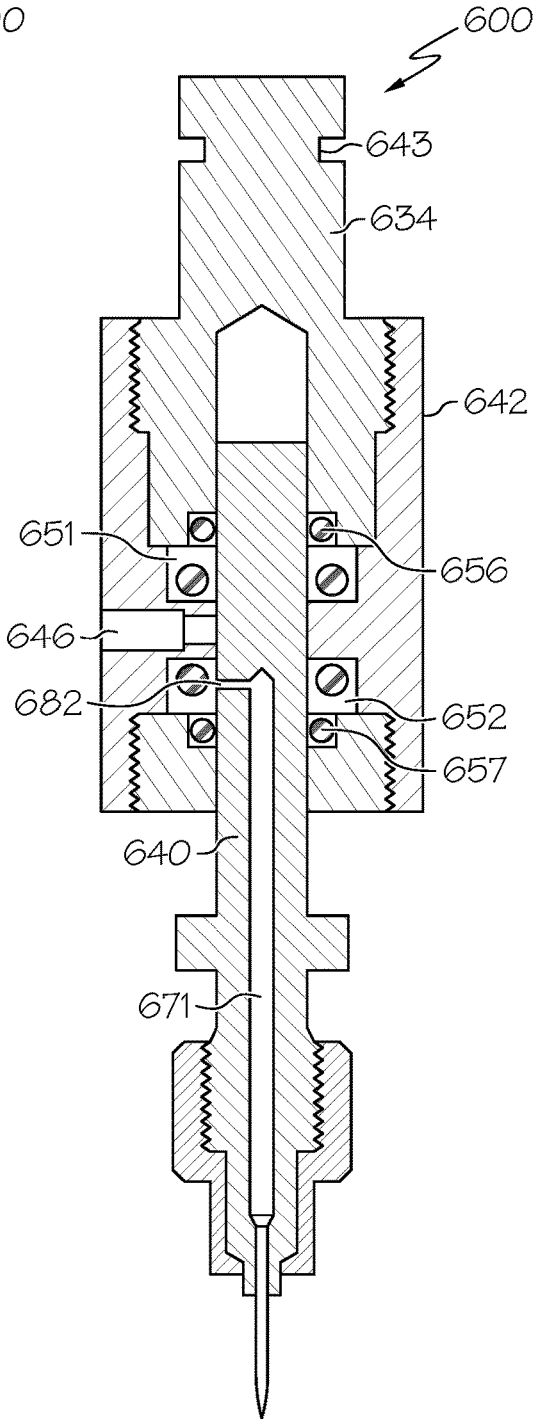
FIG. 14B is a cutaway side view of the fluid dispense pump shown in FIG. 14A.

FIG. 14A is a cutaway front view of a fluid dispense pump 600, wherein a cartridge feed aperture 646 is at a first linear position relative to a fluid shaft inlet port 682, in accordance with an embodiment. FIG. 14B is a cutaway side view of the fluid dispense pump 600 shown in FIG. 14A. The cartridge feed aperture 646 can be at the first linear position, also referred to as an off or closed position, for example, at the beginning of an downstroke of the cartridge body 642, or at the end of a upstroke of the cartridge body 642. Here, in the top position of the cartridge 650, the bottom shaft seal 652 of the cartridge body 642 is positioned over the fluid shaft inlet port 682 to prevent fluid material from being transferred from the cartridge feed aperture 646 to the fluid path 671 extending through the shaft 640.

Figure 15A:
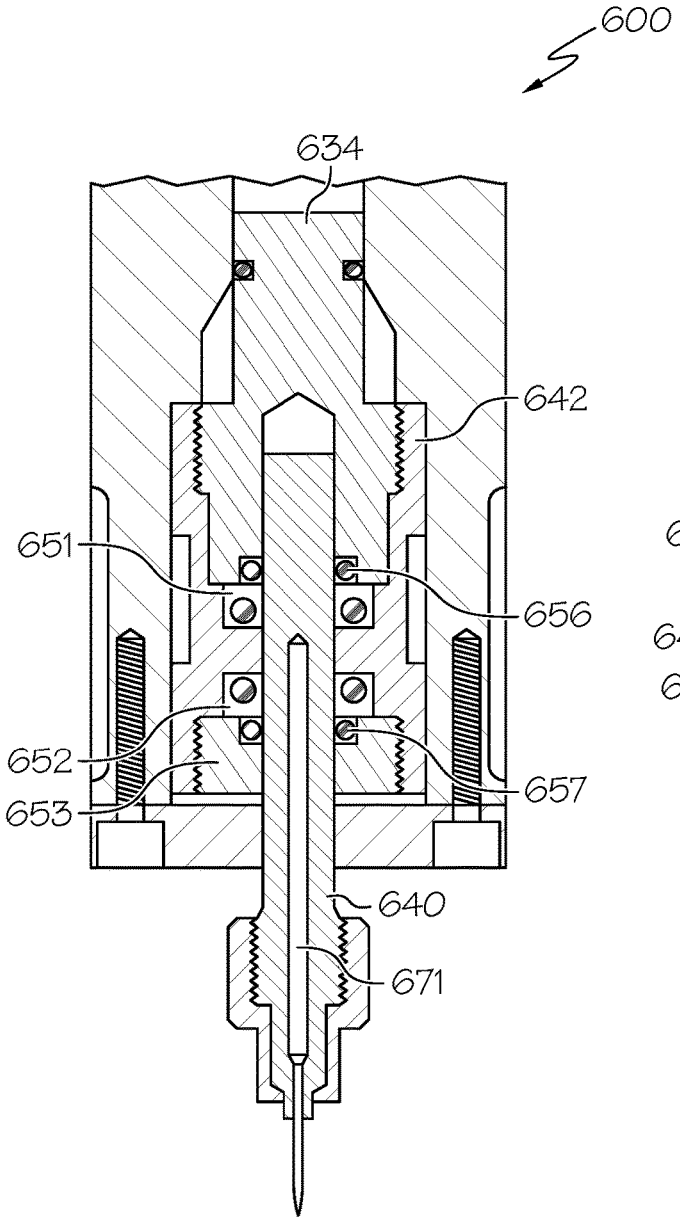
FIG. 15A is a cutaway front view of the fluid dispense pump of FIGS. 14A and 14B, wherein the cartridge feed aperture is at a second linear position relative to the fluid shaft inlet port, in accordance with an embodiment.
Figure 15B:
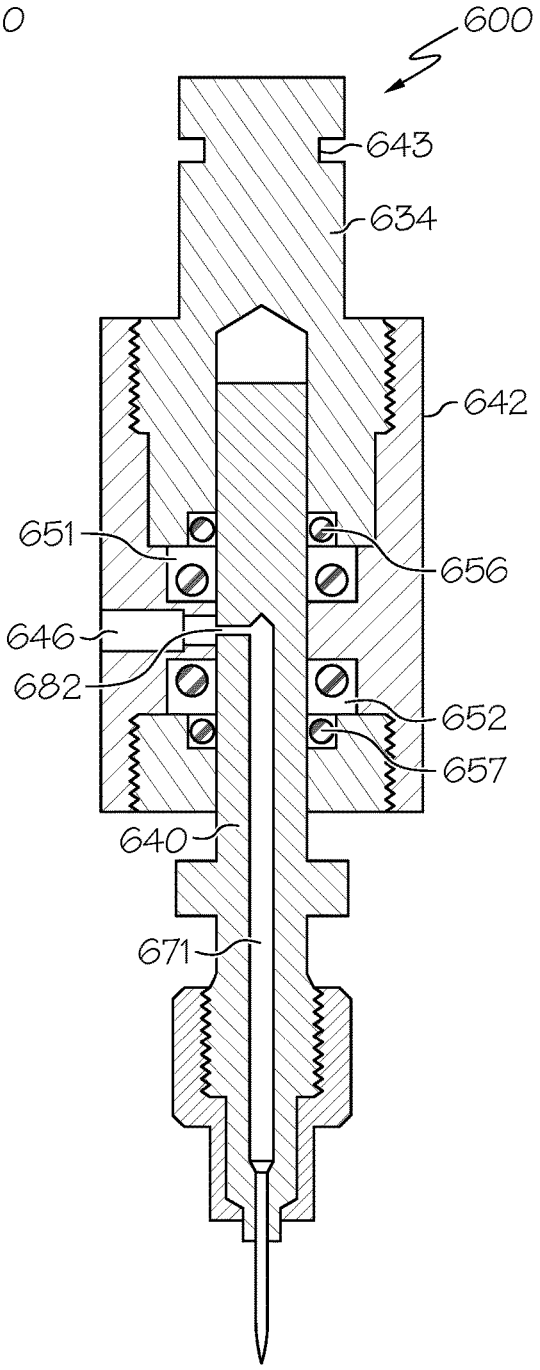
FIG. 15B is a cutaway side view of the fluid dispense pump shown in FIG. 15A.

FIG. 15A is a cutaway front view of the fluid dispense pump 600 of FIGS. 14A and 14B wherein the cartridge feed aperture 646 is at a second linear position relative to the fluid shaft inlet port 682, in accordance with an embodiment. FIG. 15B is a cutaway side view of the fluid dispense pump 600 shown in FIG. 15A. During a dispensing operation, the cartridge body 642 can move linearly from the first linear position to the second linear position, also referred to as on or open position.

When the cartridge body 642 transitions to the second linear position, the fluid shaft inlet port 682 is in the chamber volume between the bottom shaft seal 652 and the top shaft seal 651. The chamber volume is positioned so that the cartridge feed aperture 646 is exposed to at least a portion of the inlet port 682. Here, fluid material can be transferred from the cartridge feed aperture 646 via the inlet port 682 to the fluid path 671 in the shaft 640 at a precise, controlled rate, for example, established by a motion control system described herein.

Accordingly, as illustrated at FIGS. 14A, 14B, 15A, and 15B, the fluid pump system 600 can transition between two states during a dispensing operation. The first state corresponds to the first linear position of the cartridge body 642 relative to the stationary fluid shaft 640 as shown in FIGS. 14A and 14B. The second state corresponds to the second linear position of the cartridge body 642 relative to the stationary fluid shaft 640 as shown in FIGS. 15A and 15B. Fluid pressure can be produced at the cartridge feed aperture 646 when the inlet port 682 is completely or partially blocked by the bottom shaft seal 652. To release pressurized fluid material from the chamber volume 649 to the fluid path 671, the bottom shaft seal 652 that is covering the inlet port 682 is separated from the inlet port 682 by moving the cartridge body 642 to the second linear position. The movement, e.g., position, velocity, acceleration, and deceleration, of the cartridge body 642 can be controlled by the motor 615 in a manner that permits the fluid material to be introduced to the inlet port 682 at a reduced pressure and at a controlled flow rate, reducing the risk of a clogging of material at the inlet port 682, or an unexpected burst of pressurized fluid material to the fluid path 271.

Figure 16A:
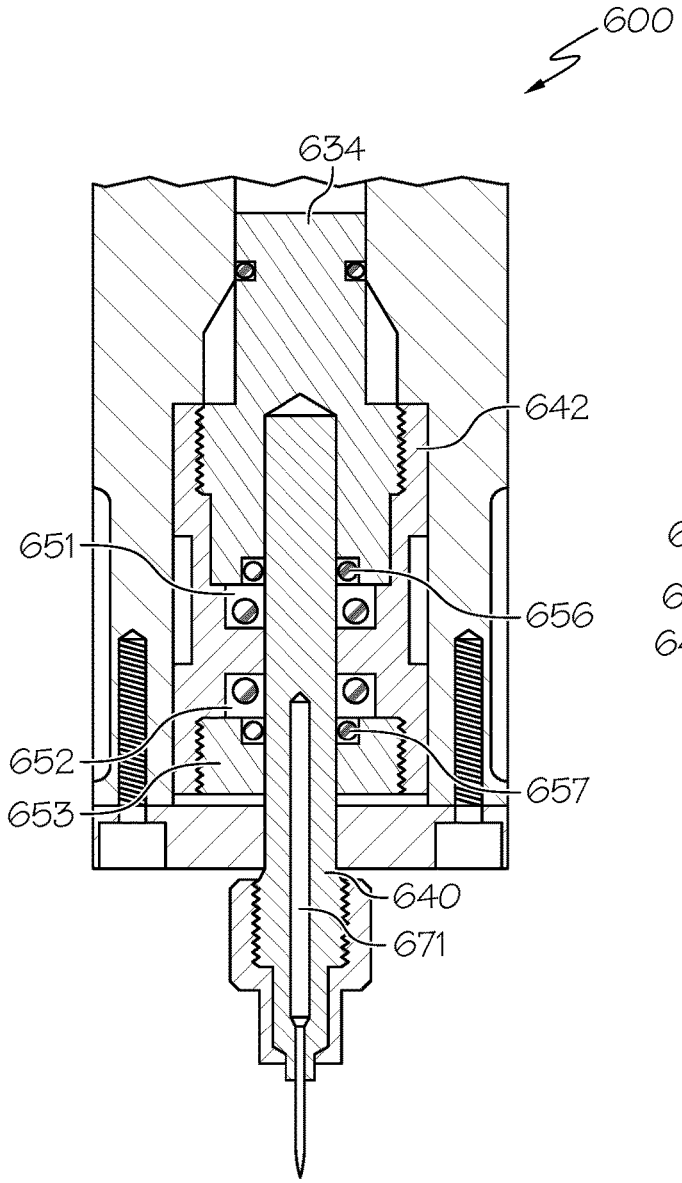
FIG. 16A is a cutaway front view of a fluid dispense pump of FIGS. 14A, 14B, 15A, and 15B, wherein the cartridge feed aperture is at a third linear position relative to the fluid shaft inlet, in accordance with an embodiment.
Figure 16B:
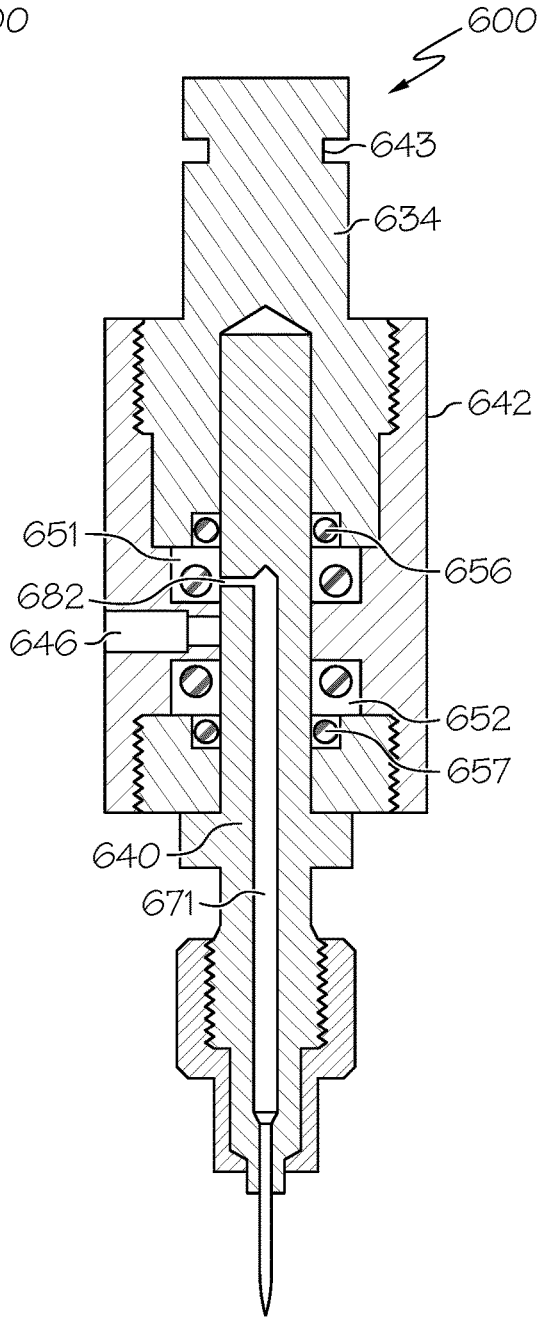
FIG. 16B is a cutaway side view of the fluid dispense pump shown in FIG. 16A.

In another embodiment, the fluid pump system 600 can transition between three states during a dispensing operation: a first state corresponding to the first linear position, or closed position, of the cartridge body 642 as shown in FIGS. 14A and 14B, a second state corresponding to the second linear position, or open position, of the cartridge body 642 as shown in FIGS. 15A and 15B, and a third state corresponding to a third linear position of the cartridge body 642, also referred to as an off or closed position, as shown in FIGS. 16A and 16B. In FIGS. 16A and 16B, the top shaft seal 652 covers the fluid shaft inlet port 682 to prevent fluid material from being transferred from the cartridge feed aperture 646 to the fluid path 671 extending through the shaft 640, similar to the bottom shaft seal 651. The fluid shaft 240 can subsequently transition to the second state, as shown and described with respect to FIGS. 15A and 15B.

In another embodiment, the fluid pump system 600 can transition between two states during a dispensing operation: a first state corresponding to the linear position of the cartridge body 642 as shown in FIGS. 16A and 16B, and a second state corresponding to the linear position of the cartridge body 642 as shown in FIGS. 15A and 15B, for example, during a downstroke of the cartridge body 642.

Figure 17A:
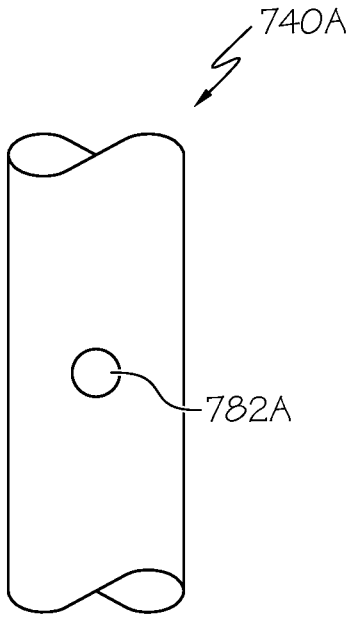
FIG. 17A is a view of a fluid shaft having a circular inlet port, in accordance with an embodiment.
Figure 17B:
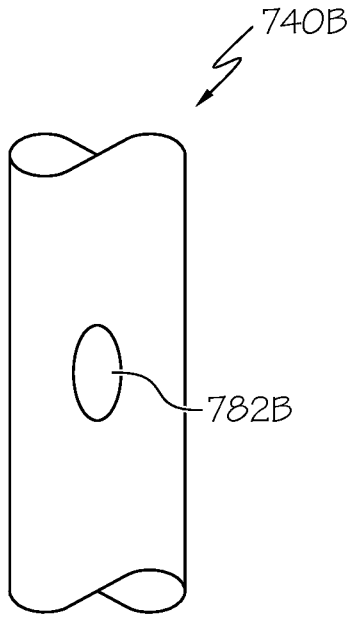
FIG. 17B is a view of a fluid shaft having an oval inlet port extending along a longitudinal direction of the fluid shaft, in accordance with an embodiment.
Figure 17C:
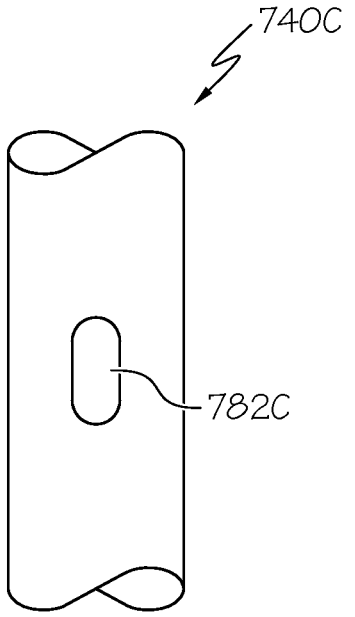
FIG. 17C is a view of a fluid shaft having an elliptical inlet port having a major axis extending along a longitudinal direction of the fluid shaft, in accordance with an embodiment.
Figure 17D:
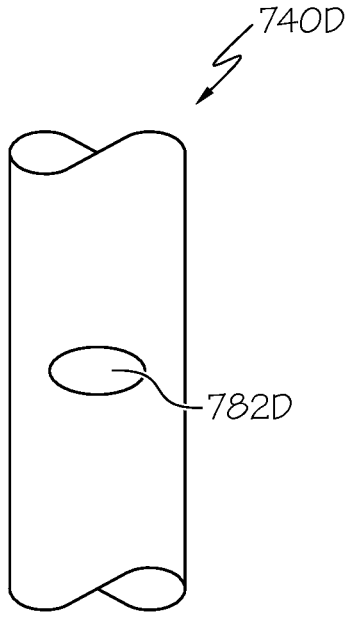
FIG. 17D is a view of a fluid shaft having an elliptical inlet port having a minor axis extending in a direction perpendicular to a major axis along which the fluid shaft extends, in accordance with an embodiment.

FIG. 17A is a view of a fluid shaft 740A having a circular inlet port 782A, in accordance with an embodiment. FIG. 17B is a view of a fluid shaft 740B having an oval inlet port 782B extending along a longitudinal direction of the fluid shaft 740B, in accordance with an embodiment. FIG. 17C is a view of a fluid shaft 740C having an elliptical inlet port 782C having a major axis extending along a longitudinal direction of the fluid shaft 740C, in accordance with an embodiment. FIG. 17D is a view of a fluid shaft 740D having an elliptical inlet port 782D having a minor axis extending in a direction perpendicular to a longitudinal direction of the fluid shaft 740D and a major axis that is transverse to the longitudinal direction of the fluid shaft 740D, in accordance with an embodiment. The fluid shafts 740A-740D can be configured in one or more of the fluid dispense pump systems in accordance with the embodiments herein.

Figure 18A:
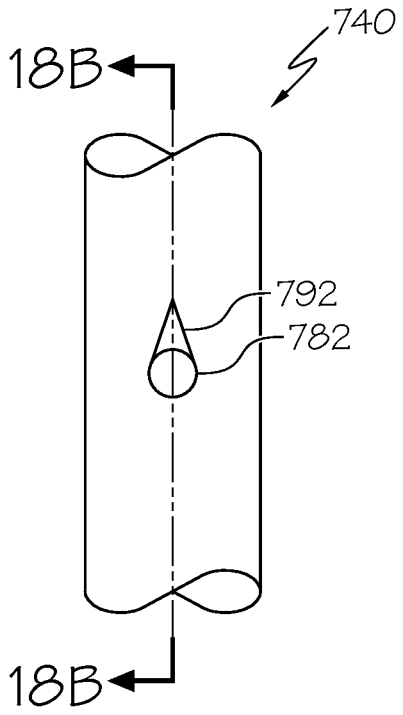
FIG. 18A is a view of a fluid shaft having a tapered inlet port, in accordance with an embodiment.
Figure 18B:
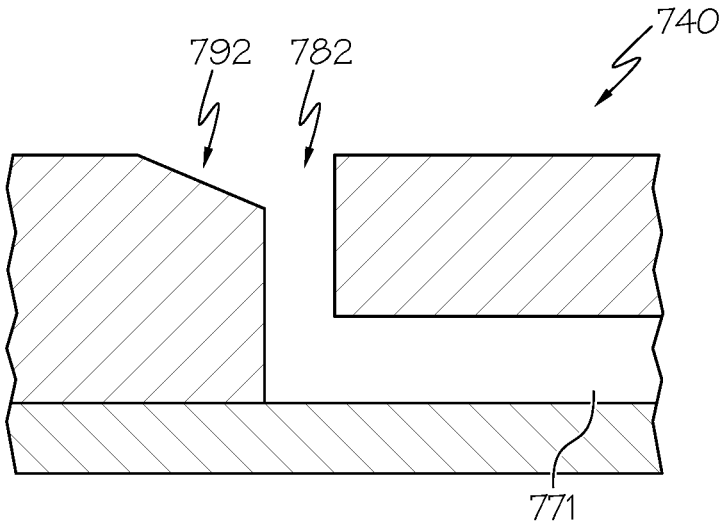
FIG. 18B is a cross-sectional view of the fluid shaft of FIG. 18A.

FIG. 18A is a view of a fluid shaft 740 having a tapered inlet port 782, in accordance with an embodiment. FIG. 18B is a cross-sectional view of the fluid shaft 740 of FIG. 18A, taken along line 18B-18B. Any of the fluid shafts 740A-740D shown in FIGS. 17A-17D, respectively, can be configured with the taper funnel 792.

As described in the abovementioned embodiments, a fluid shaft inlet port 782 can be positioned in a chamber cavity of a cartridge body during a dispensing operation so that a fluid material can be transferred from a cartridge feed aperture to a fluid path in the fluid shaft via the inlet port. However, fluid pressure can be produced at the cartridge feed aperture and/or the chamber volume when the fluid pump is in a closed state of a dispensing operation, i.e., the inlet port is blocked by a fluid shaft seal. The tapered inlet port 782 described in FIGS. 18A and 18B can provide additional control over the transfer of fluid material to the inlet port 782 since the taper funnel 792 can gradually introduce fluid material to the fluid path in the fluid shaft 740, thereby minimizing the risk of an unpredictable release of fluid material output to the fluid path 771.

Figure 19A:
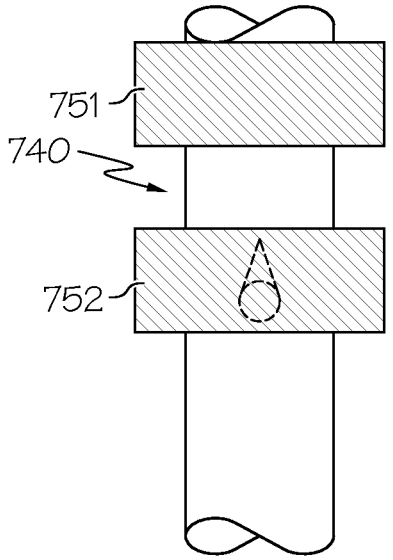
FIGS. 19A, 19C, and 19E are front views of the fluid shaft in FIGS. 18A and 18B in various stages of a dispensing operation, in accordance with an embodiment.
Figure 19B:
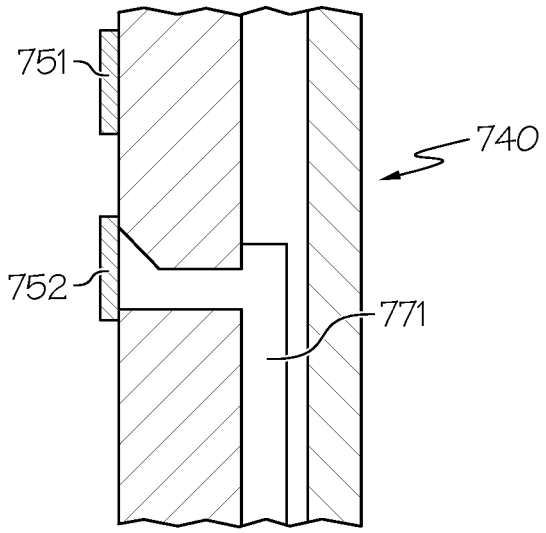
FIGS. 19B, 19D, and 19F are cross-sectional side views of the fluid shaft of FIGS. 19A, 19C, 19E, respectively.
Figure 19C:
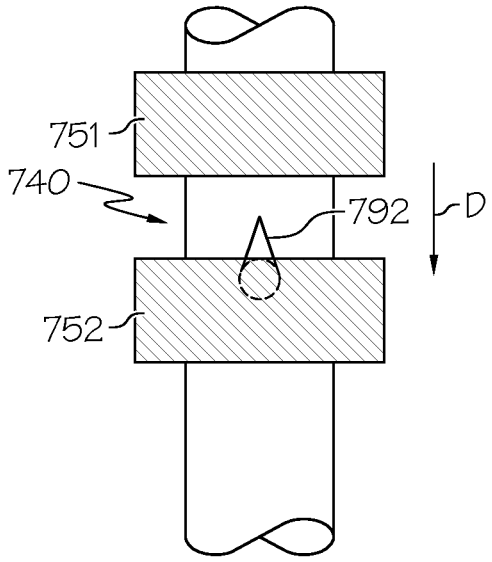
Figure 19D:
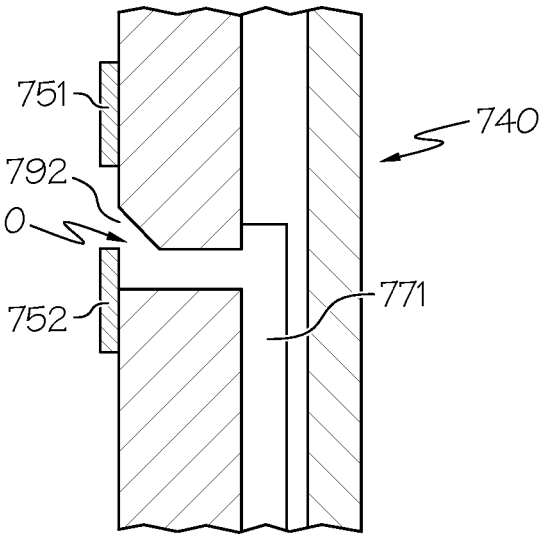
Figure 19E:
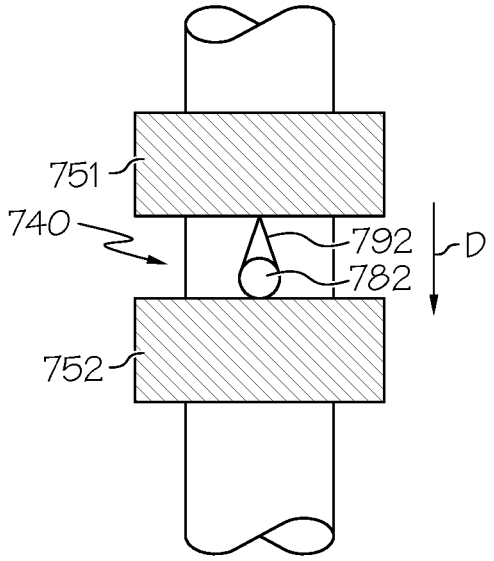
Figure 19F:
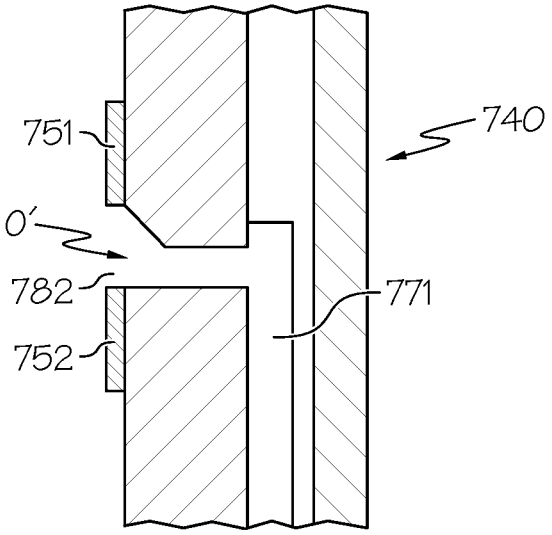

FIGS. 19A, 19C, and 19E are front views of a fluid shaft 740 in various stages of a dispensing operation, in accordance with an embodiment. FIGS. 19B, 19D, and 19F are cross-sectional side views of the fluid shaft 740 of FIGS. 19A, 19C, 189, respectively. A top shaft seal 751 and a bottom shaft seal 752 similar to those described herein are positioned about at least a portion of the fluid shaft 740. For example, the shaft seals 751, 752 can be ring-shaped, or shaped to fit over the fluid shaft inlet port 782.

At FIGS. 19A and 19B, the bottom shaft seal 752 is positioned over the fluid shaft inlet port 782 to prevent fluid material from being transferred to the fluid path 771 extending through the shaft 740.

At FIGS. 19C and 19D, a small opening O at the inlet port 782 is exposed to a cartridge feed aperture (not shown) by moving the bottom shaft seal 752 linearly in a downstroke direction D along the fluid shaft 740, for example, described in other embodiments herein. Alternatively, the fluid shaft 740 can move linearly in an upward position relative to the bottom shaft seal 752, which can be stationary, for example, as described in other embodiments herein. The taper funnel 792 can deliver fluid material to the opening O to the fluid path 771. The movement of the cartridge, and therefore the bottom shaft seal 752, can be controlled by a motor, for example, described herein, with high precision, thereby controlling the rate, size, and the like of the opening O.

At FIGS. 19E and 19F, an opening O' that is larger than the opening O is exposed to the cartridge feed aperture (not shown) by continuing to move the bottom shaft seal 752 in a downstroke direction D along the fluid shaft 740 so that the bottom shaft seal 752 is mostly or entirely removed from the entrance of the inlet port 782 and the taper funnel 792.

Figure 19G:
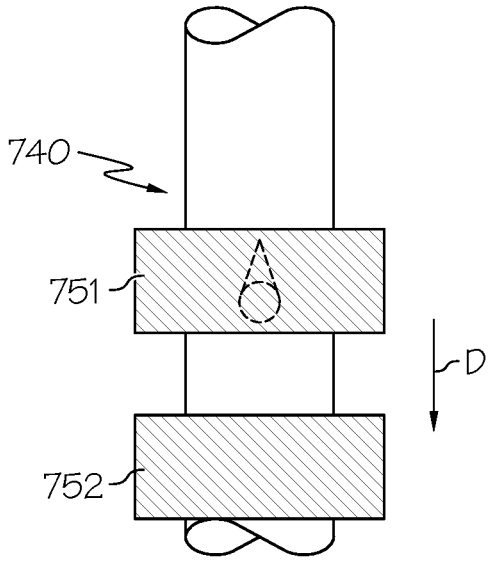
FIG. 19G is a front view of the fluid shaft in FIGS. 19A-19F having an inlet port covered by a top shaft seal, in accordance with an embodiment.
Figure 19H:
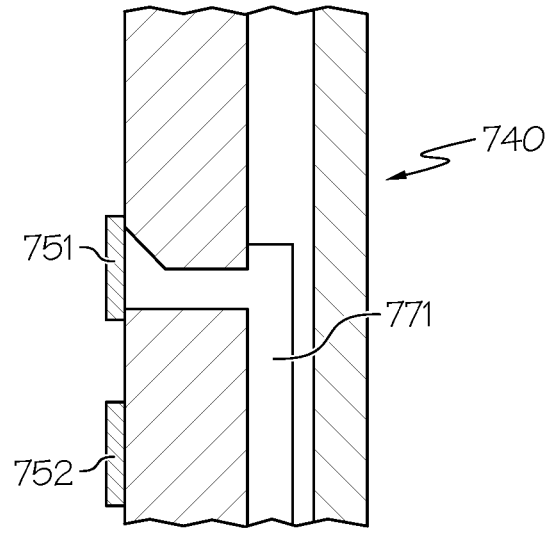
FIG. 19H is a cross-sectional side view of the fluid shaft of FIG. 19G.

In an embodiment, a fluid dispensing operation includes a range of linear positions of the bottom shaft seal 752, where the bottom shaft seal 752 is at a topmost position at FIGS. 19A and 19B, and is at a bottommost position at FIGS. 19G and 19H. In another embodiment, the bottom shaft seal 752 is at an intermediate position along the fluid shaft 740 at FIGS. 19E and 19F, and can continue to move in a downstroke direction D along the fluid shaft 740 until the inlet port 782 is at least partially covered by the top shaft seal 751, as shown in FIGS. 19G and 19H.

Figure 20A:
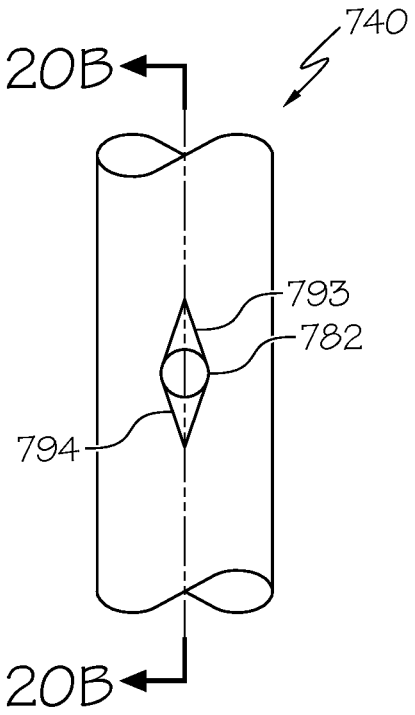
FIG. 20A is a view of a fluid shaft comprising two tapers extending from an inlet port, in accordance with another embodiment.
Figure 20B:
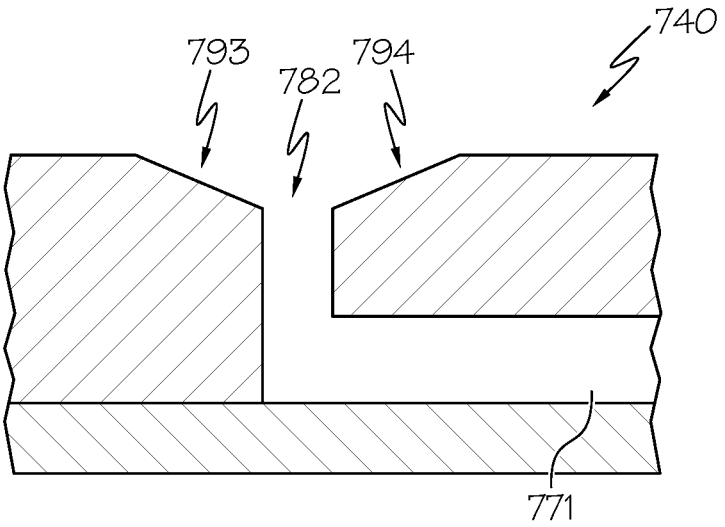
FIG. 20B is a cross-sectional view of the fluid shaft of FIG. 20A.

FIG. 20A is a view of a fluid shaft 740 comprising two tapers 793, 794 extending from an inlet port 782, in accordance with another embodiment. FIG. 20B is a cross-sectional view of the fluid shaft 740 of FIG. 20A, taken along line 20B-20B. The first taper 793 extends from a top region of the inlet port 782, similar to the taper funnel 792 described in FIGS. 18 and 19. The second taper 794 extends from a bottom region of the inlet port 782. The inlet port 782 having two tapers 793, 794 configured in this manner can provide a gradual introduction of fluid material to the fluid path 771 regardless of whether fluid material is introduced to the inlet port 782 during an upstroke or a downstroke of the cartridge body 742 relative to the shaft 740.

FIGS. 21A, 21C, 21E, 21G, and 21I are front views of the fluid shaft 740 in FIGS. 20A and 20B in various stages of a dispensing operation, in accordance with an embodiment. FIGS. 21B, 21D, 21F, 21H, and 21J are cross-sectional side views of the fluid shaft 740 of FIGS. 21A, 21C, 21E, 21G, and 21I, respectively. A top shaft seal 751 and a bottom shaft seal 752 similar to those described herein are positioned about at least a portion of the fluid shaft 740.

Figure 21A:
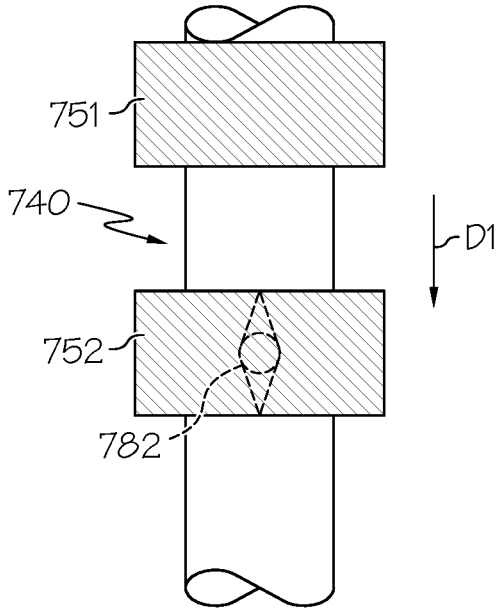
FIGS. 21A, 21C, 21E, 21G, 21I, and 21K are front views of the fluid shaft in FIGS. 20A and 20B in various stages of a dispensing operation, in accordance with an embodiment.
Figure 21B:
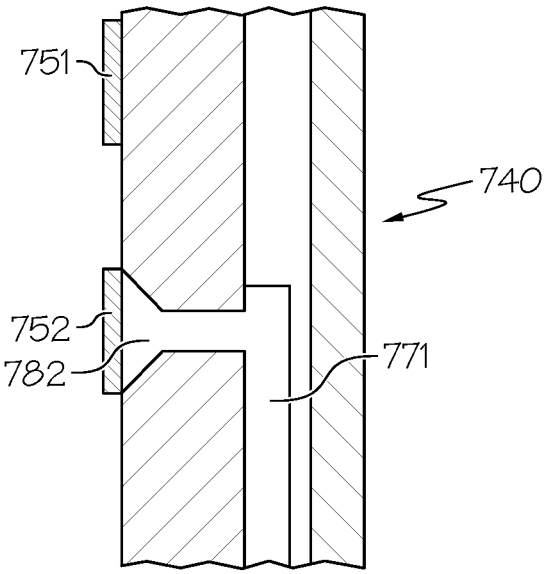
FIGS. 21B, 21D, 21F, 21H, 21J, and 21L are cross-sectional side views of the fluid shaft of FIGS. 21A, 21C, 21E, 21G, and 21I, respectively.

At FIGS. 21A and 21B, the bottom shaft seal 752 is attached to a movable cartridge body (not shown), and is positioned over the fluid shaft inlet port 782 to prevent fluid material from being transferred to the fluid path 771 extending through the shaft 740.

Figure 21C:
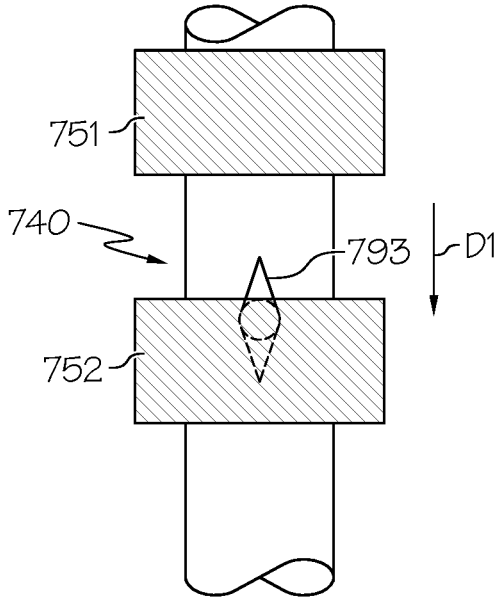
Figure 21D:
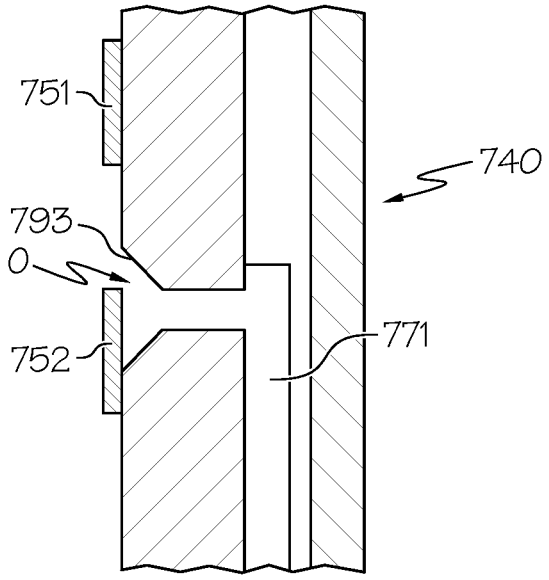

At FIGS. 21C and 21D, a small opening O is exposed to a cartridge feed aperture (not shown) by moving the bottom shaft seal 752 linearly in a downstroke direction D1 along the fluid shaft 740, for example, described with reference to FIGS. 10-16. Alternatively, the fluid shaft 740 can move linearly in an upward position relative to the bottom shaft seal 752, which can be stationary, for example, as described with reference to FIGS. 2-9. The first taper 793 can deliver fluid material to the opening O to the fluid path 771. The movement of the bottom shaft seal 752 and/or the fluid shaft 740 can be controlled by a motor, for example, described herein, with high precision, thereby controlling the rate, size, and the like of the opening O.

Figure 21E:
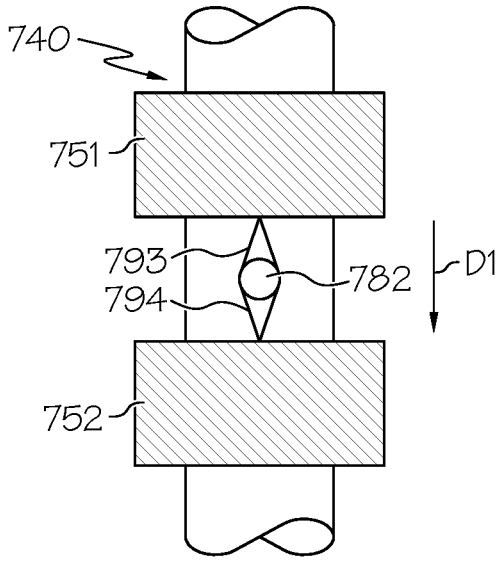
Figure 21F:
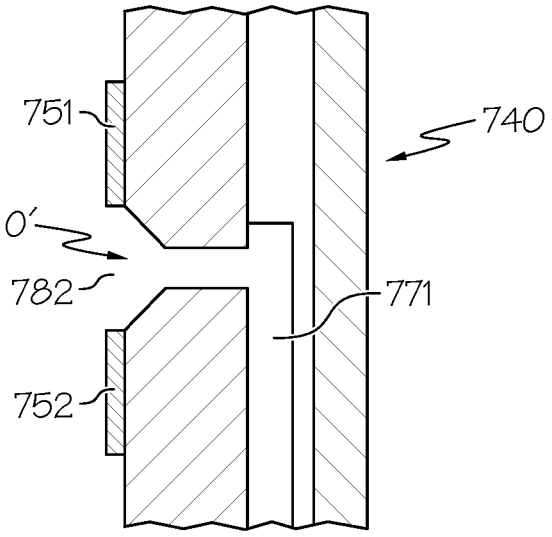

At FIGS. 21E and 21F, a larger opening O' is exposed to the cartridge feed aperture by continuing to move the bottom shaft seal 752 in the downstroke direction D1 along the fluid shaft 740 until the inlet port 782 is mostly or entirely exposed to the cartridge feed aperture 4.

Figure 21G:
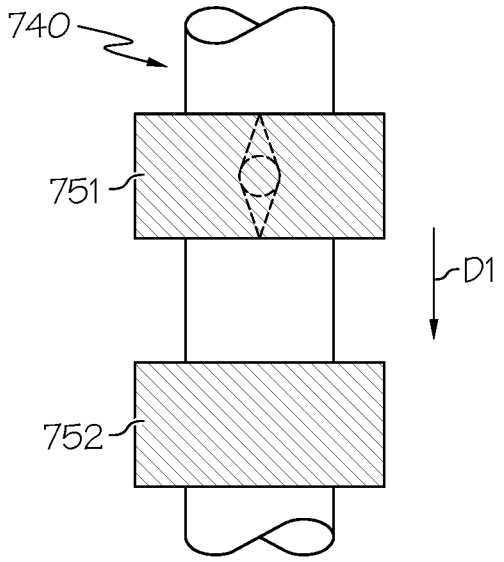
Figure 21H:
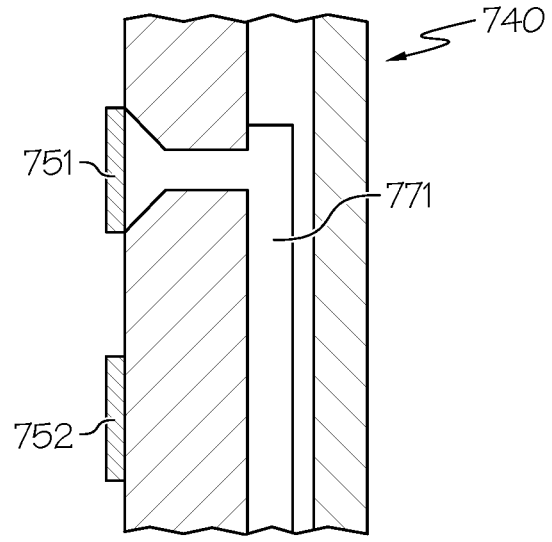
Figure 21I:
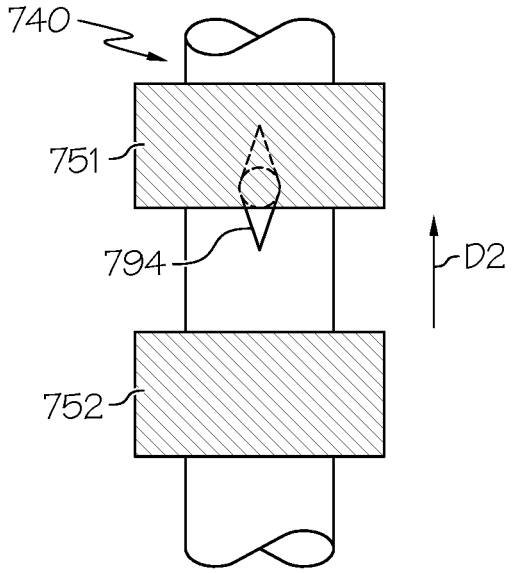

At FIGS. 21G and 21H, the top shaft seal 751 is positioned over the fluid shaft inlet port 782 and the first and second tapers 793, 794 to prevent fluid material from being transferred to the fluid path 771 extending through the shaft 740. Here, the cartridge body (not shown) to which the top and bottom shaft seals 751, 752 are attached is at a bottommost position in a downstroke of a dispensing operation.

Figure 21J:
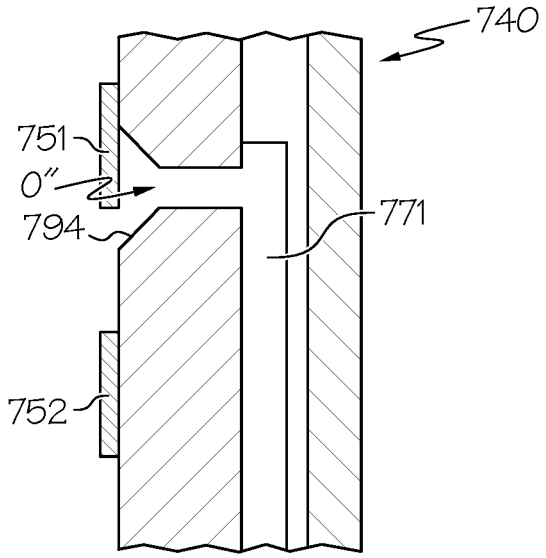

At FIGS. 211 and 21J, the direction of travel changes from a downstroke direction D1 to an upstroke direction D2. Here, a small opening O" is exposed to the cartridge feed aperture (not shown) by the top and bottom shaft seals 751, 752 moving linearly in the upstroke direction D2 along the fluid shaft 740, for example, described with reference to FIGS. 10-16. Alternatively, the fluid shaft 740 can move linearly in an upward position relative to the bottom shaft seal 752, which can be stationary, for example, as described with reference to FIGS. 2-9. The first taper 793 can deliver fluid material to the opening O to the fluid path 771. The movement of the bottom shaft seal 752 and/or the fluid shaft 740 can be controlled by a motor, for example, described herein, with high precision, thereby controlling the rate, size, and the like of the opening O.

Figure 21K:
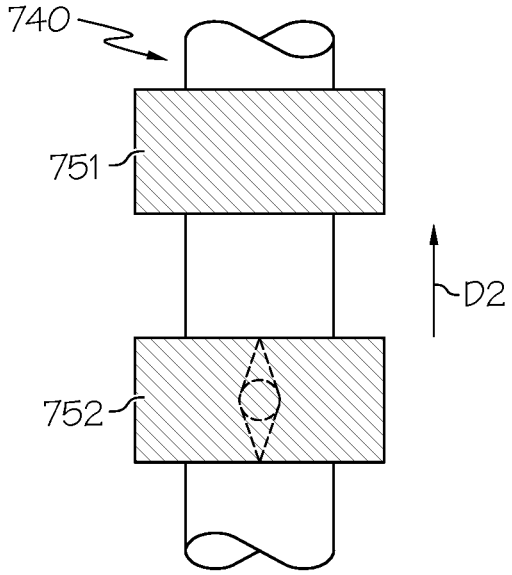
Figure 21L:
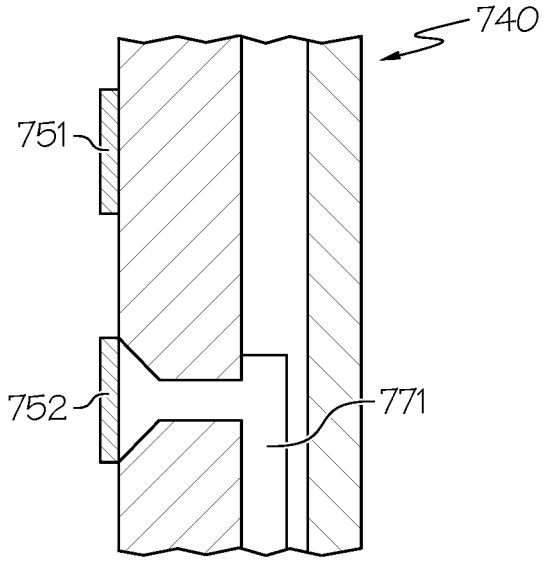

At FIGS. 21K and 21L, the bottom shaft seal 752 is positioned over most or all of the fluid shaft inlet port 782 and the first and second tapers 793, 794 to prevent fluid material from being transferred to the fluid path 771 extending through the shaft 740. Here, the cartridge body (not shown) to which the top and bottom shaft seals 751, 752 are attached is at a topmost position of the dispensing operation.

Accordingly, a fluid dispensing operation includes a range of linear positions of the top shaft seal 751 and the bottom shaft seal 752, where the top and bottom shaft seals 751, 752 are at a topmost position at FIGS. 21A, 21B, 21K, and 21L, and are at a bottommost position at FIGS. 21G and 21H.

Figure 22:
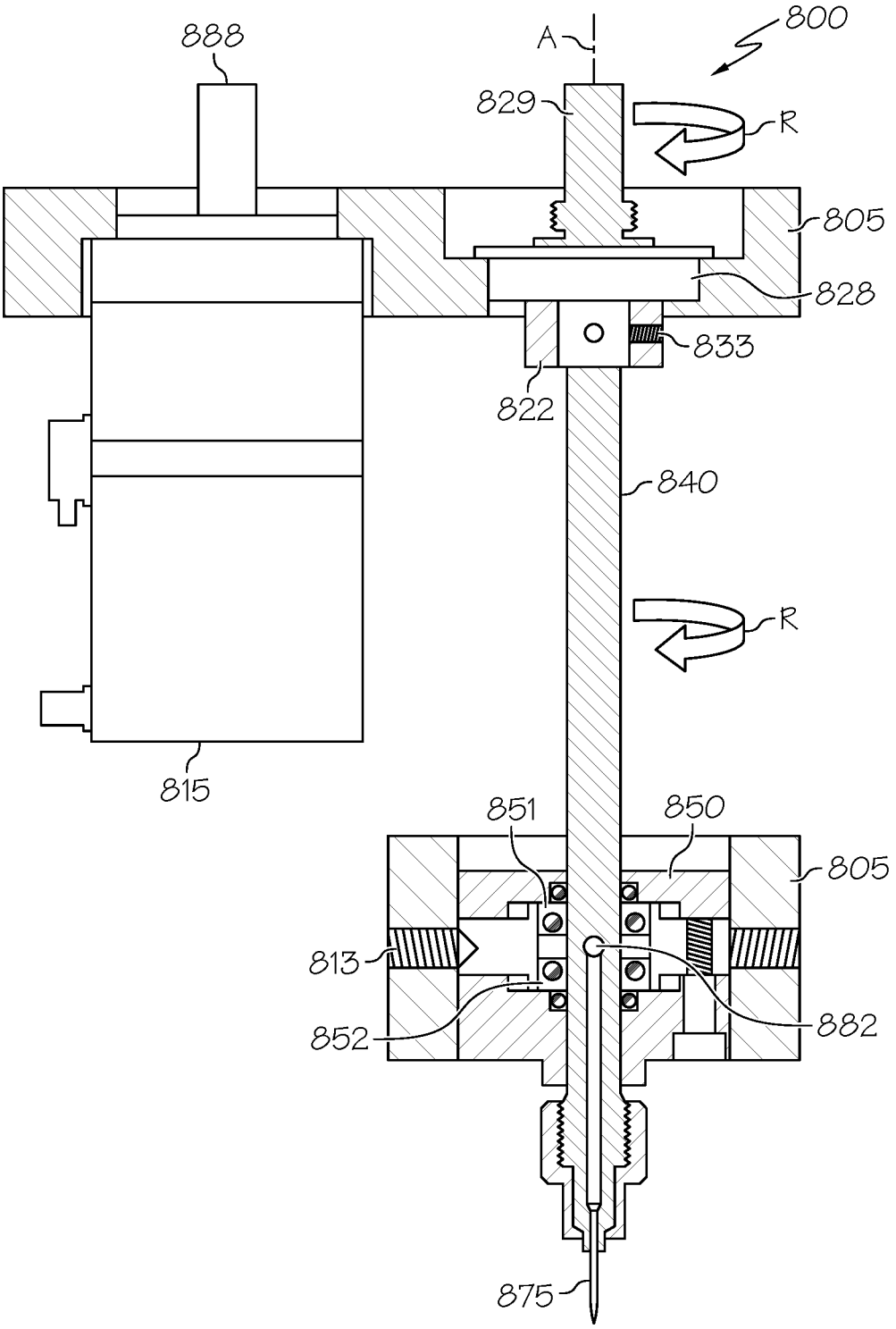
FIG. 22 is a cutaway front view of a fluid dispense pump having a fluid shaft that receives fluid material by rotating about an axis, in accordance with other embodiments of the present inventive concepts.

FIG. 22 is a cutaway front view of a fluid dispense pump 800 having a fluid shaft 840 that receives fluid material by rotating about an axis A, in accordance with other embodiments of the present inventive concepts.

The fluid dispense pump system 800 includes a pump housing 805, a motor 815, a bearing assembly 828, a rotatable fluid shaft 840, and a cartridge unit 850. The fluid dispense pump system 800 can be similar to the fluid dispense pump systems 200 and 600 described herein, except for the rotational movement of the fluid shaft 840, where the fluid shaft 840 is coupled to the bearing assembly 828, for example, by a nut 822 and a screw 833 extending through the nut 822. Another difference is that the pump system 800 does not include a ball slide assembly for providing a linear movement of the fluid shaft 840 or the cartridge unit 850. Instead, the bearing assembly 828 rotates the shaft 840 in a rotational direction R at least partially about an axis A during a dispensing operation. Other structural and functional differences between the fluid dispense pump system 800 and the pump systems 200 and 600 are described below.

During a dispensing operation, the motor 815 applies a rotational force to a motor drive axle 888, which drives a first gear (not shown). The first gear is meshed together with a second gear (not shown) coupled to a shaft 829 so that the first gear drives the second gear in a rotational direction R about the axis A. The first gear and the second gear can include couplings 283, 284, respectively, and are therefore not repeated for reasons of brevity. The motor 815 can be the same as or similar to the motors 215 and 615 described herein. A detailed description of the motor 815 is therefore not repeated for reasons of brevity. The bearing assembly 828 is positioned in an opening of the pump housing 805. The shaft 829 is coupled to one side of the bearing assembly 828. The fluid shaft 840 is coupled the other side of the bearing assembly by the nut 822. The fluid shaft 840 therefore rotates about the axis A in the same rotational direction R as the shaft 829 and second gear.

The fluid shaft 840 includes an inlet port 882 that is positioned in a cartridge assembly 850, which is held in place against the pump housing 805 in a similar manner as that described herein, for example, using a thumb screw 813.

A top shaft seal 851 is positioned about the fluid shaft 840 at an upper region of the cartridge assembly 850 above the inlet port 882. A bottom shaft seal 852 is positioned about the fluid shaft 840 at a lower region of the cartridge assembly 850 below the inlet port 882. The top and bottom shaft seals 851, 852 provide a substantially fluid-tight seal with the fluid shaft 840 above the fluid inlet 882 and below the fluid inlet port 882, respectively. Other o-rings similar to o-rings 256, 257 of FIGS. 2-9 or o-rings 656, 657 of FIGS. 10-18 can also arranged about the fluid shaft 840 for preventing fluid from escaping beyond the fluid cavity volume in the cartridge assembly 850.

In a dispensing operation, the motor 815 can move the location of the fluid shaft inlet port 882 in the cartridge assembly 850 with high precision. In particular the motor 815 can control the quality and rate of flow of fluid material during the dispensing operation. For example, the motor 815 can move a rotational position of the fluid shaft 840 about the axis A so that some or all of the inlet port 882 is positioned in the cartridge chamber, and exposed to the cartridge feed aperture 846 so that a controlled flow of fluid material can be introduced to the fluid path 871 in the fluid shaft 840.

Figure 23A:
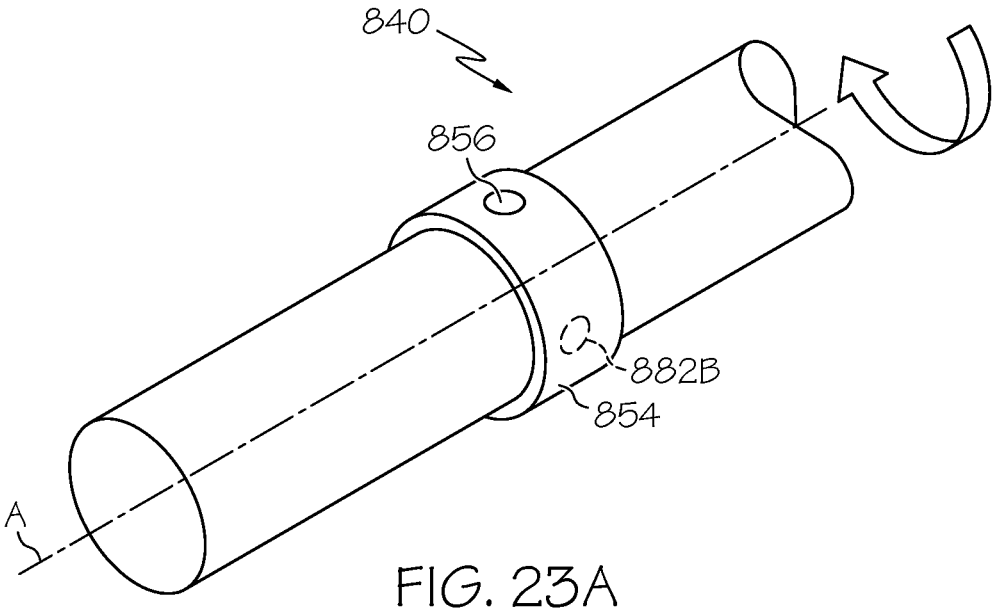
FIG. 23A is a close-up perspective view of the seal and fluid shaft of FIG. 22, wherein a fluid inlet of the shaft is aligned with a seal opening.
Figure 23B:
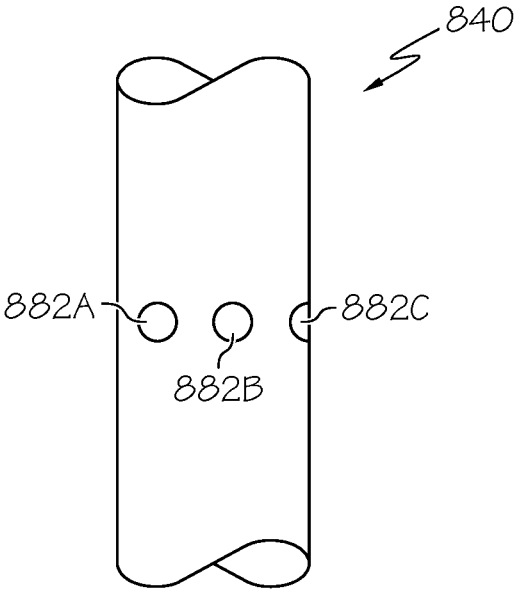
FIG. 23B is a front view of the fluid shaft of FIGS. 22 and 23A.
Figure 23C:
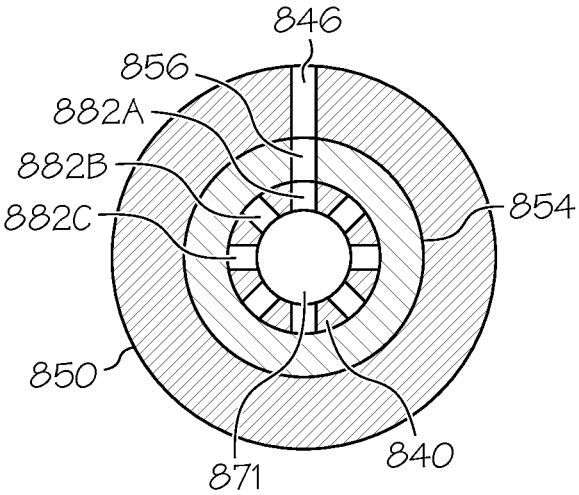
FIG. 23C is a cross-sectional view of the seal and fluid shaft of FIGS. 22, 23A, and 23B, positioned in a cartridge body.

FIG. 23A is a close-up perspective view of the seal 854 and the fluid shaft 840 of FIG. 22, wherein a fluid inlet 882 of the shaft 840 is in alignment with a seal opening 856. FIG. 23B is a front view of the fluid shaft 840 of FIGS. 22 and 23A. FIG. 23C is a cross-sectional view of the seal 854 and fluid shaft 840 of FIGS. 22, 23A, and 23B positioned in a cartridge assembly 850.

Figure 24:
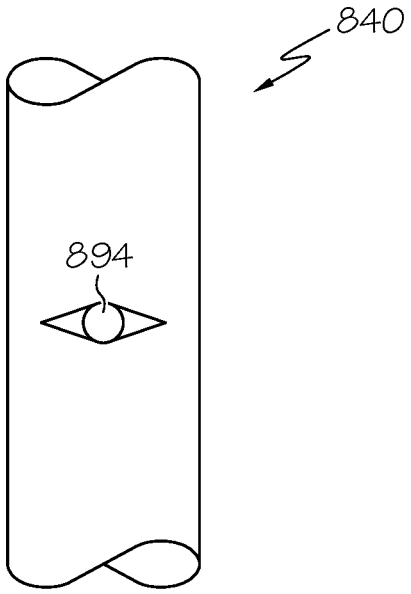
FIG. 24 is a view of a fluid shaft comprising a tapered inlet port, in accordance with another embodiment.

The fluid shaft 840 can have a plurality of inlet ports 882A, 882B, 882C (generally, 882) about a cross-sectional surface of the fluid shaft 840. In other embodiments, the fluid shaft 840 has one inlet port 882. The inlet ports 882 can have a configuration similar to the inlet ports 782 described in FIG. 17, for example, round, oval-shaped, and so on. The inlet ports 882 can include tapers similar to those described in FIGS. 18-21, for example the tapered inlet 894 shown in FIG. 24. Each inlet port 882 is in communication with a fluid path 871 in the feed screw 840 so that fluid can be transferred from the inlet port to the fluid path 871 during a dispensing operation.

A seal 854 can be positioned about the fluid shaft 840 between the top shaft seal 851 and the bottom shaft seal 252, and between the inlet ports 882 of the fluid shaft 840 and a feed aperture 846 in the cartridge assembly 850. In one embodiment, the seal 854 includes a single opening 856. In another embodiment, the seal 854 includes a plurality of openings 856 positioned about the seal 854, wherein each opening 856 is part of a compartment in the seal 854 that can receive a fluid material. Each compartment is configured to prevent fluid material from leaking into other compartments. The seal 854 can be held in place in the cartridge assembly 850 relative to the fluid shaft 840. In this manner, during a dispensing operation, the opening 856 can be aligned with the feed aperture 846 to output material to the fluid path 871 in the fluid shaft 840. In particular, the pump system 800 can be at an open state, where fluid is dispensed. For example, when the fluid shaft 840 is in a first rotational position, the inlet port 882 can be exposed to the feed aperture 846 via the seal opening 856. The pump system 800 can transition to/from a closed state, where fluid is prevented from being dispensed when the fluid shaft is in a second rotational position and partially or completely blocked by the seal 854.

In an embodiment, the seal 854 positioned in the cartridge assembly 850 can be stationary while the shaft 840 rotates about an axis A until one inlet port 882A, 882B, and so on, is aligned with the seal opening 856. Here, fluid material can enter the feed aperture 846 in the cartridge assembly 850 to the seal opening 856, which exposes the inlet port 882 to the feed aperture 846. The shaft 840 can rotate in a single direction, for example, clockwise, during a dispensing operation. The pump can be in a first state when the inlet port 882 of the shaft 840 is aligned with the seal opening 846 and the feed aperture 846, and can be in a second state when the inlet port 882 is blocked by the seal 854, thereby preventing fluid material 882 from being output to the fluid path 871 in the feed screw 840. In another embodiment, the shaft 840 remains stationary, while the cartridge assembly 850 rotates about the axis A during a dispensing operation.

Figure 25A:
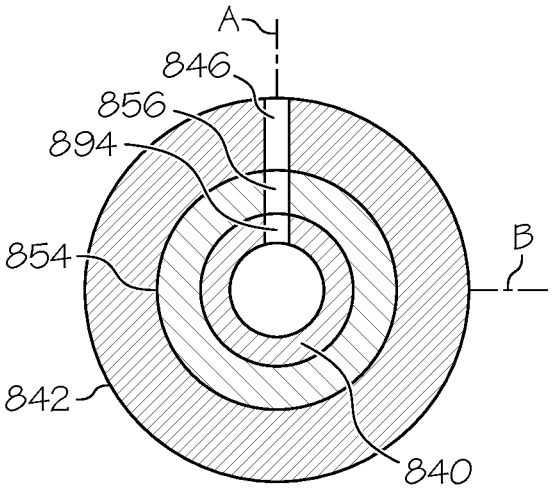
FIG. 25A is a cross-sectional view of a fluid pump cartridge and a fluid shaft in an open position with respect to each other, wherein a feed aperture and a seal opening of the fluid pump cartridge are in alignment with an inlet port of the fluid shaft, in accordance with an embodiment of the present inventive concepts.
Figure 25B:
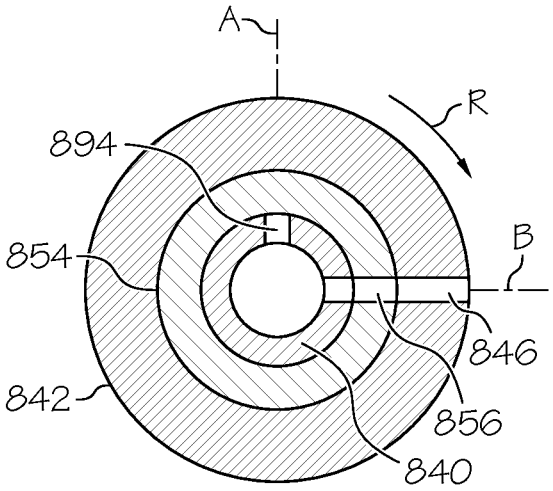
FIG. 25B is a cross-sectional of the seal and fluid shaft of FIG. 25A in a closed position with respect to each other.

FIG. 25A is a cross-sectional view of a fluid pump cartridge body 842 and a fluid shaft 840 in an open position with respect to each other, where a feed aperture 846 and a seal opening 856 of the fluid pump cartridge body 842 are in alignment with an inlet port 882 of the fluid shaft, in accordance with an embodiment of the present inventive concepts. FIG. 25B is a cross-sectional of the seal 854 and fluid shaft 840 of FIG. 25A in a closed position with respect to each other. In an embodiment, the fluid shaft 840 can rotate back and forth between the open position in FIG. 25A and the closed position in FIG. 25B while the cartridge body 842 is stationary. For example, as shown in FIG. 25B, the fluid shaft 840 can rotate in a direction R from the open position in FIG. 25A to the closed position in FIG. 25B. In another embodiment, the cartridge body 842, and therefore the seal 854, can rotate back and forth between the open position in FIG. 25A and the closed position in FIG. 25B, while the fluid shaft 840 is stationary.

Figure 26:
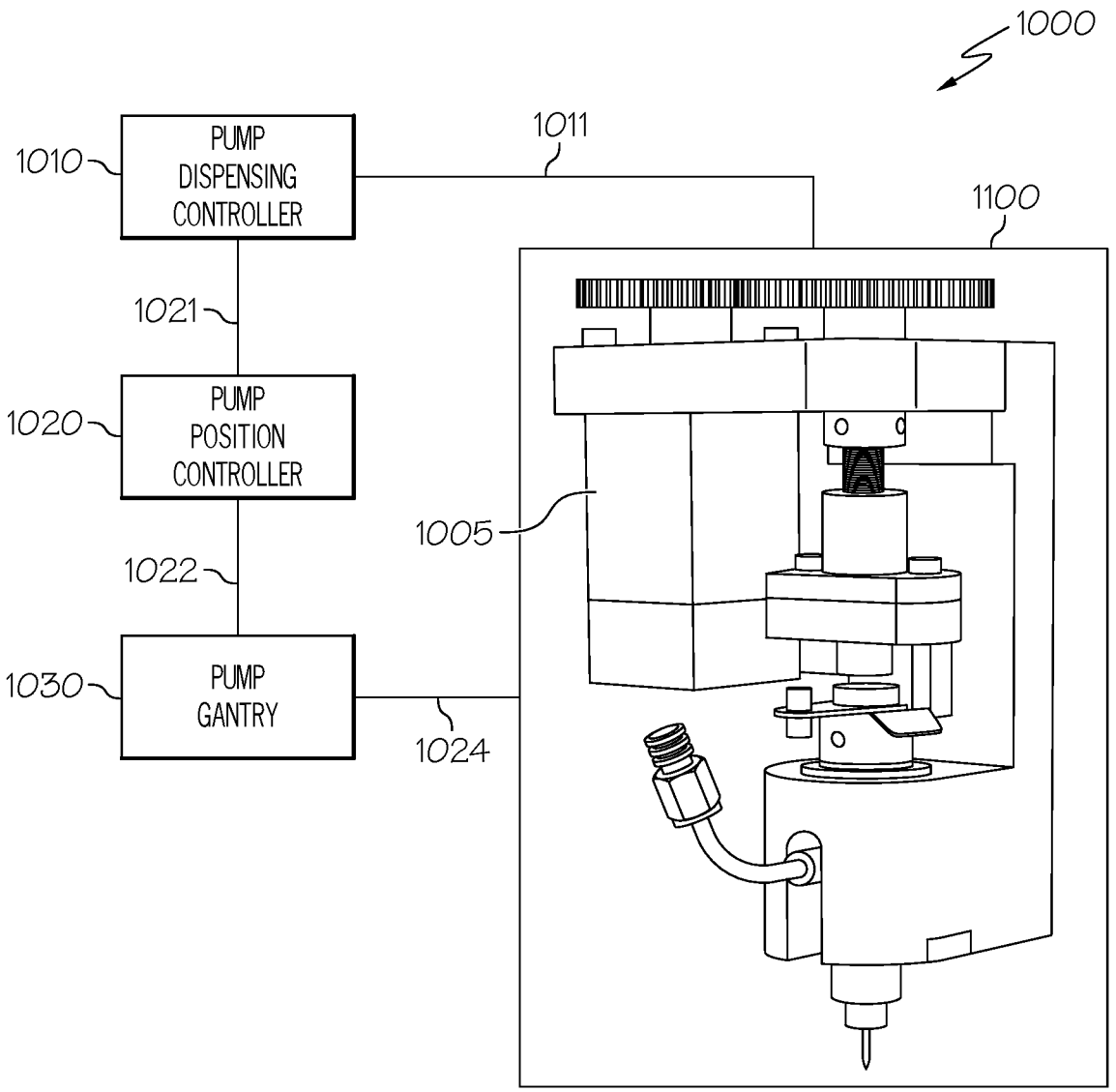
FIG. 26 is a system level diagrammatic view of a fluid dispensing system, in accordance with embodiments of the present inventive concepts.

FIG. 26 is a system level diagrammatic view of a fluid dispensing system 1000, in accordance with embodiments of the present inventive concepts. The fluid dispensing system 1000 can include a pump dispensing controller 1010, a pump position controller 1020, a pump gantry 1030 and a fluid dispense pump system 1100. The fluid dispense pump system 1100 can be the same as or similar to those described in the embodiments herein. The pump position controller 1020 and the pump dispensing controller 1010 may include one or more features of the gantry controller and the pump dispensing controller described in U.S. Pat. No. 6,892,959, the contents of which is incorporated herein above. The pump gantry 1030 can include a conventional pump gantry system.

The pump dispensing controller 1010 and pump position controller 1020 may be electrically coupled to a power source, such as an AC outlet. Although the pump dispensing controller 1010 and the pump position controller 1020 are shown as separate devices, the pump dispensing controller 1010 and the pump position controller 1020 may be combined as a single integrated device.

The pump position controller 1020 may be programmably configured to perform a dispensing operation, such as a dot dispensing operation and/or a line dispensing operation. During a dispensing operation, the pump position controller 1020 may be configured to generate position signals (e.g., Cartesian coordinates X, Y, Z) for moving an arm of the pump gantry 1030 to which the pump dispense system 1100 is connected. The position signals may be transmitted to the pump gantry 1030 via a signal connection 1022, which controls the motor 1005 of the pump dispense system 1100 via a signal connection 1024.

During a dispensing operation, the pump position controller 1020 can be further configured to transmit dispensing signals 1021 to the pump dispensing controller 1010, and can be configured to transmit position signals to the pump gantry system 1030. The dispensing signals generated by the pump position controller 1020 may include at least one of: a degree of fluid flow (e.g., 0% to 100%), a dot dispensing indicator, a line dispensing indicator and an amount of fluid to be dispensed.

The pump dispensing controller 1010 can be configured to transmit motor control signals to the fluid dispense pump system 1100 in response to dispensing signals received from the pump position controller 1020. The motor control signals may include at least one of: an acceleration control signal and a position control signal. The pump dispensing controller 1010 can be configured to control at least one of a position and a velocity of the fluid pump motor. The pump dispensing controller 1010 can be configured to command the motor to adjust a position of a fluid shaft inlet port relative to a fluid cavity of the fluid cartridge, or alternatively, to adjust a position of the fluid cartridge cavity relative to a fluid shaft inlet port, for example, described herein.

While the present inventive concepts have been particularly shown and described above with reference to exemplary embodiments thereof, it will be understood by those of ordinary skill in the art, that various changes in form and detail can be made without departing from the spirit and scope of the present inventive concepts.

What is claimed is:

1. A fluid dispense pump system, comprising:

a motor that drives a first gear in a first rotational direction;

a ball slide assembly coupled to a second gear, the second gear driven by the first gear about an axis in a second rotational direction opposite the first rotational direction, wherein the ball slide assembly includes a ball screw and a ball race nut, wherein the second gear rotates the ball screw so that the ball race nut translates in a linear direction along the axis perpendicular to the first and second rotational directions;

a removable cartridge assembly coupled to the ball slide assembly, the removable cartridge assembly having a cartridge body and a fluid shaft, the fluid shaft including at least one inlet port, an outlet, and a fluid path extending from the at least one inlet port to the outlet; and a feed aperture extending through a surface of the cartridge body, wherein in response to the ball race nut translating in the linear direction, one of the cartridge body and the fluid shaft moves relative to the other of the cartridge body and the fluid shaft along the axis to change a positional relationship between the at least one inlet port and the feed aperture for outputting a controlled source of fluid from the feed aperture to the outlet during a dispensing operation.

2. The fluid dispense pump system of claim 1, further comprising a seal about the fluid shaft and between the fluid shaft and the cartridge body, the seal having an opening aligned with the cartridge feed aperture to output a flow of material from the fluid path via the at least one inlet port through the seal opening and the cartridge feed aperture or to prevent the flow of material by blocking the at least one input port with the seal.

3. The fluid dispense pump system of claim 1, wherein the at least one inlet port has at least one taper extending in a direction about the fluid shaft to further control an output of fluid material from the fluid shaft.

4. The fluid dispense pump system of claim 1, wherein the motor is a closed-loop servo motor changing the position of the inlet port of the fluid shaft relative to the feed aperture by driving the other of the cartridge body and the fluid shaft in at least one of a linear direction along the axis and a radial direction about the axis during the dispensing operation.

5. The fluid dispense pump system of claim 1, further wherein the fluid shaft transitions between a first linear position along an axis so that the fluid path extends from the feed aperture of the cartridge body to the inlet port of the fluid shaft, and a second linear position along the axis to block a flow of fluid from the feed aperture to the inlet port.

6. The fluid dispense pump system of claim 1, further wherein the cartridge body transitions between a first linear position along an axis so that the fluid path extends from the feed aperture of the cartridge body to the inlet port of the fluid shaft, and a second linear position along the axis to block a flow of fluid from the feed aperture to the inlet port.

7. The fluid dispense pump system of claim 1, further comprising a pump dispensing controller that controls at least one of an index position and a velocity of the motor shaft.

8. The fluid dispense pump system of claim 7, further comprising:

a pump position controller that generates and outputs dispensing signals to the pump dispensing controller, wherein the pump dispensing controller in response controls the at least one of an index position and a velocity of the motor shaft by generating and outputting motor control signals to the motor to articulate the motor shaft; and a pump gantry having a movable arm, wherein the fluid dispense pump system is mounted to the movable arm; and the pump position controller transmits positioning signals to the pump gantry for moving the movable arm.

9. The fluid dispense pump system of claim 8, wherein the pump position controller is programmably configured to generate the dispensing signals and the positioning signals to perform one of a dot dispensing operation or a line dispensing operation.

10. The fluid dispense pump system of claim 8, wherein the dispensing signals are generated by the pump position controller to include at least one of: a degree of fluid flow, a dot dispensing indicator, a line dispensing indicator and an amount of fluid to be dispensed.

11. A fluid dispense pump system, comprising:

a motor that drives a first gear in a first rotational direction;

a ball slide assembly coupled to a second gear, the second gear driven by the first gear about an axis in a second rotational direction opposite the first rotational direction, wherein the ball slide assembly includes a ball screw and a ball race nut, wherein the second gear rotates the ball screw so that the ball race nut translates in a linear direction along the axis perpendicular to the first and second rotational directions;

a removable cartridge assembly coupled to the ball slide assembly, the removable cartridge assembly having a cartridge body and a fluid shaft, the fluid shaft including at least one tapered inlet port, an outlet, and a fluid path extending from the inlet port to the outlet, the tapered inlet port including a taper funnel extending from the inlet port to control an introduction of fluid material to the fluid path during a dispensing operation; and a feed aperture extending through a surface of the cartridge body, wherein in response to the ball race nut translating in the linear direction, one of the cartridge body and the fluid shaft moves relative to the other of the cartridge body and the fluid shaft along the axis to change a positional relationship between the tapered inlet port and the feed aperture for further controlling the introduction of the fluid material to the fluid path during the dispensing operation.

12. The fluid dispense pump system of claim 11, wherein the taper funnel includes:

a first taper funnel that extends from a top region of the inlet port in the linear direction of the fluid shaft; and a second taper funnel extends from a bottom region of the fluid shaft inlet port in the linear direction.

13. The fluid dispense pump system of claim 12, wherein the first and second taper funnels provide a gradual introduction of fluid material to the fluid path regardless of whether fluid material is introduced to the inlet port during an upstroke or a downstroke of the one of the cartridge body and the fluid shaft.

14. The fluid dispense pump system of claim 11, further comprising:

a top shaft seal conformably seated above the feed aperture in a seal housing at a lower region of the cartridge body; and a bottom shaft seal conformably seated below the feed aperture in a seal housing at an upper region of the cartridge body, wherein the fluid path between the feed aperture and inlet port of the fluid shaft is between the top and bottom shaft seals.

15. The fluid dispense pump system of claim 14, wherein the top or bottom shaft seal is positioned over the fluid shaft inlet port to prevent fluid material from being transferred to the fluid path extending through the fluid shaft.

16. The fluid dispense pump system of claim 14, wherein a movement of the top or bottom shaft seal is controlled by the motor, thereby controlling, rate or size of an opening of the inlet port relative to the feed aperture.

17. The fluid dispense pump system of claim 14, wherein the dispensing operation includes a range of linear positions of the bottom shaft seal between a topmost position and a bottommost position, and wherein the bottom shaft seal translates in a downstroke direction along the fluid shaft until the inlet port is at least partially covered by the top shaft seal.

18. A method for dispensing fluid at a fluid dispense pump system, comprising:

driving, by a motor, a first gear in a first rotational direction;

driving, by the first gear, a second gear about an axis in a second rotational direction opposite the first rotational direction, the second gear coupled to a ball slide assembly that includes a ball screw and a ball race nut;

rotating, by the second gear, the ball screw so that the ball race nut translates in a linear direction along the axis perpendicular to the first and second rotational directions;

in response to the ball race nut translating in the linear direction, moving one of the cartridge body and the fluid shaft relative to the other of the cartridge body and the fluid shaft along the axis to change a positional relationship between an inlet port of the fluid shaft and a feed aperture of the cartridge for outputting a controlled source of fluid from the feed aperture to an outlet during a dispensing operation.

* * * * *